US009361872B2

(12) United States Patent
Park et al.

(10) Patent No.: US 9,361,872 B2
(45) **Date of Patent: *Jun. 7, 2016**

(54) SYSTEMS, METHODS, APPARATUS, AND COMPUTER-READABLE MEDIA FOR ADAPTIVE ACTIVE NOISE CANCELLATION

(71) Applicant: QUALCOMM Incorporated, San Diego, CA (US)

(72) Inventors: Hyun Jin Park, San Diego, CA (US); Kwokleung Chan, San Jose, CA (US); Ren Li, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 118 days.

This patent is subject to a terminal disclaimer.

(21) Appl. No.: 14/270,096

(22) Filed: May 5, 2014

(65) Prior Publication Data

US 2014/0233750 A1 Aug. 21, 2014

Related U.S. Application Data

(63) Continuation of application No. 12/833,780, filed on Jul. 9, 2010, now Pat. No. 8,737,636.

(60) Provisional application No. 61/224,616, filed on Jul. 10, 2009, provisional application No. 61/228,108, filed on Jul. 23, 2009, provisional application No. 61/359,977, filed on Jun. 30, 2010.

(51) Int. Cl.
*G10K 11/178* (2006.01)
*G10K 11/00* (2006.01)

(52) U.S. Cl.
CPC ..... *G10K 11/002* (2013.01); *G10K 11/178* (2013.01); *G10K 2210/108* (2013.01); *G10K 2210/1081* (2013.01); *G10K 2210/3028* (2013.01)

(58) Field of Classification Search
CPC ..... G10K 11/178; G10K 11/1788
USPC ..... 381/71.1, 71.6, 71.8, 71.11
See application file for complete search history.

(56) References Cited

U.S. PATENT DOCUMENTS

| | | | |
|---|---|---|---|
| 5,337,366 | A | 8/1994 | Eguchi |
| 5,388,080 | A | 2/1995 | Feintuch |
| 5,444,786 | A | 8/1995 | Raviv |
| 5,852,667 | A | 12/1998 | Pan |
| 6,728,380 | B1 | 4/2004 | Zhu |

(Continued)

FOREIGN PATENT DOCUMENTS

| | | | |
|---|---|---|---|
| EP | 0560364 | A | 9/1993 |
| EP | 1397024 | A | 3/2004 |

(Continued)

OTHER PUBLICATIONS

Davari, P. Designing an Active Noise Reduction Headphone. M.Sc. thesis, Mazandaran Univ., Jun. 9, 2008. 71 pp.

(Continued)

*Primary Examiner* — Disler Paul
(74) *Attorney, Agent, or Firm* — Espartaco Diaz Hidalgo

(57) ABSTRACT

An adaptive active noise cancellation apparatus performs a filtering operation in a first digital domain and performs adaptation of the filtering operation in a second digital domain.

30 Claims, 41 Drawing Sheets

(56) References Cited

U.S. PATENT DOCUMENTS

| | | | | |
|---|---|---|---|---|
| 7,522,877 | B1 | 4/2009 | Avellan | |
| 8,073,151 | B2 * | 12/2011 | Joho | G10K 11/178 381/71.6 |
| 8,090,114 | B2 * | 1/2012 | Burge | G10K 11/16 381/71.11 |
| 8,315,405 | B2 * | 11/2012 | Bakalos | G10K 11/178 381/71.1 |
| 8,345,888 | B2 * | 1/2013 | Carreras | G10K 11/1788 381/71.14 |
| 2001/0053229 | A1 | 12/2001 | Azizi | |
| 2005/0074129 | A1 | 4/2005 | Fan | |
| 2005/0075870 | A1 | 4/2005 | Chamberlain | |
| 2005/0251389 | A1 | 11/2005 | Zangi | |
| 2006/0188107 | A1 | 8/2006 | Inoue | |
| 2006/0251266 | A1 | 11/2006 | Saunders | |
| 2007/0233755 | A1 | 10/2007 | Ohdake | |
| 2008/0159549 | A1 | 7/2008 | Copley | |
| 2009/0041260 | A1 | 2/2009 | Jorgensen | |
| 2009/0220101 | A1 | 9/2009 | Bachmann | |
| 2009/0262951 | A1 | 10/2009 | Togawa | |
| 2010/0061564 | A1 | 3/2010 | Clemow | |
| 2010/0105447 | A1 | 4/2010 | Sibbald | |
| 2010/0166199 | A1 | 7/2010 | Seydoux | |
| 2010/0266137 | A1 | 10/2010 | Sibbald | |
| 2011/0007907 | A1 | 1/2011 | Park et al. | |
| 2011/0158419 | A1 | 6/2011 | Theverapperuma | |
| 2011/0188665 | A1 | 8/2011 | Burge | |
| 2011/0286606 | A1 | 11/2011 | Al-Naimi | |

FOREIGN PATENT DOCUMENTS

| | | | |
|---|---|---|---|
| JP | 5176211 | A | 7/1993 |
| JP | 07253701 | B | 10/1995 |
| JP | 2005257720 | A | 9/2005 |
| JP | 2009510503 | A | 3/2009 |
| TW | 522665 | B | 3/2003 |
| TW | 564654 | B | 12/2003 |
| TW | 569183 | B | 1/2004 |
| TW | I220816 | B | 9/2004 |
| TW | 1232032 | B | 5/2005 |
| WO | 02093774 | A | 11/2002 |
| WO | 2009081193 | A1 | 7/2009 |

OTHER PUBLICATIONS

Intl Search Report and Written Opinion—PCT/US2010/041663, Int'l Search Authority—European Pat. Off.—Oct. 25, 2010.

Kim, I.-S. et al. Constraint filtered-x and filterd-u least-mean-square algorithms for the active control of noise in ducts. J. Acoust. Soc. Am. 95(6), Jun. 1994, pp. 3379-3389.

Kuo, S.M. et al. Active Noise Control: A Tutorial Review. Proc. IEEE, vol. 87, No. 6, Jun. 1999, pp. 943-973.

Kuo, S.M. et al. Review of Dsp Algorithms for Active Noise Control. Proc. 2000 IEEE Intl. Conf. On Control App., Anchorage, AK, Sep. 25-27, 2000, pp. 243-248.

Manikandan, S. Literature survey of active noise control systems. Academic Open Internet Journal (www-dot-acadjournal-dot-com), vol. 17, 2006, 11 pp.

Mosquera, C. et al. Adaptive IIR filters for active noise control. Sixth Intl. Congress on Sound and Vibration, Copenhagen, DK, Jul. 5-8, 1999, pp. 1571-1582.

Noor, et al. Improved, Low Complexity Noise Cancellation Technique for Speech Signals. Dept. Electr. Electron. and Syst. Engr., Faculty of Engr. and Built Environ., Univ. Kebangsaan Malaysia, UKM, 43600 Bangi, Selangor, Malaysia, 2009, pp. 272-278.

Taiwan Search Report—TW099122904—TIPO—Oct. 24, 2013.

* cited by examiner

SYSTEMS, METHODS, APPARATUS, AND COMPUTER-READABLE MEDIA FOR ADAPTIVE ACTIVE NOISE CANCELLATION

CLAIM OF PRIORITY UNDER 35 U.S.C. §119

This patent application is a continuation application of U.S. patent application Ser. No. 12/833,780, entitled "SYSTEMS, METHODS, APPARATUS, AND COMPUTER-READABLE MEDIA FOR ADAPTIVE ACTIVE NOISE CANCELLATION," filed Jul. 9, 2010, which claims priority to U.S. Provisional Pat. Appl. No. 61/224,616, entitled "SYSTEMS, METHODS, APPARATUS, AND COMPUTER-READABLE MEDIA FOR ADAPTIVE ACTIVE NOISE CANCELLATION," filed Jul. 10, 2009; to U.S. Provisional Pat. Appl. No. 61/228,108, entitled "SYSTEMS, METHODS, APPARATUS, AND COMPUTER-READABLE MEDIA FOR ADAPTIVE ACTIVE NOISE CANCELLATION," filed Jul. 23, 2009; and to U.S. Provisional Pat. Appl. No. 61/359,977, entitled "SYSTEMS, METHODS, APPARATUS, AND COMPUTER-READABLE MEDIA FOR ADAPTIVE ACTIVE NOISE CANCELLATION," filed Jun. 30, 2010.

BACKGROUND

1. Field

This disclosure relates to audio signal processing.

2. Background

Active noise cancellation (ANC, also called active noise reduction) is a technology that actively reduces acoustic noise in the air by generating a waveform that is an inverse form of the noise wave (e.g., having the same level and an inverted phase), also called an "antiphase" or "anti-noise" waveform. An ANC system generally uses one or more microphones to pick up an external noise reference signal, generates an anti-noise waveform from the noise reference signal, and reproduces the anti-noise waveform through one or more loudspeakers. This anti-noise waveform interferes destructively with the original noise wave to reduce the level of the noise that reaches the ear of the user.

Active noise cancellation techniques may be applied to personal communications device, such as cellular telephones, and sound reproduction devices, such as headphones, to reduce acoustic noise from the surrounding environment. In such applications, the use of an ANC technique may reduce the level of background noise that reaches the ear by up to twenty decibels while delivering useful sound signals, such as music and far-end voices. In headphones for communications applications, for example, the equipment usually has a microphone and a loudspeaker, where the microphone is used to capture the user's voice for transmission and the loudspeaker is used to reproduce the received signal. In such case, the microphone may be mounted on a boom or on an earcup and/or the loudspeaker may be mounted in an earcup or earplug.

SUMMARY

A method of producing an antinoise signal according to a general configuration includes producing the antinoise signal during a first time interval by applying a digital filter to a reference noise signal in a filtering domain having a first sampling rate. This method includes producing the antinoise signal during a second time interval subsequent to the first time interval by applying the digital filter to the reference noise signal in the filtering domain. During said first time interval, the digital filter has a first filter state, and during the second time interval, the digital filter has a second filter state different than the first filter state. This method includes calculating the second filter state in an adaptation domain having a second sampling rate that is lower than the first sampling rate, based on information from the reference noise signal and information from an error signal. Computer-readable media having tangible features that store machine-executable instructions for such a method are also disclosed herein.

An apparatus for producing an antinoise signal according to a general configuration includes means for producing the antinoise signal during a first time interval by applying a digital filter to a reference noise signal in a filtering domain having a first sampling rate. This apparatus includes means for producing the antinoise signal during a second time interval subsequent to the first time interval by applying the digital filter to the reference noise signal in the filtering domain. During said first time interval, the digital filter has a first filter state, and during the second time interval, the digital filter has a second filter state different than the first filter state. This method includes means for calculating the second filter state in an adaptation domain having a second sampling rate that is lower than the first sampling rate, based on information from the reference noise signal and information from an error signal.

An apparatus for producing an antinoise signal according to a general configuration includes a digital filter configured to produce the antinoise signal during a first time interval by filtering a reference noise signal, according to a first filter state, in a filtering domain having a first sampling rate. This apparatus also includes a control block configured to calculate, in an adaptation domain having a second sampling rate that is lower than the first sampling rate, a second filter state based on information from the reference noise signal and information from an error signal, wherein the second filter state is different than the first filter state. In this apparatus, the digital filter is configured to produce the antinoise signal during a second time interval subsequent to the first time interval by filtering the reference noise signal in the filtering domain according to the second filter state.

An apparatus for producing an antinoise signal according to another general configuration includes an integrated circuit configured to produce the antinoise signal during a first time interval by filtering a reference noise signal, according to a first filter state, in a filtering domain having a first sampling rate. This apparatus also includes a computer-readable medium having tangible structures that store machine-executable instructions which when executed by at least one processor cause the at least one processor to calculate, in an adaptation domain having a second sampling rate that is lower than the first sampling rate, a second filter state based on information from the reference noise signal and information from an error signal, wherein the second filter state is different than the first filter state. In this apparatus, the integrated circuit is configured to produce the antinoise signal during a second time interval subsequent to the first time interval by filtering the reference noise signal in the filtering domain according to the second filter state.

DETAILED DESCRIPTION

Figure 1A:
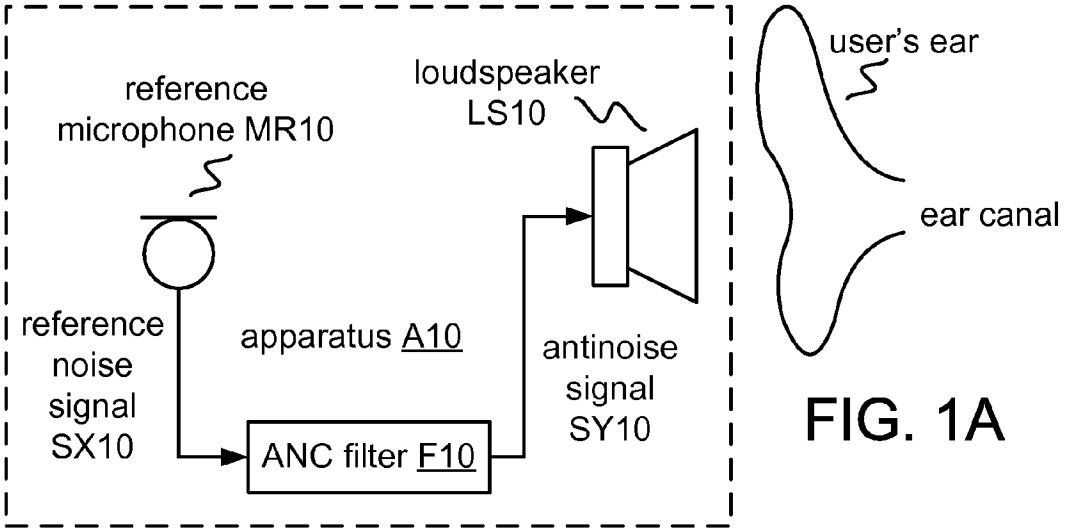
FIG. 1A shows a block diagram of a feedforward ANC apparatus A10.

The principles described herein may be applied, for example, to a headset or other communications or sound reproduction device that is configured to perform an ANC operation.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Where the term "comprising" is used in the present description and claims, it does not exclude other elements or operations. The term "based on" (as in "A is based on B") is used to indicate any of its ordinary meanings, including the cases (i) "based on at least" (e.g., "A is based on at least B") and, if appropriate in the particular context, (ii) "equal to" (e.g., "A is equal to B").

Similarly, the term "in response to" is used to indicate any of its ordinary meanings, including "in response to at least."

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Any incorporation by reference of a portion of a document shall also be understood to incorporate definitions of terms or variables that are referenced within the portion, where such definitions appear elsewhere in the document, as well as any figures referenced in the incorporated portion.

An ANC apparatus usually has a microphone arranged to capture a reference acoustic noise signal from the environment and/or a microphone arranged to capture an acoustic error signal after the noise cancellation. In either case, the ANC apparatus uses the microphone input to estimate the noise at that location and produces an antinoise signal which is a modified version of the estimated noise. The modification typically includes filtering with phase inversion and may also include gain amplification.

FIG. 1A shows a block diagram of an example A10 of an ANC apparatus that includes a feedforward ANC filter F10 and a reference microphone MR10 that is disposed to sense ambient noise. Filter F10 is arranged to receive a reference noise signal SX10 that is based on a signal produced by reference microphone MR10 and to produce a corresponding antinoise signal SY10. Apparatus A10 also includes a loudspeaker LS10 that is configured to produce an acoustic signal based on antinoise signal SY10. Loudspeaker LS10 is arranged to direct the acoustic signal at or even into the user's ear canal such that the ambient noise is attenuated or canceled before reaching the user's eardrum (also referred to as the "quiet zone"). Apparatus A10 may also be implemented to produce reference noise signal SX10 based on information from signals from more than one instance of reference microphone MR10 (e.g., via a filter configured to perform a spatially selective processing operation, such as beamforming, blind source separation, gain and/or phase analysis, etc.).

As described above, an ANC apparatus may be configured to use one or more microphones (e.g., reference microphone MR10) to pick up acoustic noise from the background. Another type of ANC system uses a microphone (possibly in addition to a reference microphone) to pick up an error signal after the noise reduction. An ANC filter in a feedback arrangement is typically configured to inverse the phase of the error signal and may also be configured to integrate the error signal, equalize the frequency response, and/or to match or minimize the delay.

Figure 1B:
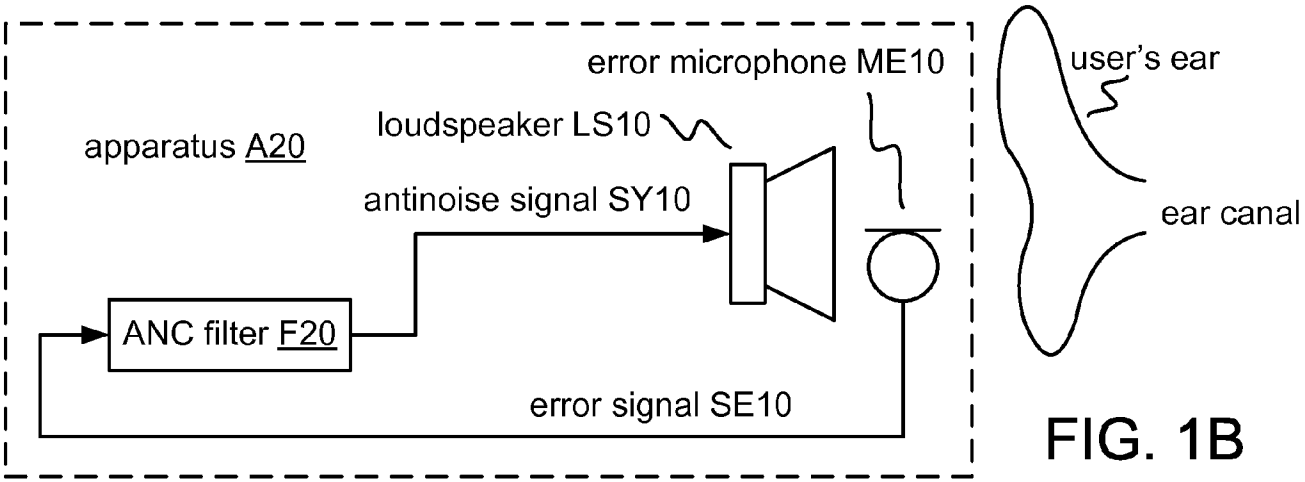
FIG. 1B shows a block diagram of a feedback ANC apparatus A20.

FIG. 1B shows a block diagram of an example A20 of an ANC apparatus that includes a feedback ANC filter F20 and an error microphone ME10 that is disposed to sense sound at a user's ear canal, including sound (e.g., an acoustic signal based on antinoise signal SY10) produced by loudspeaker LS10. Filter F20 is arranged to receive an error signal SE10 that is based on a signal produced by error microphone ME10 and to produce a corresponding antinoise signal SY10.

It is typically desirable to configure the ANC filter (e.g., filter F10, filter F20) to generate an antinoise signal SY10 that is matched with the acoustic noise in amplitude and opposite to the acoustic noise in phase. Signal processing operations such as time delay, gain amplification, and equalization or lowpass filtering may be performed to achieve optimal noise cancellation. It may be desirable to configure the ANC filter to high-pass filter the signal (e.g., to attenuate high-amplitude, low-frequency acoustic signals). Additionally or alternatively, it may be desirable to configure the ANC filter to low-pass filter the signal (e.g., such that the ANC effect diminishes with frequency at high frequencies). Because the antinoise signal should be available by the time the acoustic noise travels from the microphone to the actuator (i.e., loudspeaker LS10), the processing delay caused by the ANC filter should not exceed a very short time (typically about thirty to sixty microseconds).

Filter F10 includes a digital filter, such that ANC apparatus A10 will typically be configured to perform analog-to-digital conversion on the signal produced by reference microphone MR10 to produce reference noise signal SX10 in digital form. Similarly, filter F20 includes a digital filter, such that ANC apparatus A20 will typically be configured to perform analog-to-digital conversion on the signal produced by error microphone ME10 to produce error signal SE10 in digital form. Examples of other preprocessing operations that may be performed by the ANC apparatus upstream of the ANC filter in the analog and/or digital domain include spectral shaping (e.g., low-pass, high-pass, and/or band-pass filtering), echo cancellation (e.g., on error signal SE10), impedance matching, and gain control. For example, the ANC apparatus (e.g., apparatus A10) may be configured to perform a high-pass filtering operation (e.g., having a cutoff frequency of 50, 100, or 200 Hz) on the signal upstream of the ANC filter.

The ANC apparatus will typically also include a digital-to-analog converter (DAC) arranged to convert antinoise signal SY10 to analog form upstream of loudspeaker LS10. As noted below, it may also be desirable for the ANC apparatus to mix a desired sound signal with the antinoise signal (in either the analog or digital domain) to produce an audio output signal for reproduction by loudspeaker LS10. Examples of such desired sound signals include a received (i.e. far-end) voice communications signal, a music or other multimedia signal, and a sidetone signal.

Figure 2B:
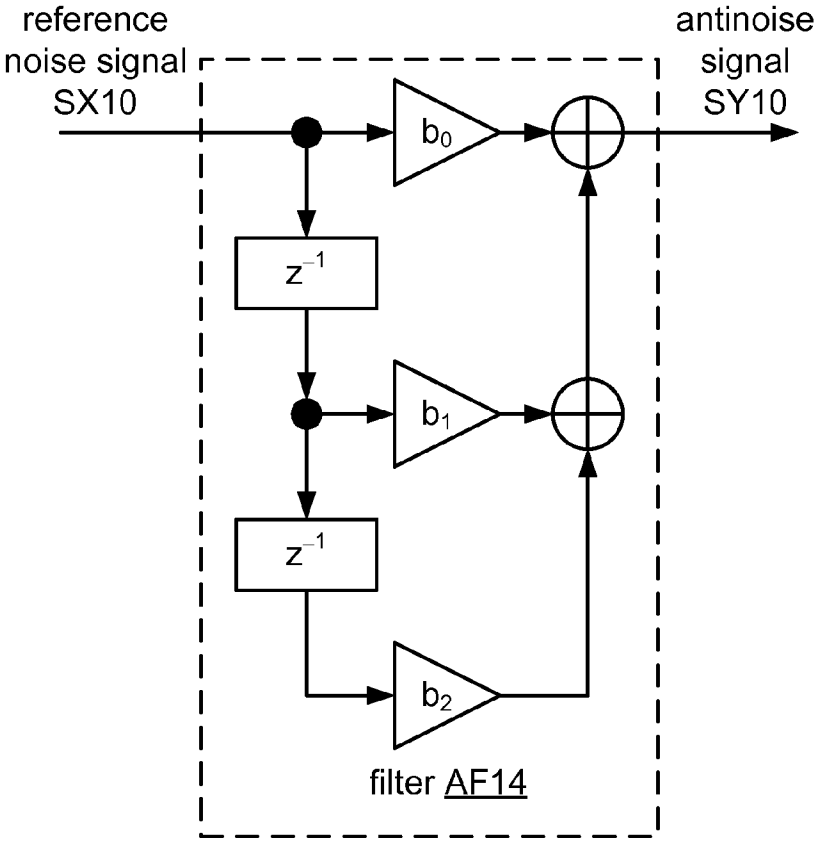
FIG. 2B shows a block diagram of an implementation AF14 of filter AF10.
Figure 2A:
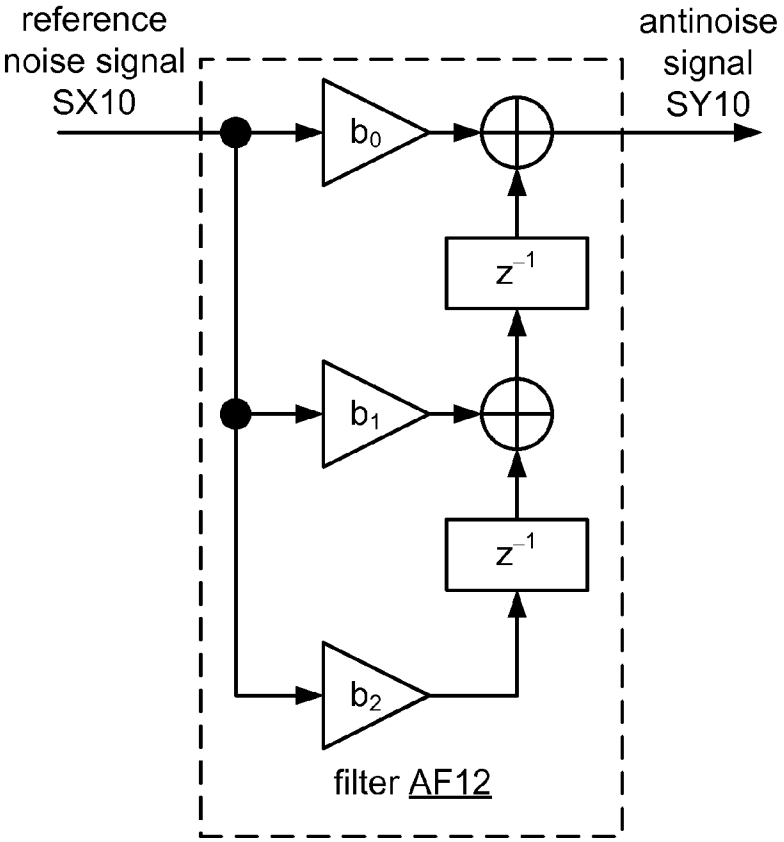
FIG. 2A shows a block diagram of an implementation AF12 of filter AF10.

FIG. 2A shows a block diagram of a finite-impulse-response (FIR) implementation AF12 of feedforward ANC filter AF10. In this example, filter AF12 has a transfer function $B(z)=b_0+b_1*z^{-1}+b_2*z^{-2}$ that is defined by the values of the filter coefficients (i.e., feedforward gain factors $b_0$, $b_1$, and $b_2$). Although a second-order FIR filter is shown in this example, an FIR implementation of filter AF10 may include any number of FIR filter stages (i.e., any number of filter coefficients), depending on factors such as maximum allowable delay. For a case in which reference noise signal SX10 is one bit wide, each of the filter coefficients may be implemented using a polarity switch (e.g., an XOR gate). FIG. 2B shows a block diagram of an alternate implementation AF14 of FIR filter AF12. Feedback ANC filter AF20 may be implemented as an FIR filter according to the same principles discussed above with reference to FIGS. 2A and 2B.

Figure 3:
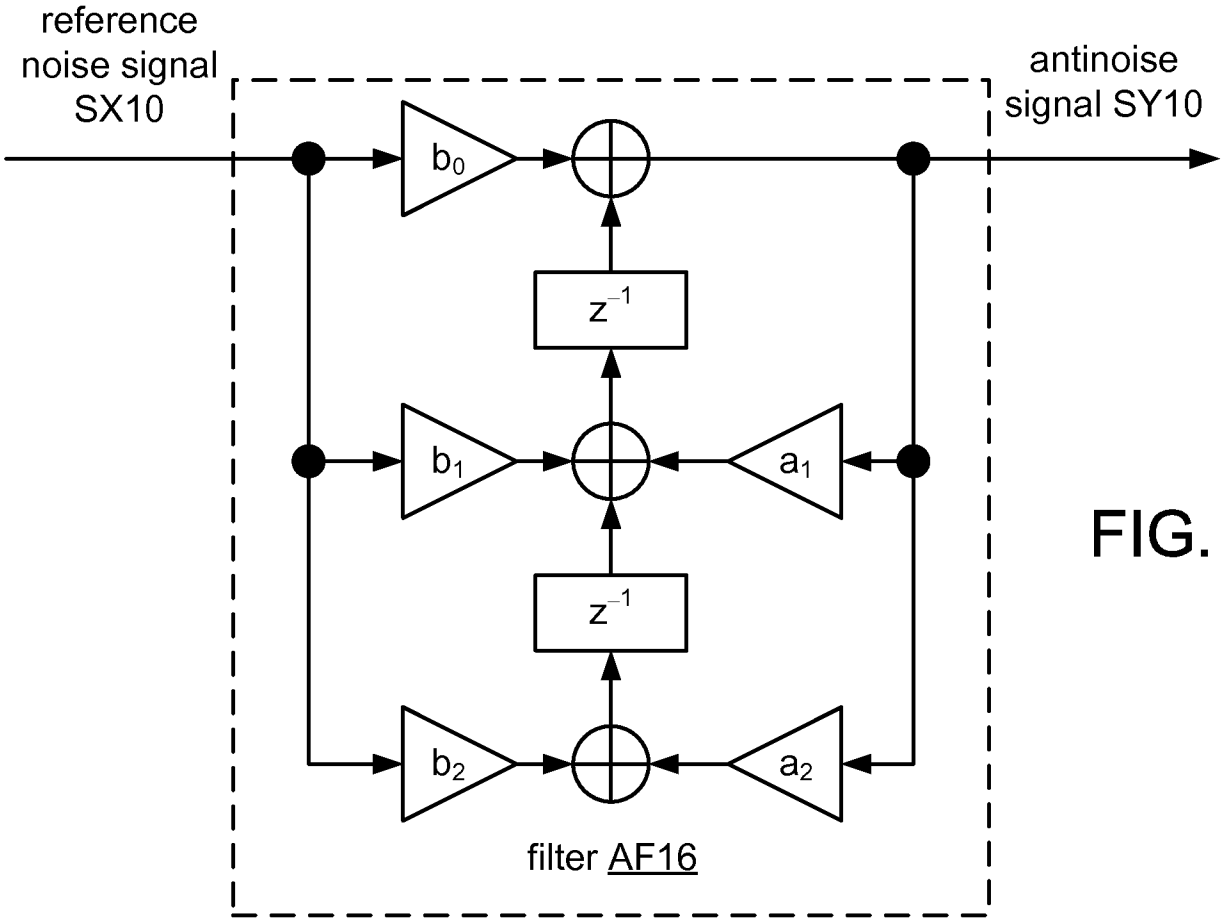
FIG. 3 shows a block diagram of an implementation AF16 of filter AF10.

FIG. 3 shows a block diagram of an infinite-impulse-response (IIR) implementation AF16 of filter AF10. In this example, filter AF16 has the transfer function $B(z)/(1-A(z))=(b_0+b_1*z^{-1}+b_2*z^{-2})/(1-a_1*z^{-1}-a_2*z^{-2})$ that is defined by the values of the filter coefficients (i.e., feedforward gain factors $b_0$, $b_1$, and $b_2$ and feedback gain factors $a_1$ and $a_2$). Although a second-order IIR filter is shown in this example, an IIR implementation of filter AF10 may include any number of filter stages (i.e., any number of filter coefficients) on either of the feedback side (i.e., the denominator of the transfer function) and the feedforward side (i.e., the numerator of the transfer function), depending on factors such as maximum allowable delay. For a case in which reference noise signal SX10 is one bit wide, each of the filter coefficients may be implemented using a polarity switch (e.g., an XOR gate). Feedback ANC filter AF20 may be implemented as an IIR filter according to the same principles discussed above with reference to FIG. 3. Either of filters F10 and F20 may also be implemented as a series of two or more FIR and/or IIR filters.

Figure 4A:
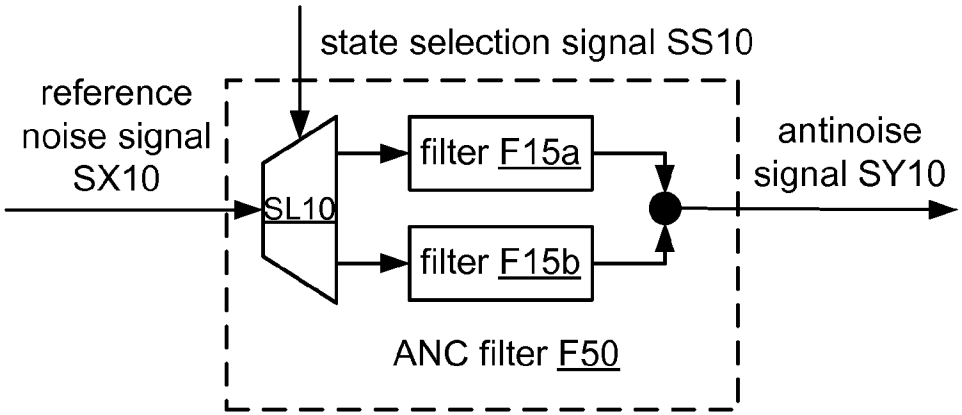
FIG. 4A shows a block diagram of an adaptive implementation F50 of filter F10.

An ANC filter may be configured to have a filter state that is fixed over time or, alternatively, a filter state that is adaptable over time. An adaptive ANC filtering operation can typically achieve better performance over an expected range of operating conditions than a fixed ANC filtering operation. In comparison to a fixed ANC approach, for example, an adaptive ANC approach can typically achieve better noise cancellation results by responding to changes in the ambient noise and/or in the acoustic path. FIG. 4A shows a block diagram of an adaptable implementation F50 of ANC filter F10 that includes a plurality of different fixed-state implementations F15*a* and F15*b* of filter F10. Filter F50 is configured to select one among the component filters F15*a* and F15*b* according to a state of state selection signal SS10. In this example, filter F50 includes a selector SL10 that directs reference noise signal SX10 to the filter indicated by the current state of state selection signal SS10. ANC filter F50 may also be implemented to include a selector that is configured to select the output of one of the component filters according to the state of selection signal SS10. In such case, selector SL10 may also be present, or may be omitted such that all of the component filters receive reference noise signal SX10.

The plurality of component filters of filter F50 may differ from one another in terms of one or more response characteristics, such as gain, low-frequency cutoff frequency, low-frequency rolloff profile, high-frequency cutoff frequency, and/or high-frequency rolloff profile. Each of the component filters F15*a* and F15*b* may be implemented as an FIR filter, as an IIR filter, or as a series of two or more FIR and/or IIR filters. Although two selectable component filters are shown in the example of FIG. 4A, any number of selectable component filters may be used, depending on factors such as maximum allowable complexity. Feedback ANC filter AF20 may be implemented as an adaptable filter according to the same principles discussed above with reference to FIG. 4A.

Figure 4B:
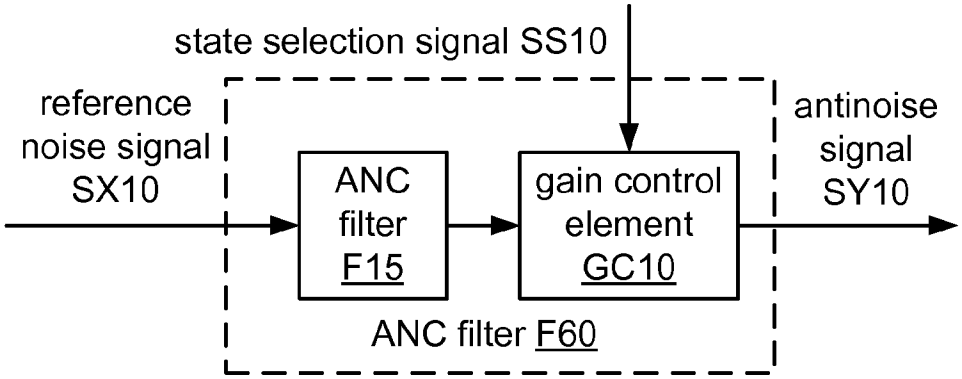
FIG. 4B shows a block diagram of an adaptive implementation F60 of filter F10.

FIG. 4B shows a block diagram of another adaptable implementation F60 of ANC filter F10 that includes a fixed-state implementation F15 of filter F10 and a gain control element GC10. Filter F15 may be implemented as an FIR filter, as an IIR filter, or as a series of two or more FIR and/or IIR filters. Gain control element GC10 is configured to amplify and/or attenuate the output of ANC filter F15 according to a filter gain update indicated by the current state of state selection signal SS10. Gain control element GC10 may be implemented such that the filter gain update is a linear or logarithmic gain factor to be applied to the output of filter F15, or a linear or logarithmic change (e.g., an increment or decrement) to be applied to a current gain factor of gain control element GC10. In one example, gain control element GC10 is implemented as a multiplier. In another example, gain control element GC10 is implemented as a variable-gain amplifier. Feedback ANC filter AF20 may be implemented as an adaptable filter according to the same principles discussed above with reference to FIG. 4B.

Figure 4C:
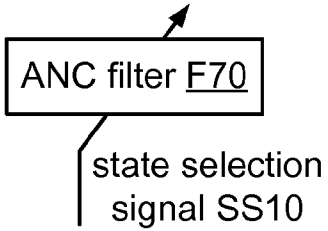
FIG. 4C shows a block diagram of an adaptive implementation F70 of filter F10.

It may be desirable to implement an ANC filter, such as filter F10 or F20, such that one or more of the filter coefficients have values that may change over time (i.e., are adaptable). FIG. 4C shows a block diagram of an adaptable implementation F70 of ANC filter F10 in which the state of state selection signal SS10 indicates a value for each of one or more of the filter coefficients. Filter F70 may be implemented as an FIR filter or as an IIR filter. Alternatively, filter F70 may be implemented as a series of two or more FIR and/or IIR filters in which one or more (possibly all) of the filters are adaptable and the rest have fixed coefficient values.

In an implementation of ANC filter F70 that includes an IIR filter, one or more (possibly all) of the feedforward filter coefficients and/or one or more (possibly all) of the feedback filter coefficients may be adaptable. Feedback ANC filter AF20 may be implemented as an adaptable filter according to the same principles discussed above with reference to FIG. 4C.

An ANC apparatus that includes an instance of adaptable filter F70 may be configured such that the latency introduced by the filter is adjustable (e.g., according to the current state of selection signal SS10). For example, filter F70 may be configured such that the number of delay stages is variable according to the state of selection signal SS10. In one such example, the number of delay stages is reduced by setting the values of the highest-order filter coefficients to zero. Such adjustable latency may be desirable especially for feedforward ANC designs (e.g., implementations of apparatus A10).

It is expressly noted that feedforward ANC filter F10 may also be configured as an implementation of two or more among component-selectable filter F50, gain-selectable filter F60, and coefficient value-selectable filter F70, and that feedback ANC filter F20 may be configured according to the same principles.

Figure 5A:
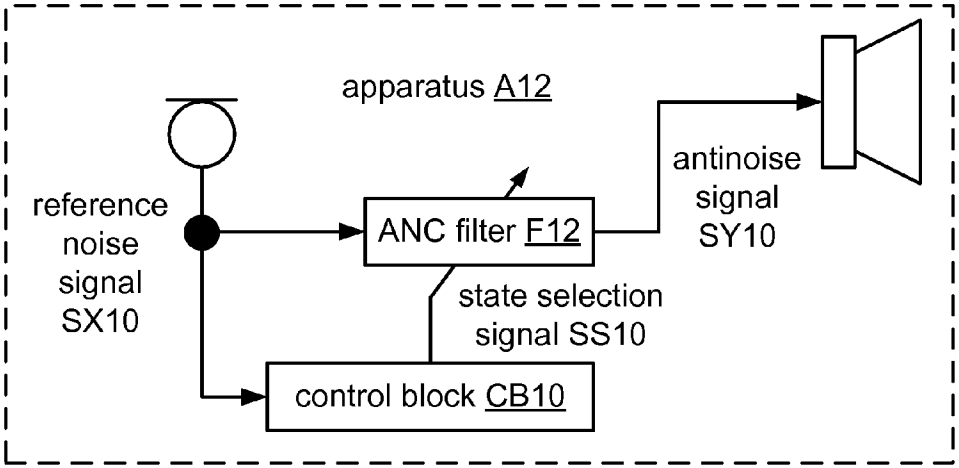
FIG. 5A shows a block diagram of an implementation A12 of apparatus A10.
Figure 5B:
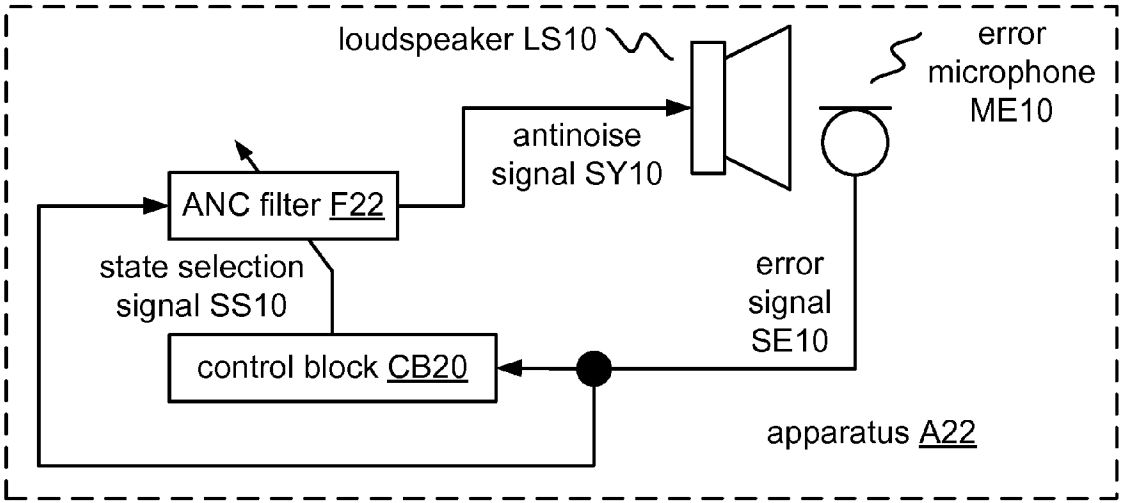
FIG. 5B shows a block diagram of an implementation A22 of apparatus A20.

It may be desirable to configure the ANC apparatus to generate state selection signal SS10 based on information from reference noise signal SX10 and/or information from error signal SE10. FIG. 5A shows a block diagram of an implementation A12 of ANC apparatus A10 that includes an adaptable implementation F12 of feedforward ANC filter F10 (e.g., an implementation of filter F50, F60, and/or F70). Apparatus A12 also includes a control block CB10 that is configured to generate state selection signal SS10 based on information from reference noise signal SX10. It may be desirable to implement control block CB10 as a set of instructions to be executed by a processor (e.g., a digital signal processor or DSP). FIG. 5B shows a block diagram of an implementation A22 of ANC apparatus A20 that includes an adaptable implementation F22 of feedback ANC filter F20 and a control block CB20 that is configured to generate state selection signal SS10 based on information from error signal SE10. It may be desirable to implement control block CB20 as a set of instructions to be executed by a processor (e.g., a DSP).

Figure 6A:
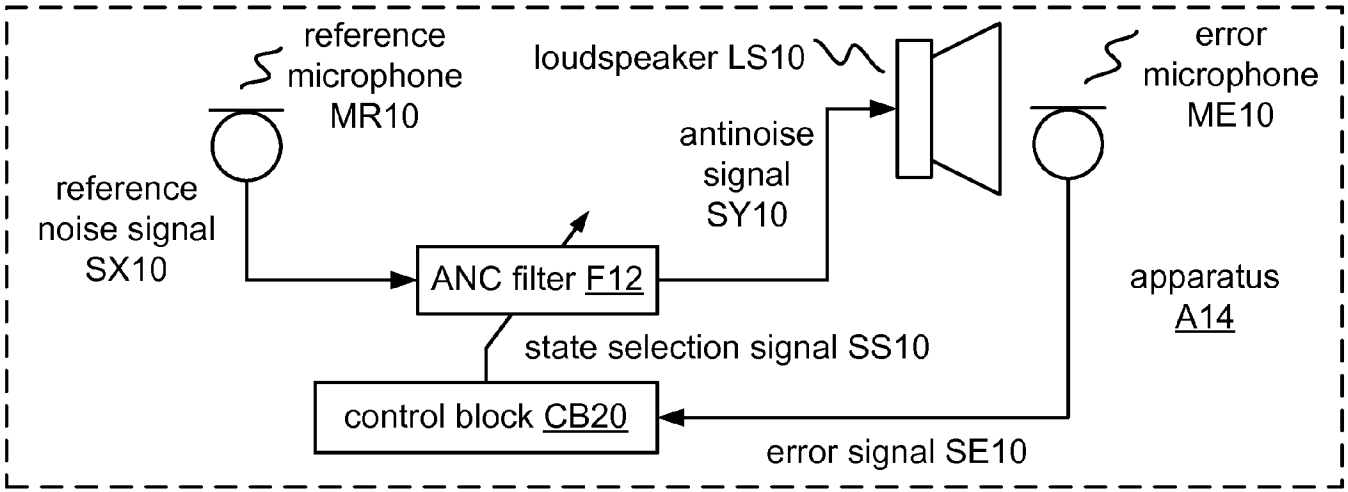
FIG. 6A shows a block diagram of an implementation A14 of apparatus A10.
Figure 6B:
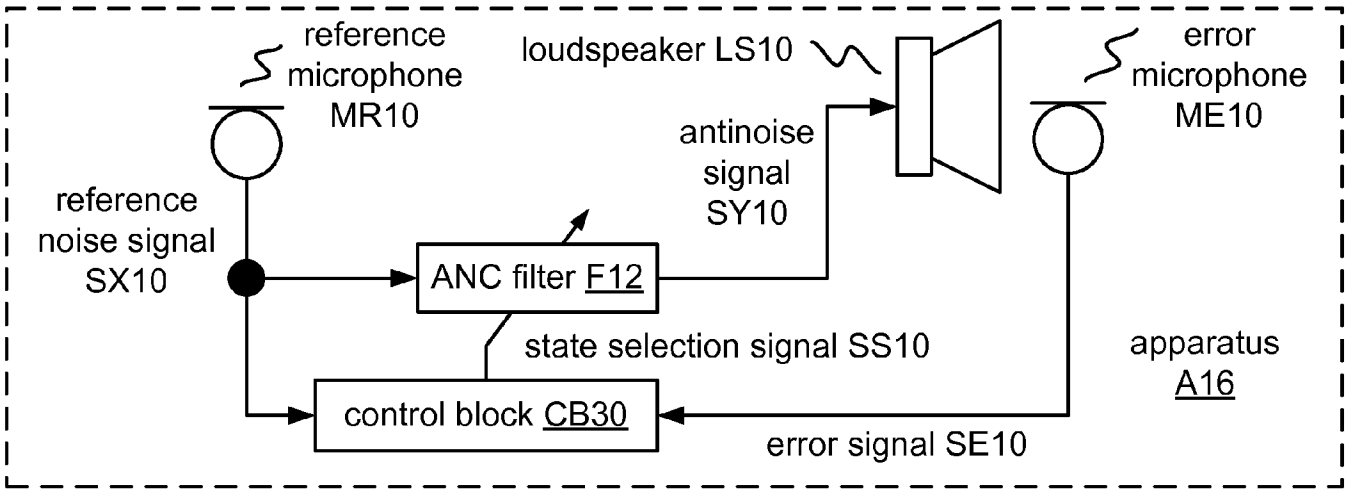
FIG. 6B shows a block diagram of an implementation A16 of apparatus A12 and A14.

FIG. 6A shows a block diagram of an implementation A14 of ANC apparatus A10 that includes error microphone ME10 and an instance of control block CB20 configured to generate state selection signal SS10 based on information from error signal SE10. FIG. 6B shows a block diagram of an implementation A16 of ANC apparatus A12 and A14 that includes an implementation CB30 of control block CB10 and CB20 that is configured to generate state selection signal SS10 based on information from reference noise signal SX10 and information from error signal SE10. It may be desirable to implement control block CB30 as a set of instructions to be executed by a processor (e.g., a DSP). It may be desirable to perform an echo cancellation operation on error signal SE10 upstream of control block CB20 or CB30.

It may be desirable to configure control block CB30 to generate state selection signal SS10 according to an implementation of a least-mean-squares (LMS) algorithm, which class includes filtered-reference ("filtered-X") LMS, filtered-error ("filtered-E") LMS, filtered-U LMS, and variants thereof (e.g., subband LMS, step size normalized LMS, etc.). For a case in which ANC filter F12 is an FIR implementation of adaptable filter F70, it may be desirable to configure control block CB30 to generate state selection signal SS10 to indicate an updated value for each of one or more of the filter coefficients according to an implementation of a filtered-X or filtered-E LMS algorithm. For a case in which ANC filter F12 is an IIR implementation of adaptable filter F70, it may be desirable to configure control block CB30 to generate state selection signal SS10 to indicate an updated value for each of one or more of the filter coefficients according to an implementation of the filtered-U LMS algorithm.

Figure 7:
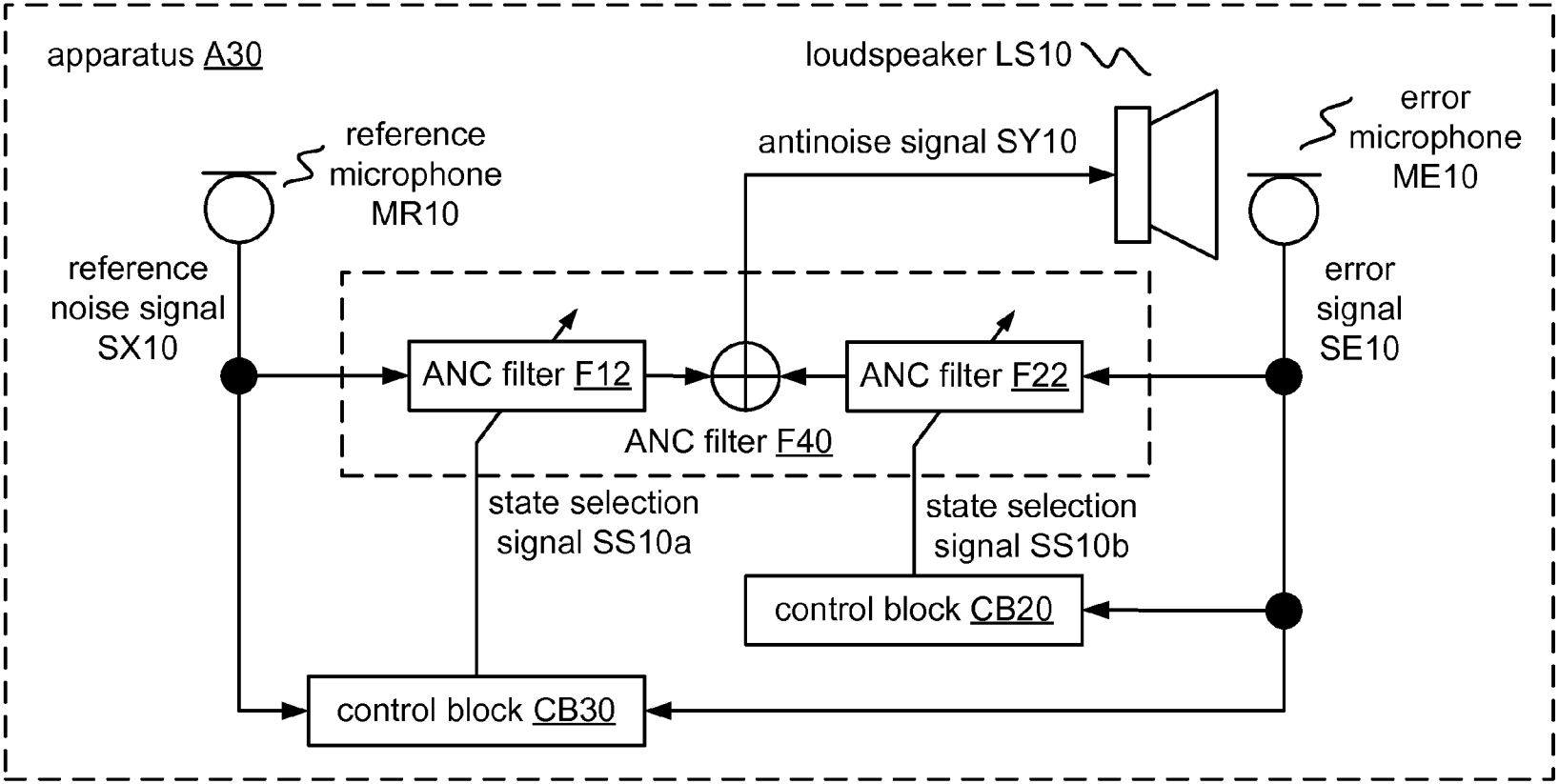
FIG. 7 shows a block diagram of an implementation A30 of apparatus A16 and A22.

FIG. 7 shows a block diagram of an implementation A30 of apparatus A16 and A22 that includes a hybrid ANC filter F40. Filter F40 includes instances of adaptable feedforward ANC filter F12 and adaptable feedback ANC filter F22. In this example, the outputs of filters F12 and F22 are combined to produce antinoise signal SY10. Apparatus A30 also includes an instance of control block CB30 that is configured to provide an instance SS10*a* of state selection signal SS10 to filter F12, and an instance of control block CB20 that is configured to provide an instance SS10*b* of state selection signal SS10 to filter F22.

Figure 8A:
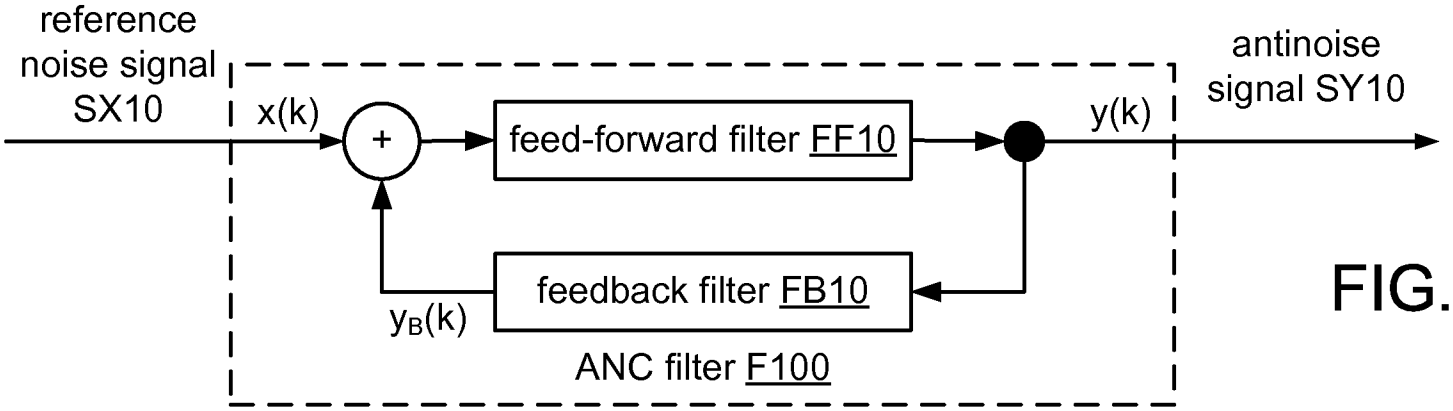
FIG. 8A shows a block diagram of an ANC filter F100 as an implementation of filter F10.

FIG. 8A shows a block diagram of an ANC filter F100 that includes a feed-forward IIR filter FF10 and a feedback IIR filter FB10. The transfer function of feed-forward filter FF10 may be expressed as B(z)/(1−A(z)), and the transfer function of feedback filter FB10 may be expressed as W(z)/(1−V(z)), where the component functions B(z), A(z), W(z), and V(z) are defined by the values of their filter coefficients (i.e., gain factors) according to the following expressions:

$$B(z)=b_0+b_1z^{-1}+b_2z^{-2}+\ldots$$

$$A(z)=a_1z^{-1}+a_2z^{-2}+\ldots$$

$$W(z)=w_0+w_1z^{-1}+w_2z^{-2}+\ldots$$

$$V(z)=v_1z^{-1}+v_2z^{-2}+\ldots$$

Figure 8B:
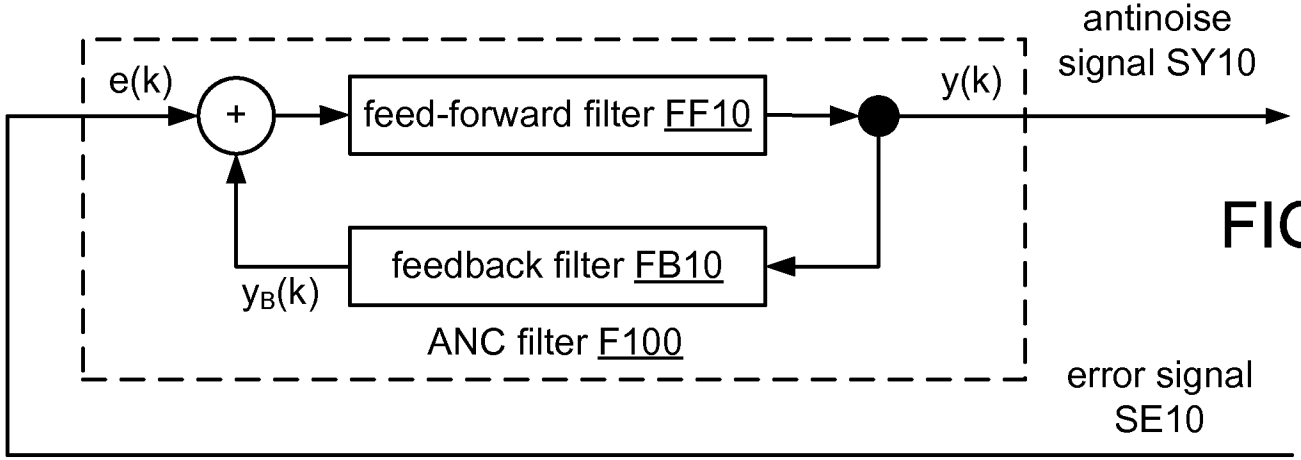
FIG. 8B shows a block diagram of ANC filter F100 as an implementation of filter F20.

Filter F100 may be arranged to perform a feed-forward ANC operation (i.e., as an implementation of ANC filter F10) or a feedback ANC operation (i.e., as an implementation of ANC filter F20). FIG. 8A shows filter F100 arranged as an implementation of feedforward ANC filter F10. In such case, feedback IIR filter FB10 may act to cancel acoustic leakage from reference microphone MR10. The label k denotes a time-domain sample index, x(k) denotes reference noise signal SX10, y(k) denotes antinoise signal SY10, and $y_B(k)$ denotes a feedback signal produced by feedback filter FB10. FIG. 8B shows filter F100 arranged as an implementation of feedback ANC filter F20. In such case, feedback IIR filter FB10 may act to remove antinoise signal SY10 from error signal SE10.

It is noted that feedforward filter FF10 may be implemented as an FIR filter by setting A(z) to zero (i.e., by setting each of the feedback coefficient values a of A(z) to zero). Similarly, feedback filter FB10 may be implemented as an FIR filter by setting V(z) to zero (i.e., by setting each of the feedback coefficient values v of V(z) to zero).

Either or both of feed-forward filter FF10 and feedback filter FB10 may be implemented to have fixed filter coefficients. In a fixed ANC approach, a feed-forward IIR filter and a feedback IIR filter form a full feedback IIR-type structure (e.g., a filter topology that includes a feedback loop formed by a feed-forward filter and a feedback filter, each of which may be an IIR filter).

Figure 9:
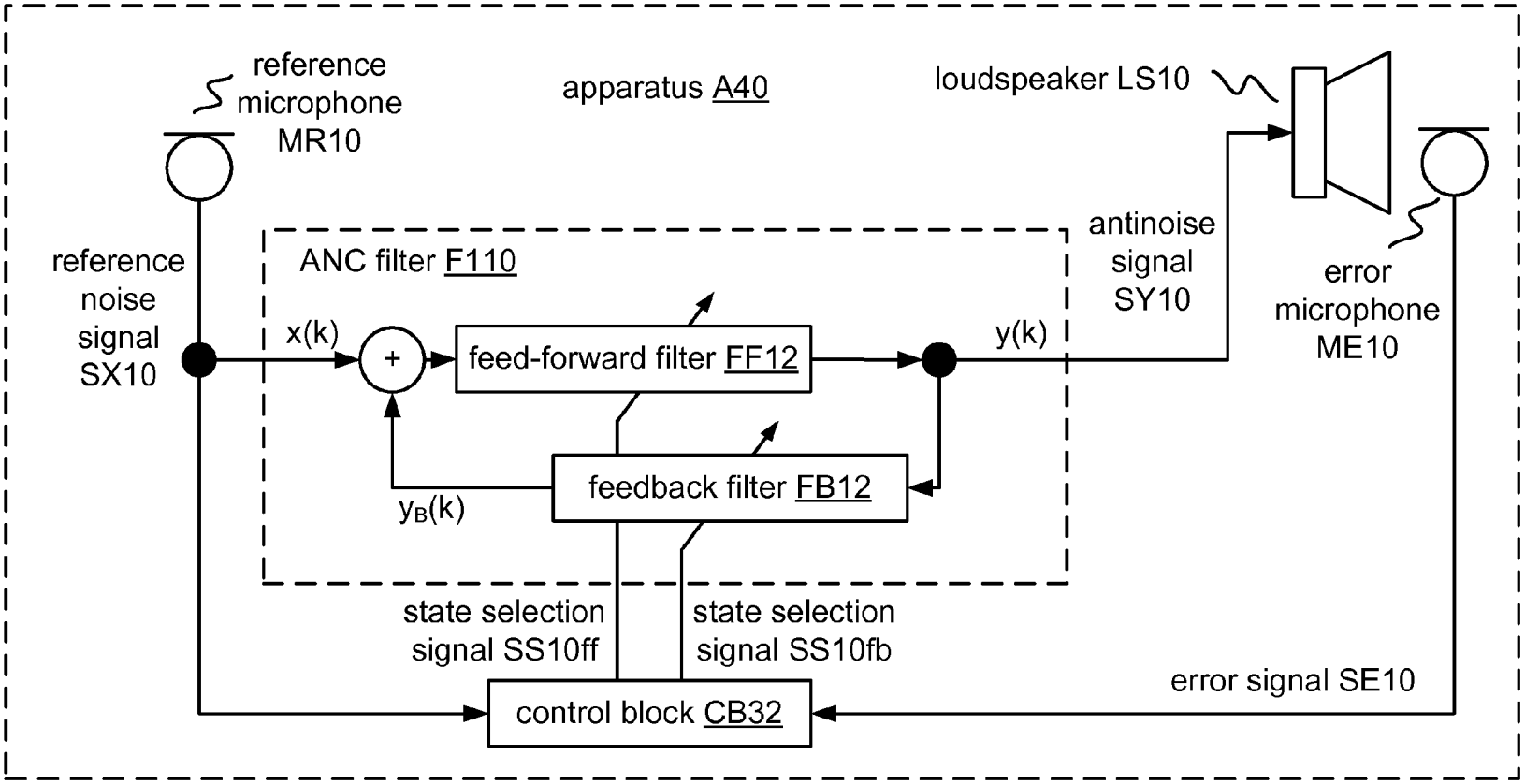
FIG. 9 shows a block diagram of an implementation A40 of apparatus A16.

FIG. 9 shows a block diagram of an implementation A40 of apparatus A16 that includes an adaptable implementation F110 of ANC filter F100 in a feed-forward arrangement (i.e., as an implementation of filter F12). In this example, adaptable filter F110 includes an adaptable implementation FF12 of feedforward filter FF10 and an adaptable implementation FB12 of feedback filter FB10. Each of adaptable filters FF12 and FB12 may be implemented according to any of the principles discussed above with reference to adaptable filters F50, F60, and F70. Apparatus A40 also includes an implementation CB32 of control block CB30 that is configured to provide an instance SS10*ff* of state selection signal SS10 to filter FF12 and an instance SS10*fb* of state selection signal SS10 to filter FB12, where signals SS10*ff* and SS10*fb* are based on information from reference noise signal SX10 and error signal SE10. It may be desirable to implement control block CB32 as a set of instructions to be executed by a processor (e.g., a DSP).

Figure 10:
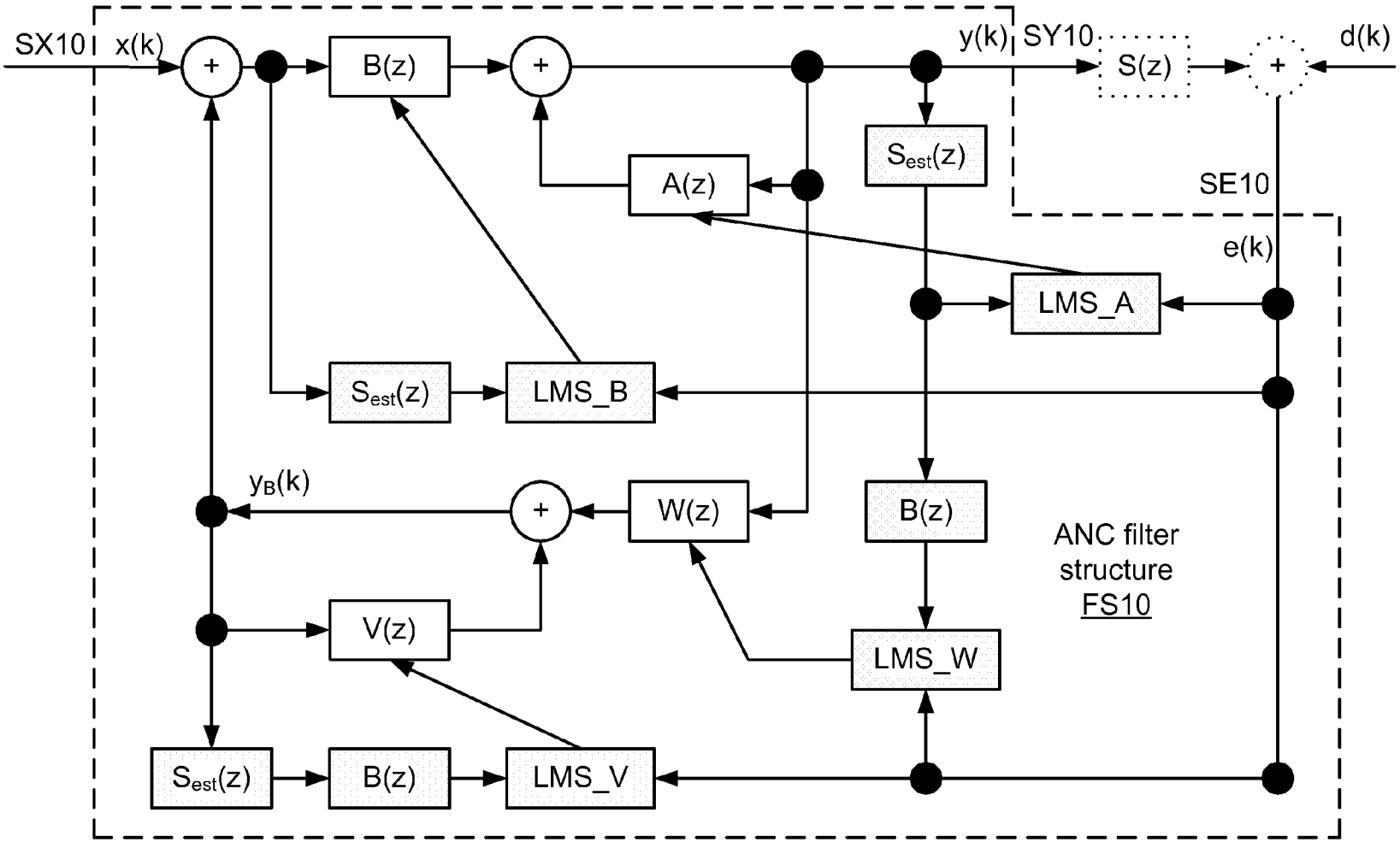
FIG. 10 shows a block diagram of a structure FS10 that includes control block CB32 and an adaptive implementation F110 of ANC filter F100 in a feed-forward arrangement.
Figure 11:
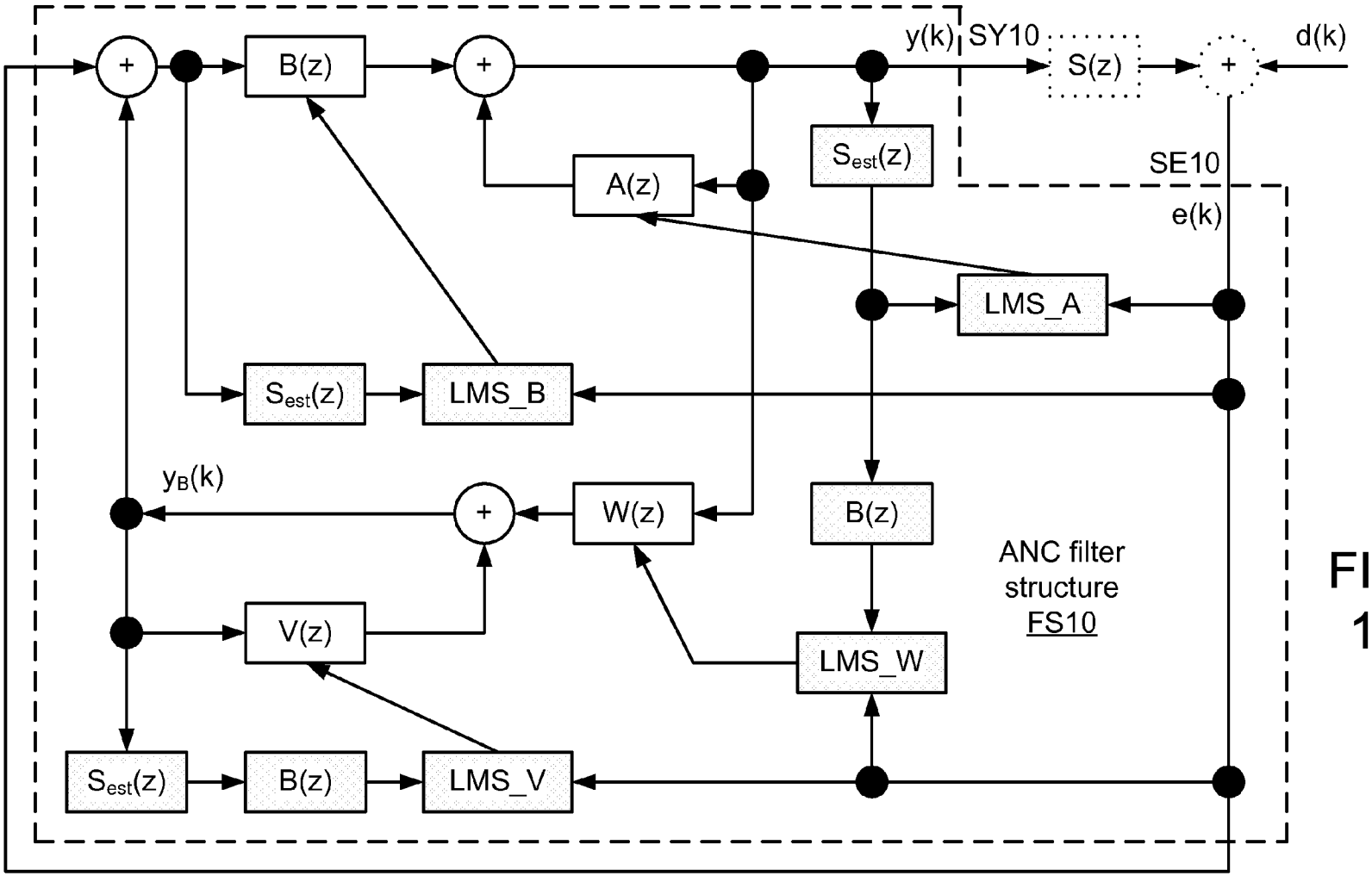
FIG. 11 shows a block diagram of ANC filter structure FS10 in a feedback arrangement.

FIG. 10 shows a block diagram of a structure FS10 that includes implementations of filter F110 and control block CB32 and is arranged in a feedforward arrangement. In structure FS10, the unshaded boxes denote the filtering operations B(z)/(1−A(z)) and W(z)/(1−V(z)) within filter F110, and the shaded boxes denote adaptation operations within control block CB32. The transfer function $S_{est}(z)$, which may be calculated offline, estimates the secondary acoustic path S(z) between loudspeaker LS10 and error microphone ME10, including the responses of the microphone preamplifier and the loudspeaker amplifier. The label d(k) denotes the acoustic noise to be cancelled at the location of error microphone ME10, and the functions B(z) and $S_{est}(z)$ are copied to various locations within control block CB32 to generate intermediate signals. The blocks LMS_B and LMS_A denote operations for calculating updated coefficient values for B(z) and A(z), respectively (i.e., state selection signal SS10*ff*), according to LMS (least-mean-squares) principles. The blocks LMS_W and LMS_V denote operations for calculating updated coefficient values for W(z) and V(z), respectively (i.e., state selection signal SS10*fb*), according to LMS (least-mean-squares) principles. Control block CB32 may be implemented such that the numerator and denominator coefficients of both of feedforward filter FF12 and feedback IIR filter FB12 are updated simultaneously with respect to the signal being filtered. FIG. 11 shows a block diagram of ANC filter structure FS10 in a feedback arrangement.

An algorithm for operating control block CB32 to generate updated values for filter coefficients of filter F110 may be derived by applying principles of the filtered-U LMS methodology to the structure of filter F110. Such an algorithm may be derived in two steps: a first step that derives the coefficient values without considering S(z), and a second step in which the derived coefficient values are convolved by S(z).

In the first step of the derivation, θ=[B, A, W, V] are filter coefficients:

$$\theta(k+1)=\theta(k)+\mu(-\nabla(k))$$

$$\nabla(k)=\frac{\partial e^2}{\partial\theta(k)}=-2e\frac{\partial e}{\partial\theta(k)}=-2e\frac{\partial(d(k)-y(k))}{\partial\theta(k)}=2e\frac{\partial y(k)}{\partial\theta(k)}$$

-continued $$y(k)=\sum_{i1=0}^{Nf} b_{i1}(k)[x(k-i1)+y_B(k-i1)]+\sum_{j1=1}^{Mf} a_{j1}(k)y(k-j1)$$

$$y_B(k-i1)=\sum_{i2=0}^{Nb} w_{i2}(k-i1)[y(k-i1-i2)]+\sum_{j2=1}^{Mb} v_{j2}(k-i1)[y_B(k-i1-j2)]$$

where Nf, Mf are the orders of the feed-forward filter numerator and denominator, respectively, and Nb, Mb are the orders of the feedback filter numerator and denominator, respectively. We assume that the derivatives of past outputs with respect to the current coefficients are zero:

$$\frac{\partial y(k)}{\partial b_{nf}(k)}\simeq x(k-nf)+y_B(k-nf)$$

$$\frac{\partial y(k)}{\partial a_{mf}(k)}\simeq y(k-mf)$$

$$\frac{\partial y(k)}{\partial w_{nb}(k)}\simeq \sum_{i1=0}^{mf-1} b_{i1}(k)y(k-i1-nb)$$

$$\frac{\partial y(k)}{\partial v_{mb}(k)}\simeq \sum_{i1=0}^{nf-1} b_{i1}(k)y_B(k-i1-mb)$$

In the second step of the derivation, the coefficient values derived above are convolved with s(k), the time-domain version of the acoustic path S(z) between loudspeaker LS10 and error microphone ME10:

$$b_n(k+1)=b_n(k)-2\mu_b e(k)\sum_{1=0}^{L} s(l)[x(k-n-l)+y_B(k-n-l)]$$

$$a_m(k+1)=a_m(k)-2\mu_a e(k)\sum_{l=0}^{L} s(l)[y(k-m-l)]$$

$$w_n(k+1)=w_n(k)-2\mu_w e(k)\sum_{l=0}^{L} s(l)\left[\sum_{i1=0}^{mf-1} b_{i1}(k)y(k-i1-n)\right]$$

$$v_m(k+1)=v_m(k)-2\mu_v e(k)\sum_{l=0}^{L} s(l)\left[\sum_{i1=0}^{nf-1} b_{i1}(k)y_B(k-i1-m)\right]$$

where $\mu_b$, $\mu_a$, $\mu_w$, $\mu_v$ are individual step parameters to control the LMS adaptation operations.

It may be desirable to modify the adaptation operations derived above by using one or more methods that may improve the LMS convergence performance. Examples of such algorithms include subband LMS and various step size normalized LMS techniques.

A fully adaptive structure as shown in FIGS. 10 and 11 may be appropriate for an application in which sufficient computational resources are available, such as a handset application. For applications in which a less computationally complex implementation is desired, various forms of simplified adaptive ANC filter structures may be derived based on this fully IIR adaptive ANC algorithm. These simplified adaptive ANC algorithms can be tailored to different applications (e.g., resource-limited applications).

Figure 12:
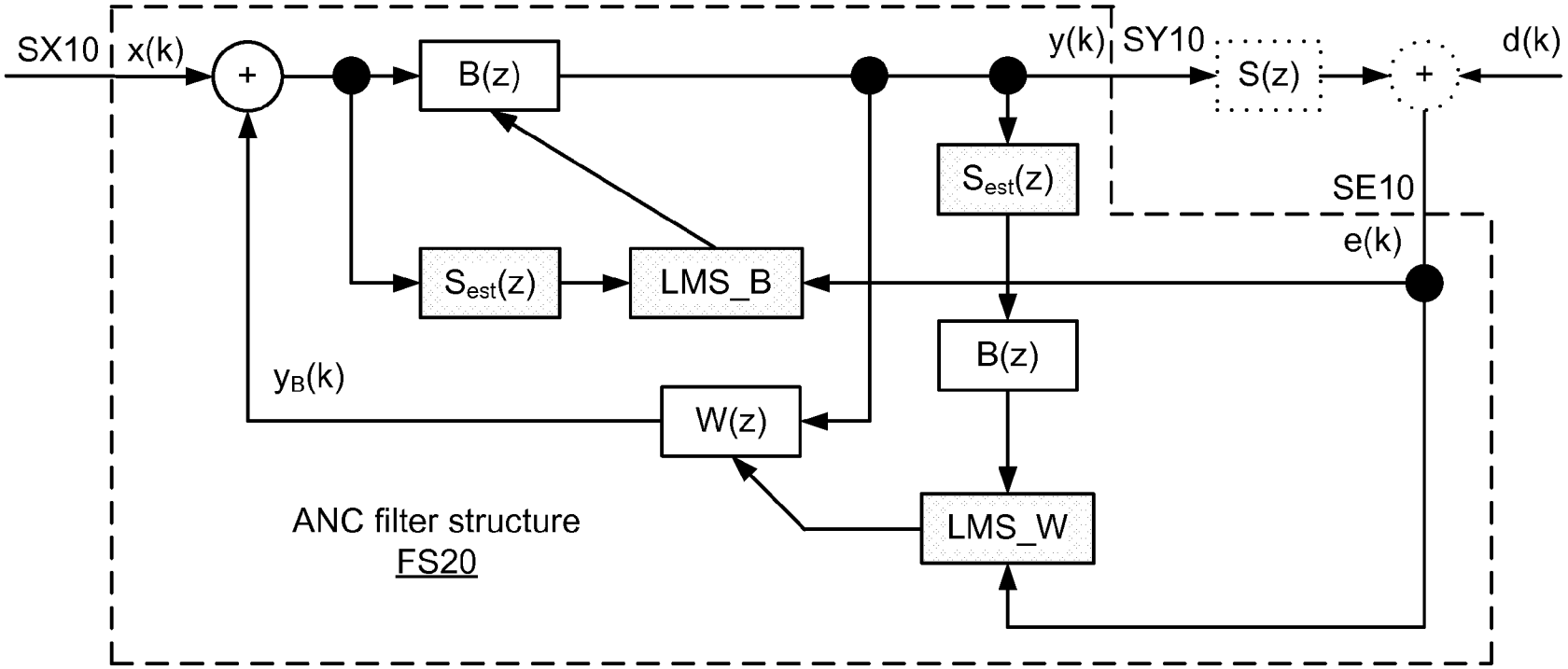
FIG. 12 shows a block diagram of a simplified implementation FS20 of adaptive structure FS10.

One such simplification can be realized by setting the feedback (denominator) coefficients A(z) of feed-forward filter FF10 and the feedback (denominator) coefficients V(z) of feedback IIR filter FB10 to zero, which configures feed-forward filter FF10 and feedback filter FB10 as FIR filters. Such a structure may be more suitable for a feed-forward arrangement. FIG. 12 shows a block diagram of such a simplified implementation FS20 of adaptive structure FS10.

Figure 13:
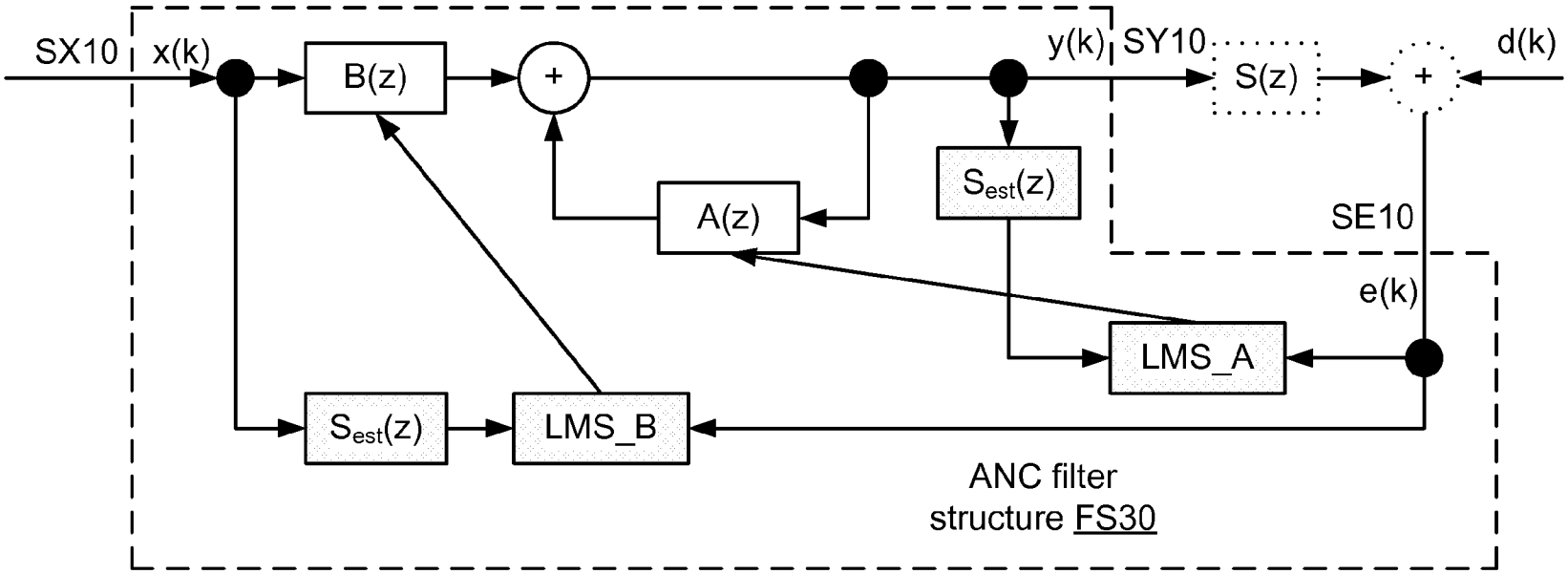
FIG. 13 shows a block diagram of another simplified implementation FS30 of adaptive structure FS10.
Figure 14:
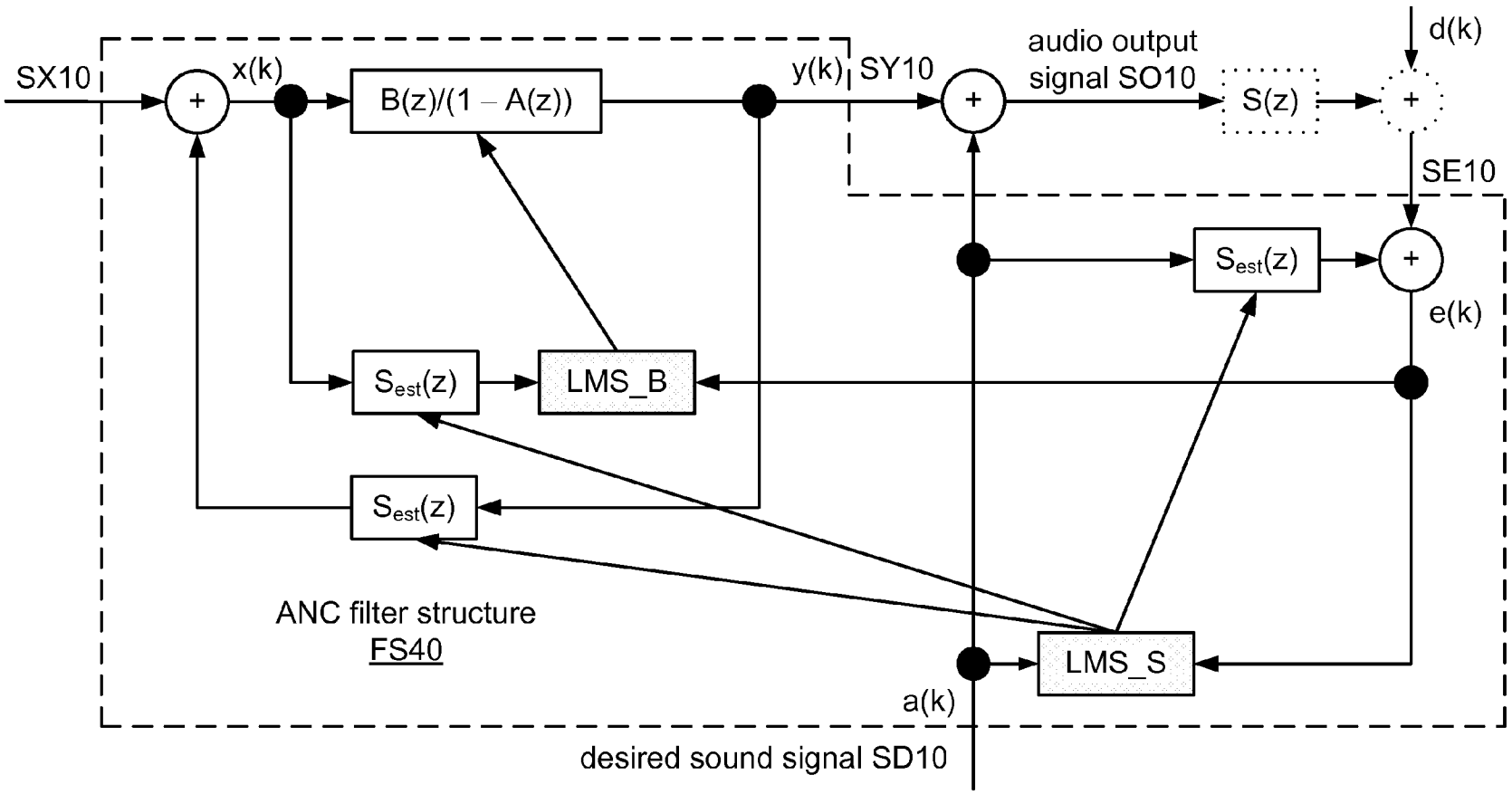
FIGS. 14, 15, 16, and 17 show alternative simplified adaptive ANC structures.

Another simplification may be realized by setting the feed-forward (numerator) coefficients W(z) and the feedback (denominator) coefficients V(z) of feedback filter FB10 to zero. FIG. 13 shows a block diagram of such a simplified implementation FS30 of adaptive structure FS10. In this example, control block CB32 may be configured to perform the adaptation operations LMS_B and LMS_A according to an implementation of the filtered-U LMS algorithm, such as the following:

$$b_i \leftarrow b_i+\mu x'(k)e(k), \text{ for all } b_i \text{ in } B(z)$$

$$a_i \leftarrow a_i+\mu y'(k-1)e(k), \text{ for all } a_i \text{ in } A(z)$$

where x' and y' denote the results of applying the transfer function $S_{est}(z)$ to the signals SX10 and SY10, respectively.

In a feedback arrangement, W(z)/(1−V(z)) may be expected to converge to S(z). However, the adaptation may make these functions diverge. In practice, an estimate $S_{est}(z)$ that is calculated offline may not be accurate. It may be desirable to configure the adaptation to minimize the residual error signal such that a noise reduction goal may still be achieved (e.g., in a minimum mean square error (MMSE) sense).

It may be desirable to configure any of the implementations of ANC apparatus A10 or A20 described herein (e.g., apparatus A40) to mix antinoise signal SY20 with a desired sound signal SD10 to produce an audio output signal S010 for reproduction by loudspeaker LS10. In one such example, desired sound signal SD10 is a reproduced audio signal, such as a far-end voice communications signal (e.g., a telephone call) or a multimedia signal (e.g., a music signal, which may be received via broadcast or decoded from a stored file). In another such example, desired sound signal SD10 is a sidetone signal that carries the user's own voice.

Figure 15:
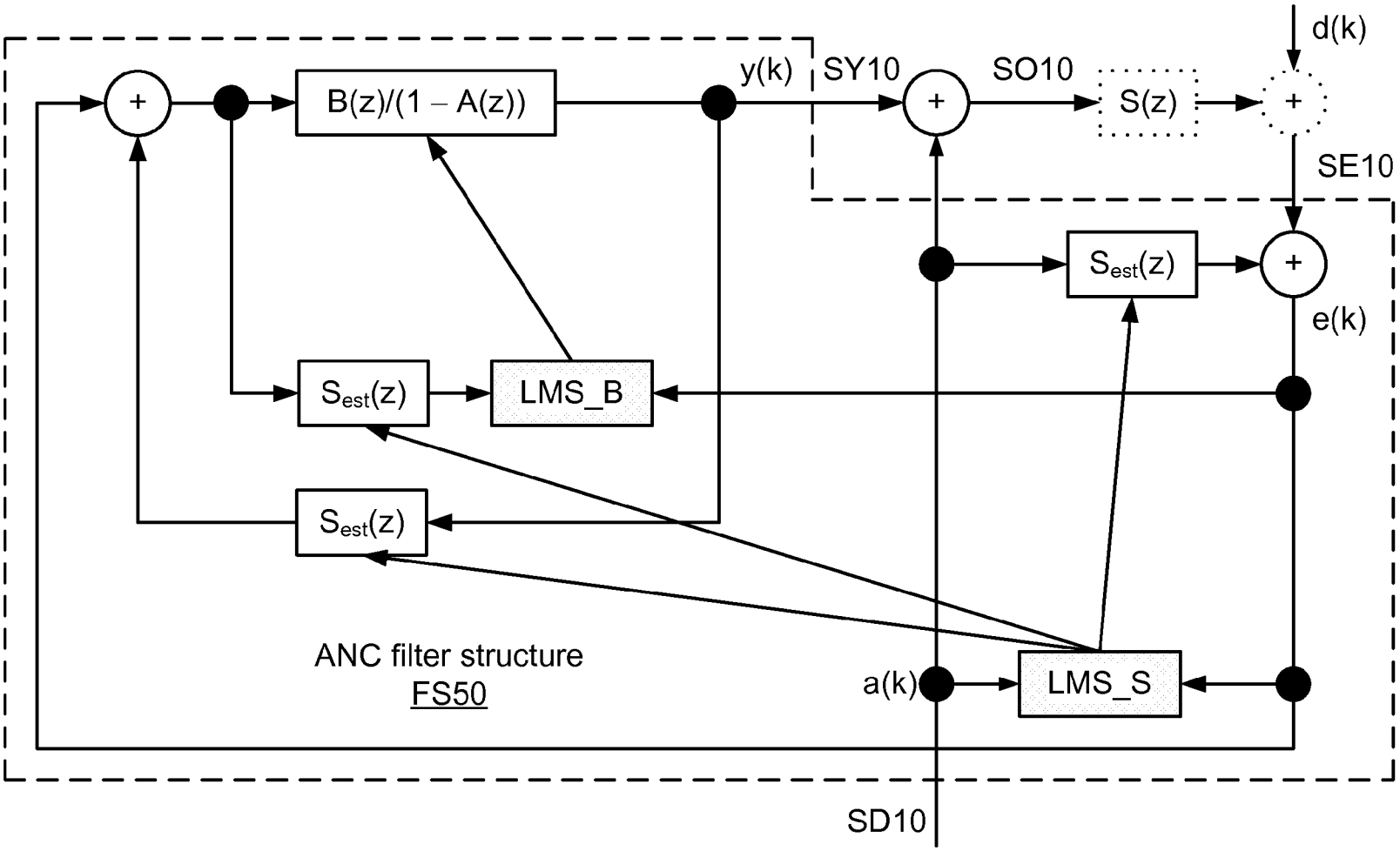

FIGS. 14, 15, 16, and 17 show alternative simplified adaptive ANC structures for such implementations of apparatus A40 in which $S_{est}(z)$ is adapted. The adaptation operation LMS_S supports cancellation of the desired sound signal SD10 (indicated as a(k)) and online estimation of S(z). In the feed-forward arrangement of FIG. 14, an implementation FS40 of adaptive structure FS10 is configured such that the coefficient values W(z)/(1−V(z)) of feedback filter FB10 are equal to the adapted secondary path estimate $S_{est}(z)$. FIG. 15 shows a similar implementation FS50 of adaptive structure FS10 in a feedback arrangement. In these examples, control block CB32 may be configured to perform the adaptation operation LMS_B according to an implementation of the filtered-X LMS algorithm, such as the following:

$$b_i \leftarrow b_i+\mu x'(k)e(k), \text{ for all } b_i \text{ in } B(z)$$

where x' denotes the results of applying the transfer function $S_{est}(z)$ to the signal SX10.

Figure 16:
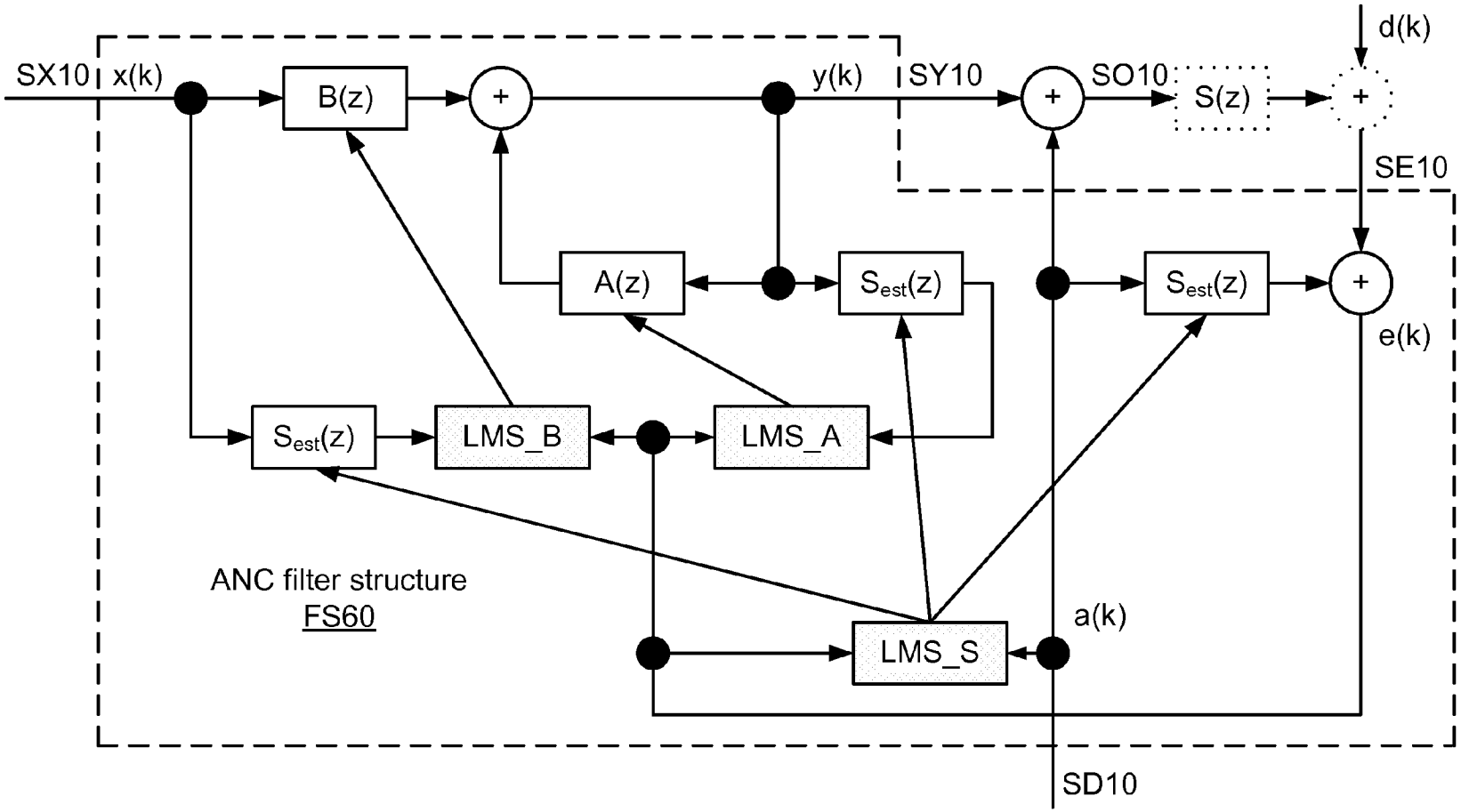
Figure 17:
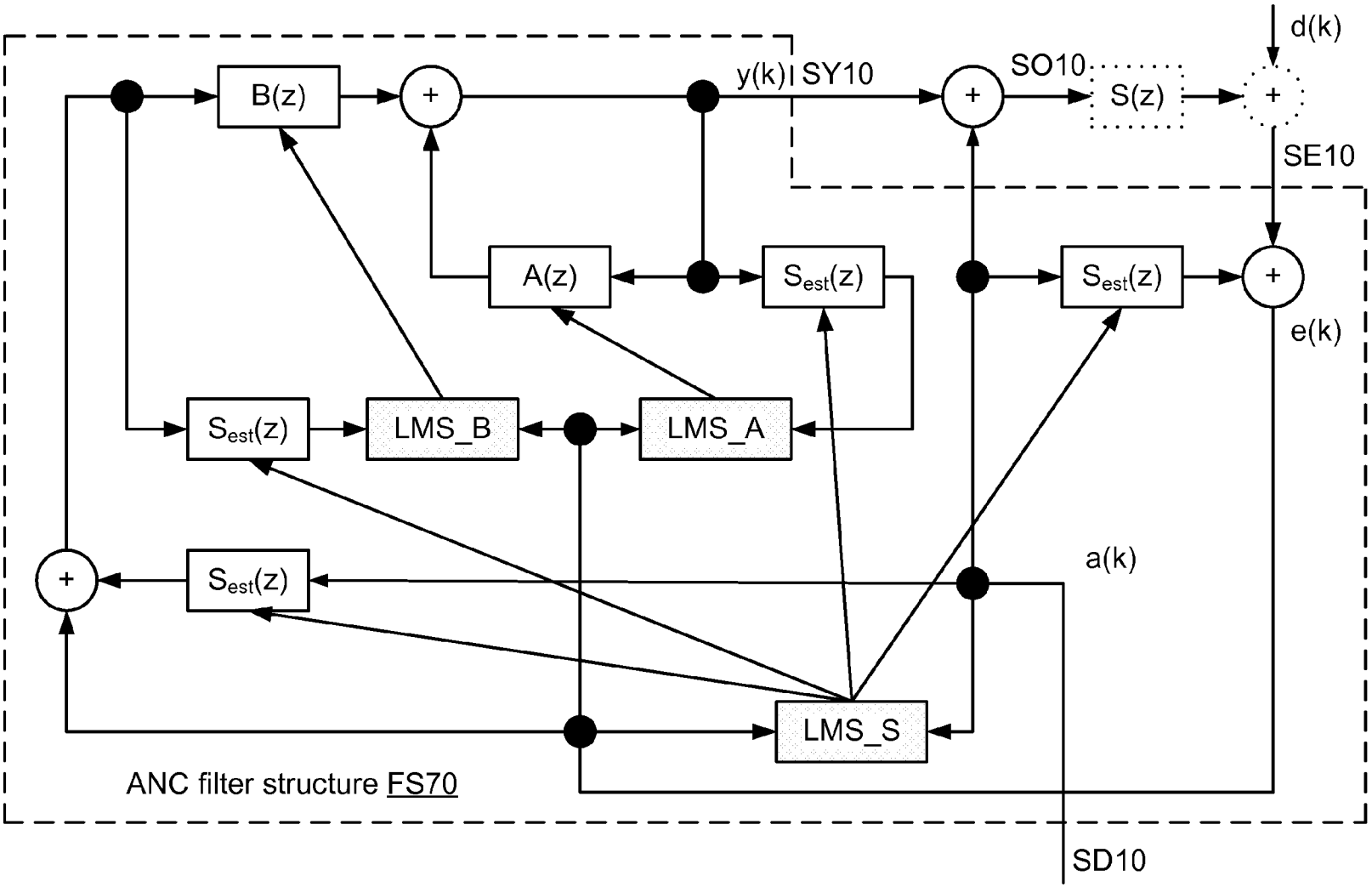

It may be desirable to implement ANC filter structure FS30 as described above to include adaptation of $S_{est}(z)$. FIG. 16 shows such an implementation FS60 of adaptive structure FS10 in a simplified feedforward arrangement, and FIG. 17 shows a similar implementation FS70 of adaptive structure FS10 in a simplified feedback arrangement. In these examples, control block CB32 may be configured to perform the adaptation operations LMS_B and LMS_A according to an implementation of the filtered-U LMS algorithm (e.g., as described above).

It may be difficult to implement a full adaptation of the filter coefficient values of an IIR filter without divergence. Consequently, it may be desirable to perform a more limited adaptation of filter structure FS10. For example, both of filters FF10 and FB10 may be realized as an implementation of component-selectable filter F50, or one may be realized as an implementation of filter F50 and the other may be fixed. Another alternative is to implement filters FF10 and FB10 with fixed coefficient values and update the filter gain only. In such case, it may be desirable to implement a simplified ANC algorithm for gain and phase adaptation.

Figure 18A:
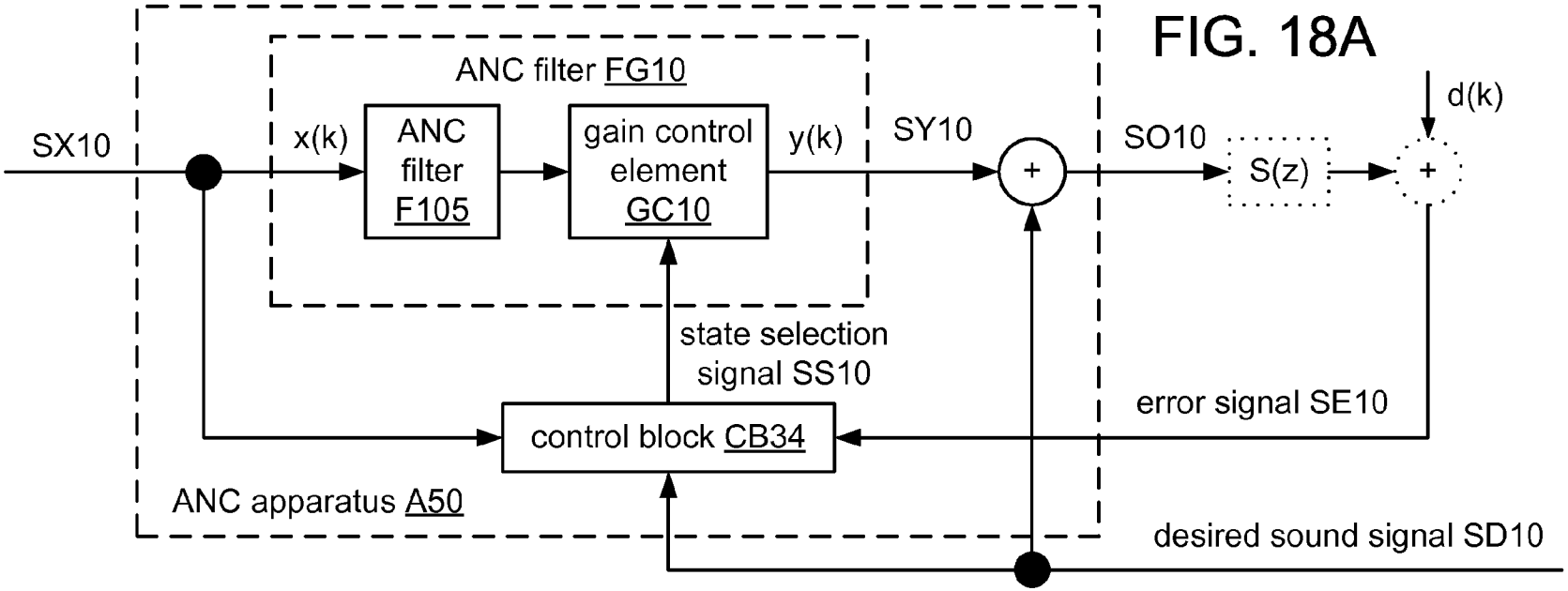
FIG. 18A shows a block diagram of an adaptive implementation A50 of feedforward ANC apparatus A10.
Figure 18B:
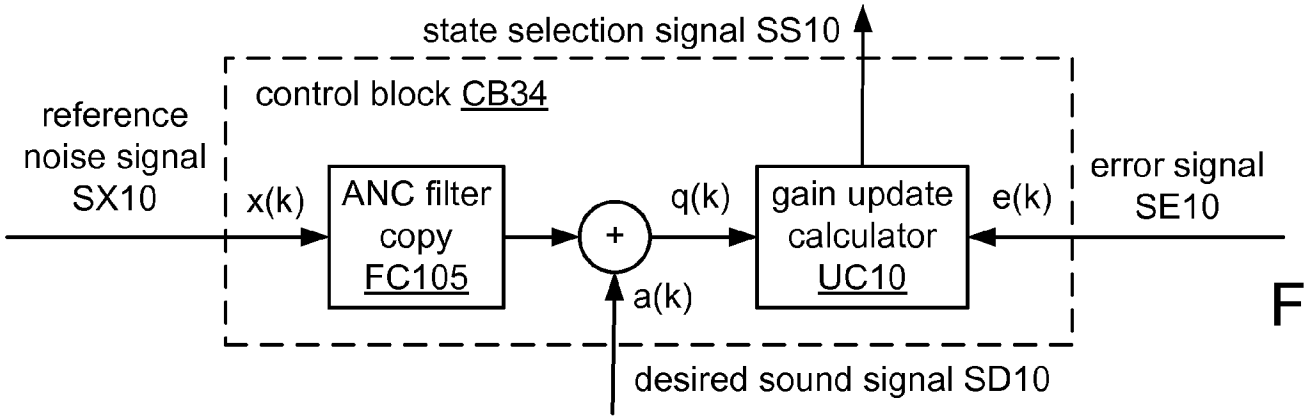
FIG. 18B shows a block diagram of control block CB34.

FIG. 18A shows a block diagram of an adaptive implementation A50 of feedforward ANC apparatus A10 that includes ANC filter FG10 and a control block CB34. Filter FG10 is an implementation of gain-selectable filter F60 that includes a fixed-coefficient implementation F105 of filter F100. FIG. 18B shows a block diagram of control block CB34, which includes a copy FC105 of ANC filter F105 and a gain update calculator UC10. Gain update calculator UC10 is configured to generate state selection signal SS10 to include filter gain update information (e.g., updated gain factor values or changes to existing gain factor values) that is based on information from error signal SE10 and information from a sum q(k) of reference noise signal SX10, as filtered by filter copy FC105, and desired sound signal SD10. It may be desirable to implement apparatus A50 such that ANC filter FG10 is implemented in hardware (e.g., within an application-specific integrated circuit (ASIC) or field-programmable gate array (FPGA)), and control block CB34 is implemented in software (e.g., as instructions for execution by a processor, such as a DSP).

Figure 19A:
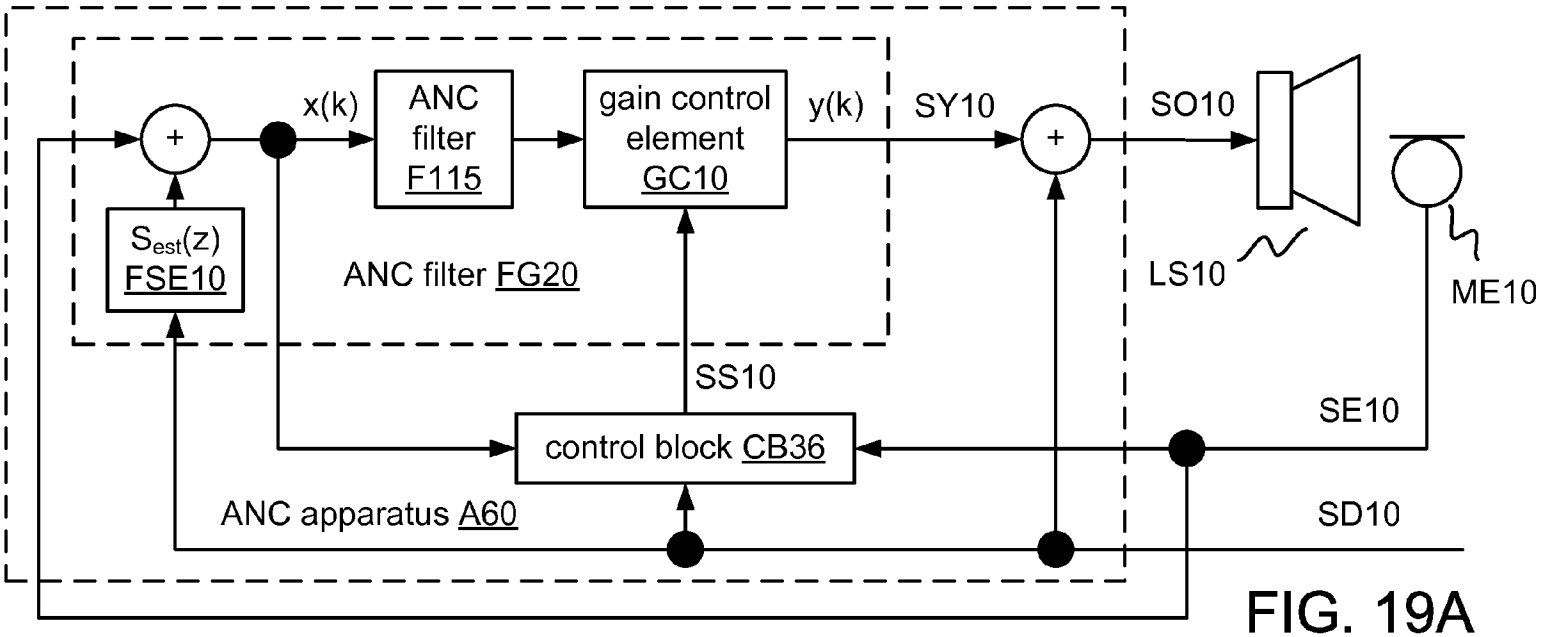
FIG. 19A shows a block diagram of an adaptive implementation A60 of feedback ANC apparatus A20.
Figure 19B:
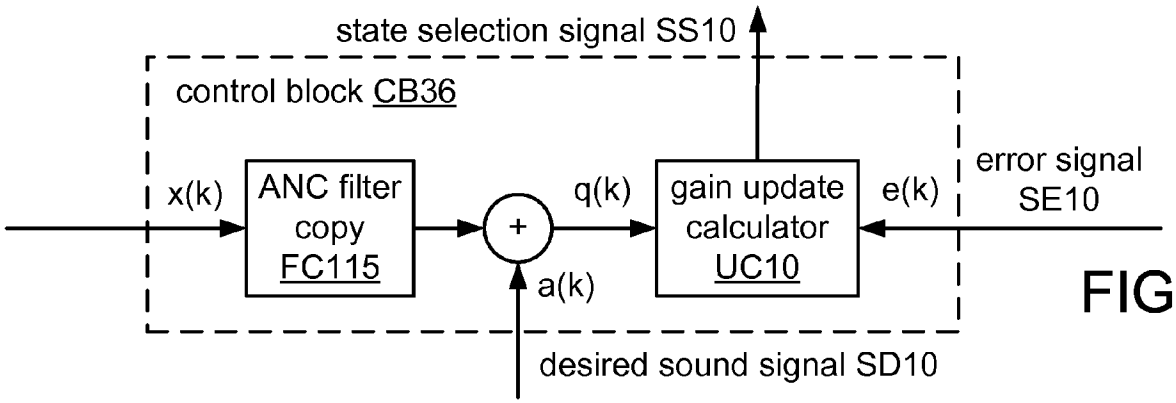
FIG. 19B shows a block diagram of control block CB36.

FIG. 19A shows a block diagram of an adaptive implementation A60 of feedback ANC apparatus A20 that includes ANC filter FG20 and a control block CB36. Filter FG20 is a gain-selectable implementation of filter F20, according to the principles described herein with respect to gain-selectable filter F60, that includes a fixed-coefficient implementation F115 of filter F100. Filter FG20 also includes a filter FSE10, which is an estimate $S_{est}(z)$ of the transfer function of the secondary acoustic path. FIG. 19B shows a block diagram of control block CB36, which includes a copy FC115 of ANC filter F115 and an instance of gain update calculator UC10. In this case, gain update calculator UC10 is arranged to generate state selection signal SS10 to include filter gain update information (e.g., updated gain factor values or changes to existing gain factor values) that is based on information from error signal SE10 and information from a sum q(k) of x(k) (here, a sum of desired sound signal SD10, as filtered by secondary path estimate $S_{est}(z)$, and error signal SE10), as filtered by filter copy FC115, and desired sound signal SD10. It may be desirable to implement apparatus A60 such that ANC filter FG20 is implemented in hardware (e.g., within an ASIC or FPGA), and control block CB36 is implemented in software (e.g., as instructions for execution by a processor, such as a DSP).

Gain update calculator UC10 as shown in FIGS. 18B and 19B may be configured to operate according to an SNR-based gain curve. For example, calculator UC10 may be configured to set the gain value G(k) equal to one if the voice SNR is above (alternatively, not less than) a threshold value (e.g., to reduce ANC artifacts), and otherwise to update G(k) according to a subband LMS scheme as described in the following operation.

In this operation, M denotes the number of subbands, K denotes the number of samples per frame (for a frame length of, e.g., ten or twenty milliseconds), and m denotes a subband index. An estimate of the secondary acoustic path S(z) is not needed for this adaptation. A gain update may be performed at each sample k according to an expression such as $G(k)=G(k-1)+\Sigma_{m=0}^{M-1}\mu_m e_m(k)q_m(k)$.

Energy estimates $P_m$ for each subband may be updated at each sample according to expressions such as the following:

$$P_{m,e}(k)=\alpha P_{m,e}(k-1)+(1-\alpha)e_m^2(k);$$

$$P_{m,q}(k)=\alpha P_{m,q}(k-1)+(1-\alpha)q_m^2(k).$$

Ratios of the energy estimates may be used to determine when to change the sign of the parameter $\mu_m$ in each subband, according to an expression such as the following:

$$\mu_m=-\mu_m, \text{ if } [P_{m,e}(k)/P_{m,q}(k)]>[P_{m,e}(k-K)/P_{m,q}(k-K)].$$

Each of the above gain and energy estimate updates may be repeated at each sample k or at some less frequent time interval (e.g., once per frame). Such an algorithm is based on the assumption that within each subband of the secondary path S(z), changes occur only in gain and phase, such that these changes may be compensated by updating the gain G. It may be desirable to configure the adaptive algorithm to operate only on an ANC-related spectrum region (e.g., about 200-2000 Hz).

Although this gain adaptation algorithm is not filtered-X LMS, the theoretical value of $\mu_m$, may be derived from filtered-X LMS. In practice, both $\mu_m$ (which may differ from one subband to another) and the number of subbands M may be experimentally selected.

Filter stability is not an issue in fixed-coefficient structures (e.g., filter F105 as shown in FIG. 18A, filter F115 as shown in FIG. 19A). For an adaptive structure (e.g., a structure that includes a fully adaptable implementation of filter F110), it may be desirable to initialize the filter coefficients with optimal initial values. Example filter initialization methods include using a system identification tool to calculate an acoustic path estimate $S_{est}(z)$ offline, and obtaining FIR filter coefficient values using an adaptive LMS algorithm. The FIR coefficient values may be converted into an initial set of IIR coefficient values using a balanced model reduction technique.

It may be desirable to configure the adaptation to use a small step size (n) to update the filter coefficient values (e.g., to ensure better error residue value and IIR filter stability). Selecting different μ values for the feedforward (numerator) and feedback (denominator) coefficient values may also help to maintain IIR filter stability. For example, it may be desirable to select a μ value for each filter denominator that is about one-tenth of the μ value for the corresponding filter numerator.

It may be desirable to configure the control block (e.g., control blocks CB10, CB20, CB30, and CB32) to check the filter stability for each adaptation update before the filter coefficient values are sent to the ANC filter via the state selection signal. In the s-domain, based on the Lienard-Chipart criterion, the filter is stable if and only if $$a_n>0, a_{n-2}>0, a_{n-4}>0, \ldots a_1>0$$

$$D_1>0, D_3>0, D_5>\ldots$$

where $D_i$ denote Hurwitz determinants and $a_i$ are the denominator coefficients of the IIR filter. A bilinear transform may be used to translate z-domain coefficients into s-domain coefficients. For a feedback arrangement, it may also be desirable to meet the closed-loop stability criterion.

As noted above, the delay required by an ANC apparatus to process the input noise signal and generate a corresponding antinoise signal should not exceed a very short time. Implementations of ANC apparatus for small mobile devices, such as handsets and headsets, typically require a very short processing delay or latency (e.g., about thirty to sixty microseconds) for the ANC operation to be effective. This delay requirement puts a great constraint on the possible processing and implementation method of the ANC system. While the signal processing operations typically used in an ANC apparatus are straightforward and well defined, it may be difficult to implement these operations while meeting the delay constraint.

Due to the delay constraint, most of the commercial ANC implementations for consumer electronic devices are based on analog signal processing. Because analog circuits may be implemented to have very short processing delays, an ANC operation is typically implemented for a small device (e.g., a headset or handset) using analog signal processing circuits. Many commercial and/or military devices that include short-delay, nonadaptive analog ANC processing are currently in use.

While an analog ANC implementation may exhibit good performance, each application typically requires a custom analog design, resulting in a very poor generalization capability. It may be difficult to implement an analog signal processing circuit to be configurable or adaptable. In contrast, digital signal processing typically has very good generalization capability, and it is typically comparatively easy to implement an adaptive processing operation using digital signal processing.

In comparison to an equivalent analog signal processing circuit, a digital signal processing operation typically has a much larger processing delay, which may reduce the effectiveness of an ANC operation for small dimensions. An adaptive ANC apparatus as described above (e.g., apparatus A12, A14, A16, A22, A30, A40, A50, or A60) may be implemented, for example, such that both of the ANC filtering and the filter adaptation are performed in software (e.g., as respective sets of instructions executing on a processor, such as a DSP). Alternatively, such an adaptive ANC apparatus may be implemented by combining hardware that is configured to filter an input noise signal to generate a corresponding antinoise signal (e.g., a pulse-code modulation (PCM)-domain coder-decoder or "codec") with a DSP that is configured to execute an adaptive algorithm in software. However, the operations of converting an analog signal to a PCM digital signal for processing and converting the processed signal back to analog introduce a delay that is typically too large for optimal ANC operation. Typical bit widths for a PCM digital signal include eight, twelve, and sixteen bits, and typical PCM sampling rates for audio communications applications include eight, eleven, twelve, sixteen, thirty-two, and forty-eight kilohertz. At sampling rates of eight, sixteen, and forty-eight kHz, each sample has a duration of about 125, 62.5, and 21 microseconds, respectively. Application of such an apparatus would be limited, as a substantial processing delay could be expected, and the ANC performance would typically be limited to cancelling repetitive noise.

As noted above, it may be desirable for an ANC application to obtain a filtering latency on the order of ten microseconds. To obtain such a low latency in a digital domain, it may be desirable to avoid conversion to a PCM domain by performing the ANC filtering in a pulse density modulation (PDM) domain. A PDM-domain signal typically has a low resolution (e.g., a bit width of one, two, or four bits) and a very high sampling rate (e.g., on the order of 100 kHz, 1 MHz, or even 10 MHz). For example, it may be desirable for the PDM sampling rate to be eight, sixteen, thirty-two, or sixty-four times the Nyquist rate. For an audio signal whose highest frequency component is 4 kHz (i.e., a Nyquist rate of 8 kHz), an oversampling rate of 64 yields a PDM sampling rate of 512 kHz. For an audio signal whose highest frequency component is 8 kHz (i.e., a Nyquist rate of 16 kHz), an oversampling rate of 64 yields a PDM sampling rate of 1 MHz. For a Nyquist rate of 48 kHz, an oversampling rate of 256 yields a PDM sampling rate of 12.288 MHz.

A PDM-domain digital ANC apparatus may be implemented to introduce a minimal system delay (e.g., about twenty to thirty microseconds). Such a technique may be used to implement a high-performance ANC operation. For example, such an apparatus may be arranged to apply signal processing operations directly to the low-resolution oversampled signals from an analog-to-PDM analog-to-digital converter (ADC) and to send the result directly to a PDM-to-analog digital-to-analog converter (DAC).

Figure 20A:
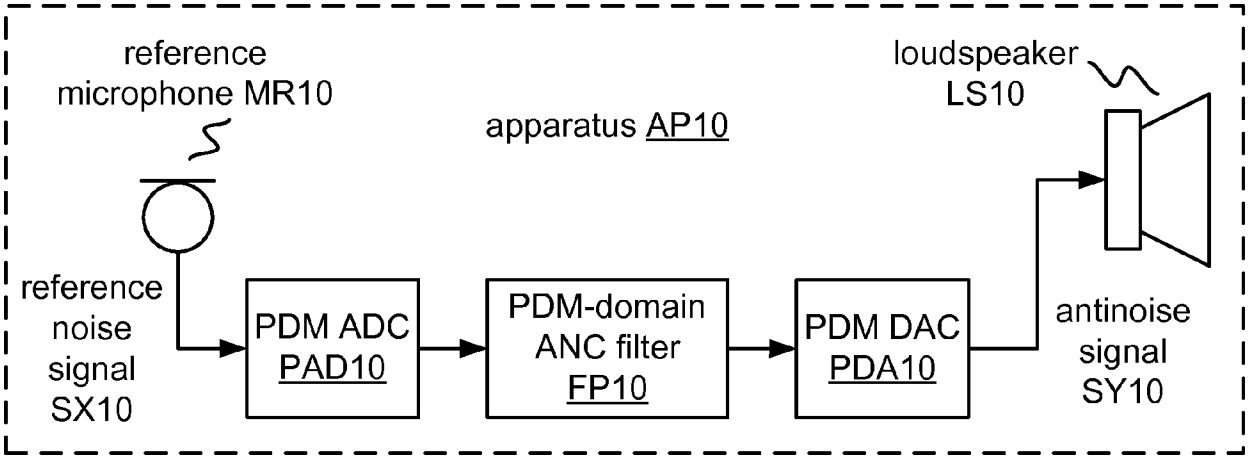
FIG. 20A shows a block diagram of an implementation AP10 of ANC apparatus A10.

FIG. 20A shows a block diagram of an implementation AP10 of ANC apparatus A10. Apparatus AP10 includes a PDM ADC PAD10 that is configured to convert reference noise signal SX10 from the analog domain to a PDM domain. Apparatus AP10 also includes an ANC filter FP10 that is configured to filter the converted signal in the PDM domain. Filter FP10 is an implementation of filter F10 that may be realized as a PDM-domain implementation of any of filters F15, F50, F60, F100, F105, FG10, AF12, AF14, and AF16 as disclosed herein. Filter FP10 may be implemented as an FIR filter, as an IIR filter, or as a series of two or more FIR and/or IIR filters. Apparatus AP10 also includes a PDM DAC PDA10 that is configured to convert antinoise signal SY10 from the PDM domain to the analog domain.

Figure 20B:
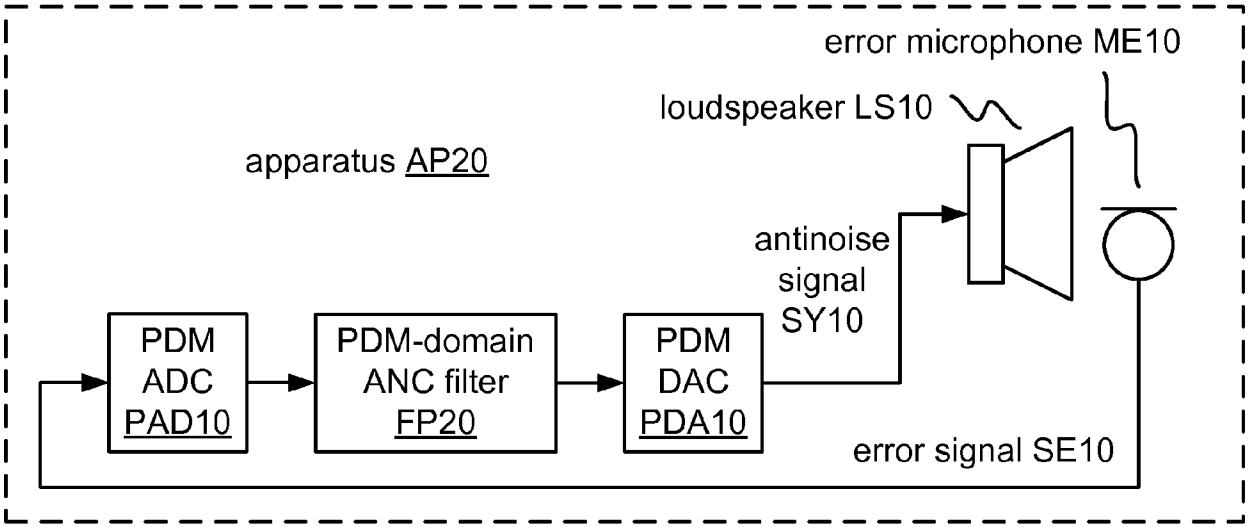
FIG. 20B shows a block diagram of an implementation AP20 of ANC apparatus A20.

FIG. 20B shows a block diagram of an implementation AP20 of ANC apparatus A20. Apparatus AP20 includes an instance of PDM ADC PAD10 that is arranged to convert error signal SE10 from the analog domain to a PDM domain and an ANC filter FP20 that is configured to filter the converted signal in the PDM domain. Filter FP20 is an implementation of filter F20 that may be realized as a PDM-domain implementation of any of filters AF12, AF14, AF16, and FG20 as disclosed herein and/or according to the principles described herein with reference to any of filters F15, F50, F60, F100, and F105. Apparatus AP20 also includes an instance of PDM DAC PDA10 that is arranged to convert antinoise signal SY10 from the PDM domain to the analog domain.

Figure 21A:
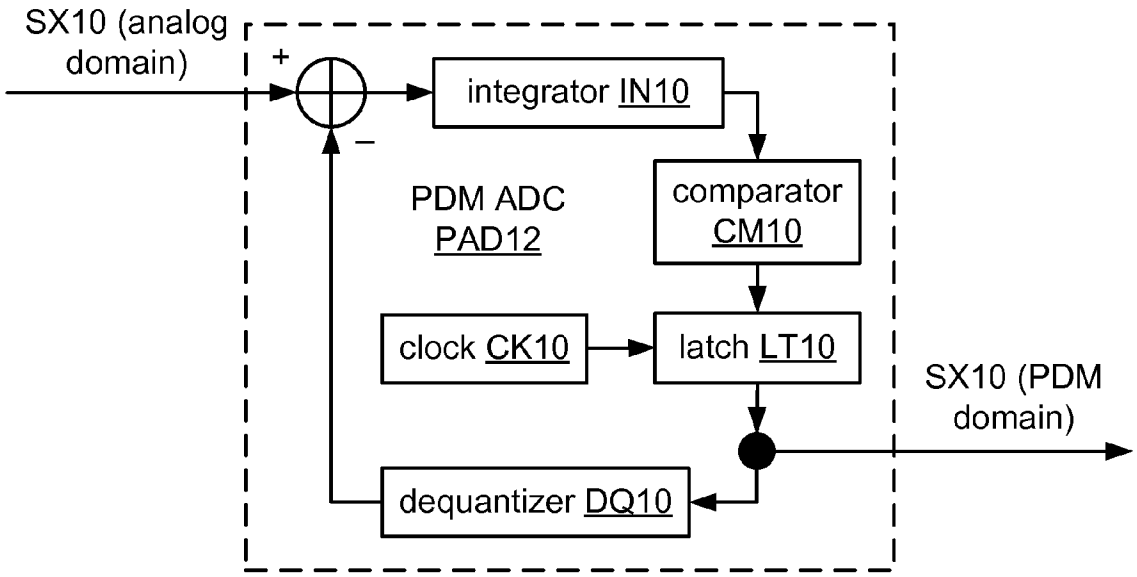
FIG. 21A shows a block diagram of an implementation PAD12 of PDM analog-to-digital converter PAD10.

It may be desirable to implement PDM DAC PDA10 as an analog low-pass filter arranged to convert antinoise signal SY10 from the PDM domain to the analog domain. For a case in which the input to PDM DAC PDA10 is wider than one bit, it may be desirable for PDM DAC PDA10 first to reduce the signal width to one bit (e.g., to include an instance of PDM converter PD30 as described below). It may be desirable to implement PDM ADC PAD10 as a sigma-delta modulator AD10 (also called a "delta-sigma modulator"). Any sigma-delta modulator that is deemed suitable for the particular application may be used. FIG. 21A shows a block diagram of one example PAD12 of an implementation of PDM ADC PAD10 that includes an integrator IN10, a comparator CM10 configured to digitize its input signal by comparing it to a threshold value, a latch LT10 (e.g., a D-type latch) configured to operate at the PDM sampling rate according to a clock CK10, and a dequantizer DQ10 (e.g, a switch) configured to convert the output digital signal to an analog signal for feedback.

Figure 21B:
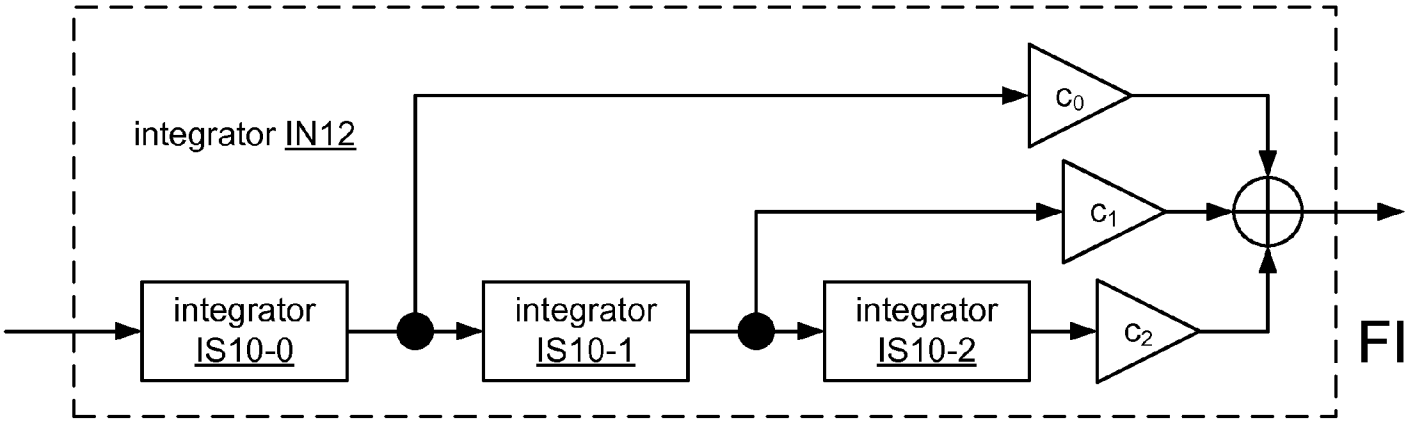
FIG. 21B shows a block diagram of an implementation IN12 of integrator IN10.

For first-order operation, integrator IN10 may be configured to perform one level of integration. Integrator IN10 may also be configured to perform multiple levels of integration for higher-order operation. For example, FIG. 21B shows a block diagram of an implementation IN12 of integrator IN10 that may be used for third-order sigma-delta modulation. Integrator IN12 includes a cascade of single integrators IS10-0, IS10-1, IS10-2 whose outputs are weighted by respective gain factors (filter coefficients) c0, c1, c2 and then summed Gain factors c0-c2 are optional, and their values may be selected to provide a desired noise-shaping profile. For a case in which the input to integrator IN12 is one bit wide, gain factors c0-c2 may be implemented using polarity switches (e.g., XOR gates). Integrator IN10 may be implemented for second-order modulation, or for higher-order modulation, in similar fashion.

Due to the very high sampling frequency, it may be desirable to implement PDM-domain ANC filters FP10 and FP20 in digital hardware (e.g., a fixed configuration of logic gates, such as an FPGA or ASIC) rather than in software (e.g., instructions executed by a processor, such as a DSP). For applications that involve high computational complexity (e.g., as measured in millions of instructions per second or MIPS) and/or high power consumption, implementation of a PDM-domain algorithm in software (e.g., for execution by a processor, such as a DSP) is typically uneconomical, and a custom digital hardware implementation may be preferred.

An ANC filtering technique that adapts the ANC filter dynamically can typically achieve a higher noise reduction effect than a fixed ANC filtering technique. However, one potential disadvantage of implementing an adaptive algorithm in digital hardware is that such an implementation may require a relatively high complexity. An adaptive ANC algorithm, for example, typically requires much more computational complexity than a non-adaptive ANC algorithm. Consequently, PDM-domain ANC implementations are generally limited to fixed filtering (i.e., nonadaptive) approaches. One reason for this practice is the high cost of implementing an adaptive signal processing algorithm in digital hardware.

It may be desirable to implement an ANC operation using a combination of PDM-domain filtering and a PCM-domain adaptive algorithm. As discussed above, ANC filtering in a PDM domain may be implemented using digital hardware, which may provide a minimal delay (latency) and/or optimal ANC operation. Such PDM-domain processing may be combined with an implementation of an adaptive ANC algorithm in a PCM domain using software (e.g., instructions for execution by a processor, such as a DSP), as the adaptive algorithm may be less sensitive to delay or latency incurred by converting a signal to the PCM domain. These hybrid adaptive ANC principles may be used to implement an adaptive ANC apparatus that has one or more of the following features: minimum processing delay (e.g., due to PDM-domain filtering), adaptive operation (e.g., due to adaptive algorithm in a PCM domain), a much lower cost of implementation (e.g., due to much lower cost of implementing an adaptive algorithm in the PCM domain than in hardware, and/or ability to execute the adaptive algorithm on a DSP, which is available in most communications devices).

An adaptive ANC method is disclosed that may be implemented at a low hardware cost. This method includes performing high-speed, low-latency filtering in a high-sampling-rate or "oversampled" domain (e.g., a PDM domain). Such filtering may be most easily implemented in hardware. The method also includes performing low-speed, high-latency adaptation of the filter in a low-sampling-rate domain (e.g., a PCM domain). Such adaptation may be most easily implemented in software (e.g., for execution by a DSP). The method may be implemented such that the filtering hardware and the adaptation routine share the same input source (e.g., reference noise signal SX10 and/or error signal SE10).

Figure 22A:
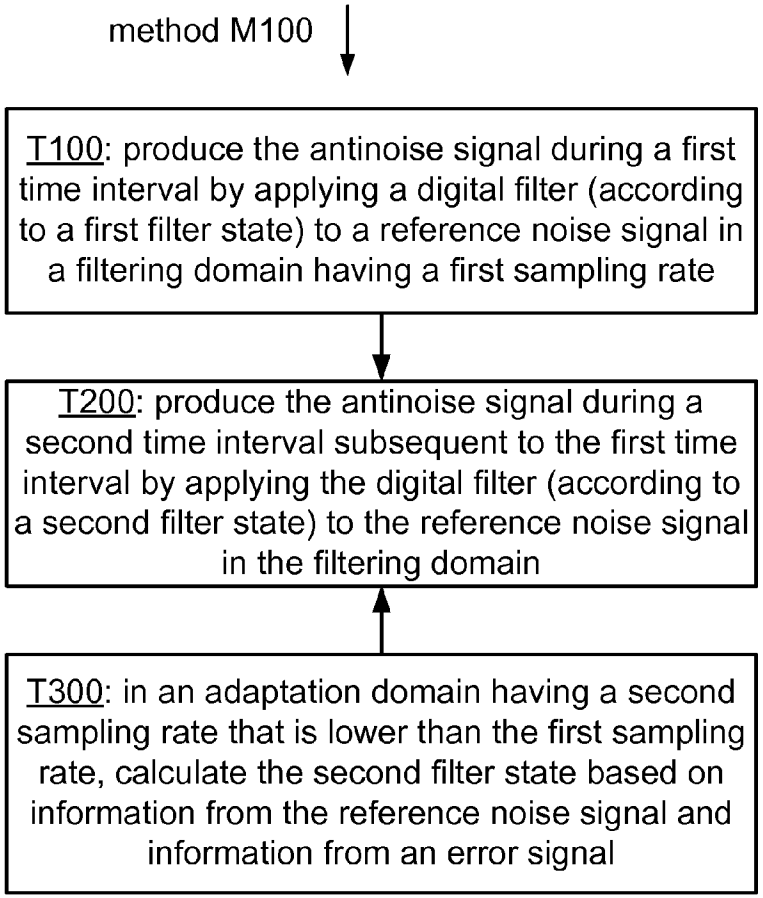
FIG. 22A shows a flowchart of a method M100 according to a general configuration.

FIG. 22A shows a flowchart of a method M100 of producing an antinoise signal according to a general configuration that includes tasks T100, T200, and T300. Task T100 produces the antinoise signal during a first time interval by applying a digital filter to a reference noise signal in a filtering domain having a first sampling rate. During the first time interval, the digital filter has a first filter state. Task T200 produces the antinoise signal during a second time interval subsequent to the first time interval by applying the digital filter to the reference noise signal in the filtering domain. During the second time interval, the digital filter has a second filter state that is different than the first filter state. Task T300 calculates the second filter state, in an adaptation domain having a second sampling rate that is lower than the first sampling rate, based on information from the reference noise signal and information from an error signal.

Figure 22B:
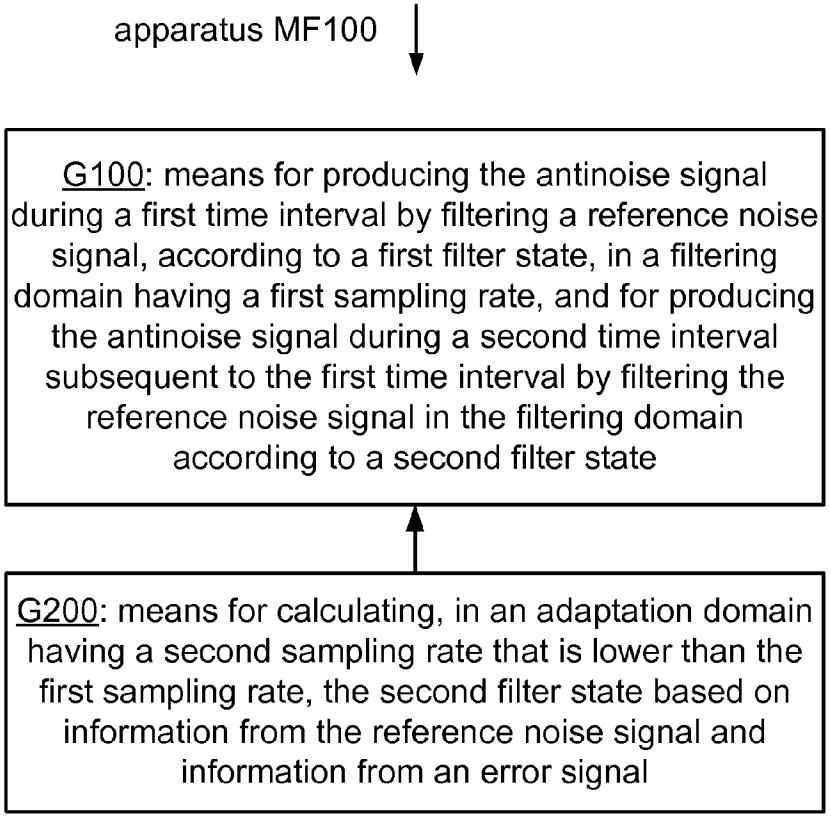
FIG. 22B shows a block diagram of an apparatus MF100 according to a general configuration.

FIG. 22B shows a block diagram of an apparatus MF100 for producing an antinoise signal according to a general configuration. Apparatus MF100 includes means G100 (e.g., a PDM-domain filter) for producing the antinoise signal during a first time interval by filtering a reference noise signal, according to a first filter state, in a filtering domain having a first sampling rate, and for producing the antinoise signal during a second time interval subsequent to the first time interval by filtering the reference noise signal in the filtering domain according to a second filter state that is different from the first filter state. Apparatus MF100 also includes means G200 (e.g., a control block) for calculating, in an adaptation domain having a second sampling rate that is lower than the first sampling rate, the second filter state based on information from the reference noise signal and information from an error signal.

It may be desirable for the sampling rate of the high-sampling-rate domain to be at least twice (e.g., at least four, eight, sixteen, 32, 64, 128, or 256 times) the sampling rate of the low-sampling-rate domain. The ratio of the high sampling rate to the low sampling rate is also called the "oversampling rate" or OSR. Alternatively or additionally, the two digital domains may be configured such that the bit width of a signal in the low-sampling-rate domain is greater than (e.g., at least two, four, eight, or sixteen times) the bit width of a signal in the high-sampling-rate domain.

In the particular examples illustrated herein, the low-sampling-rate domain is implemented as a PCM domain and the high-sampling-rate domain is implemented as a PDM domain. As noted above, typical PCM sampling rates for audio communications applications include eight, eleven, twelve, sixteen, thirty-two, and forty-eight kilohertz, and typical OSRs include 4, 8, 16, 32, 64, 128, and 256, and all forty-two combinations of these parameters are expressly contemplated and hereby disclosed. However, it is also expressly contemplated and hereby disclosed that these examples are merely illustrative and not limiting. For example, the method may be implemented such that both of the low-sampling-rate domain (e.g., in which adaptation is performed in software) and the high-sampling-rate domain (e.g., in which filtering is performed in hardware) are PCM domains.

It may be desirable to design the filter coefficient values in a low-sampling-rate domain and to upsample them at the OSR to obtain filter coefficient values for the oversampled clock domain. In such case, a separate copy of the filter may be running in each clock domain.

While high-speed filtering is important for ANC performance, adaptation of the ANC filter may typically be performed at a much lower rate (e.g., without high-frequency updates or a very short latency). For example, the latency for ANC adaptation (i.e., the interval between filter state updates) may be on the order of ten milliseconds (e.g., 10, 20, or 50 milliseconds). Such adaptation may be implemented in a PCM domain to be performed in software (e.g., for execution by a DSP). It may be more cost-effective to implement an adaptive algorithm in software (e.g., for execution by a generic DSP) than to implement a complex hardware solution for such slow processing. Additionally, a software implementation of an adaptive algorithm is typically much more flexible than a hardware implementation.

Figure 22C:
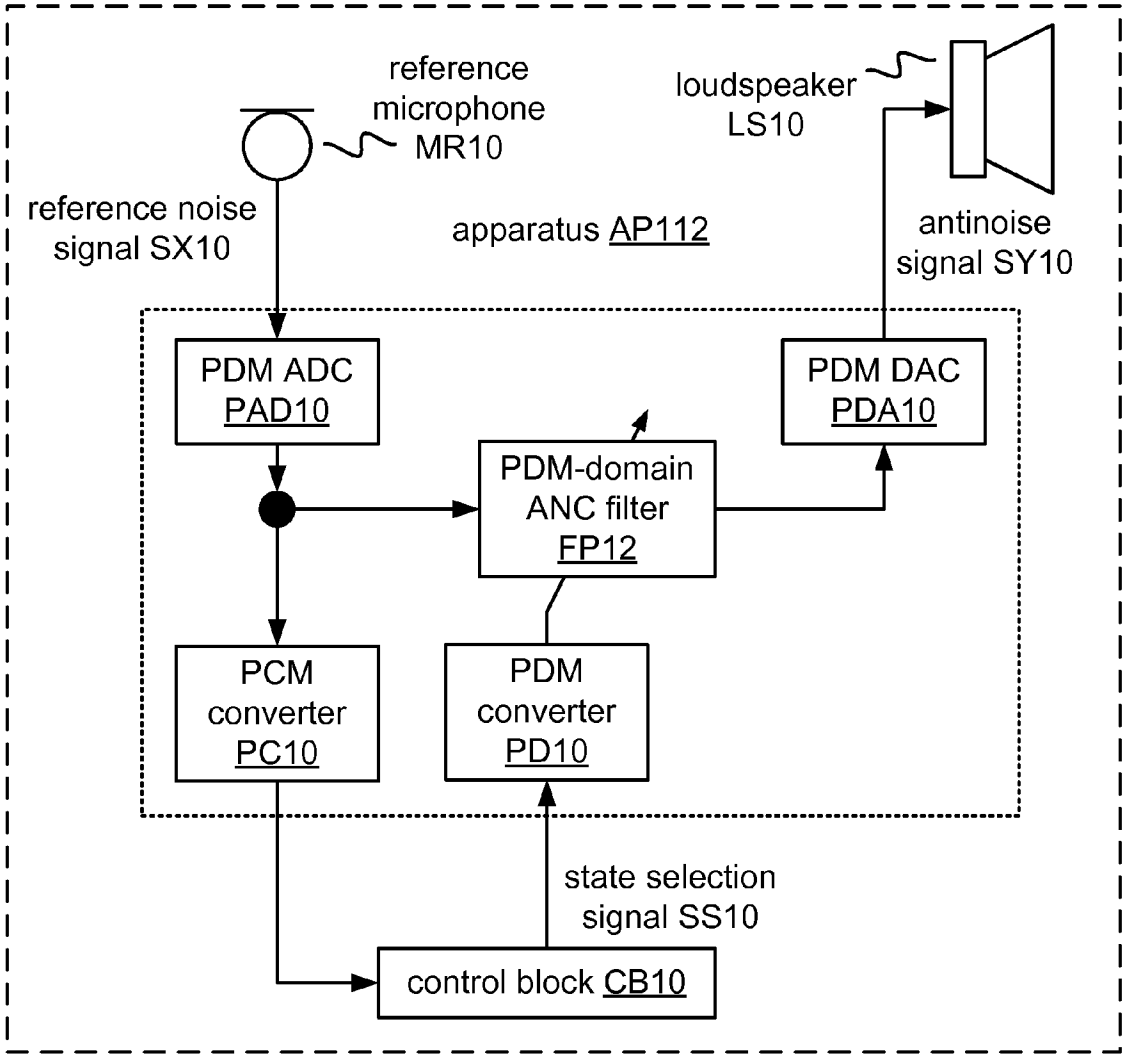
FIG. 22C shows a block diagram of an implementation AP112 of adaptive ANC apparatus A12.

FIG. 22C shows a block diagram of an implementation AP112 of adaptive ANC apparatus A12. Apparatus AP112 includes an instance of PDM ADC PAD10 that is arranged to convert reference noise signal SX10 from the analog domain to a PDM domain. Apparatus AP112 also includes an adaptable ANC filter FP12 that is configured to filter the converted signal in the PDM domain. Filter FP12 is an implementation of filter F12 that may be realized as a PDM-domain implementation of any of filters F50, F60, F70, F100, FG10, AF12, AF14, and AF16 as disclosed herein. Filter FP12 may be implemented as an FIR filter, as an IIR filter, or as a series of two or more FIR and/or IIR filters. Apparatus AP112 also includes an instance of PDM DAC PDA10 that is arranged to convert antinoise signal SY10 from the PDM domain to the analog domain, and an instance of control block CB10 that is arranged to generate state selection signal SS10, based on information from reference noise signal SX10 in the PCM domain.

Apparatus AP112 also includes a PCM converter PC10 that is configured to convert reference noise signal SX10 from the PDM domain to a PCM domain, and a PDM converter PD10 that is configured to convert state selection signal SS10 from the PCM domain to the PDM domain. For example, PCM converter PC10 may be implemented to include a decimator, and PDM converter PD10 may be implemented to include an upsampler (e.g., an interpolator). Conversion between the PCM and PDM domains typically incurs a substantial delay or latency. Such conversion processes may include operations, such as lowpass filtering, downsampling, and/or signal conditioning filtering, that may generate a large delay or latency. For a case in which state selection signal SS10 indicates only a selection among component filters (e.g., of an implementation of component-selectable filter F50) or a gain update (e.g., for an implementation of gain-selectable filter F60), it is possible that upsampling of state selection signal SS10 to the PDM domain (i.e., PDM converter PD10) may be omitted.

Figure 23A:
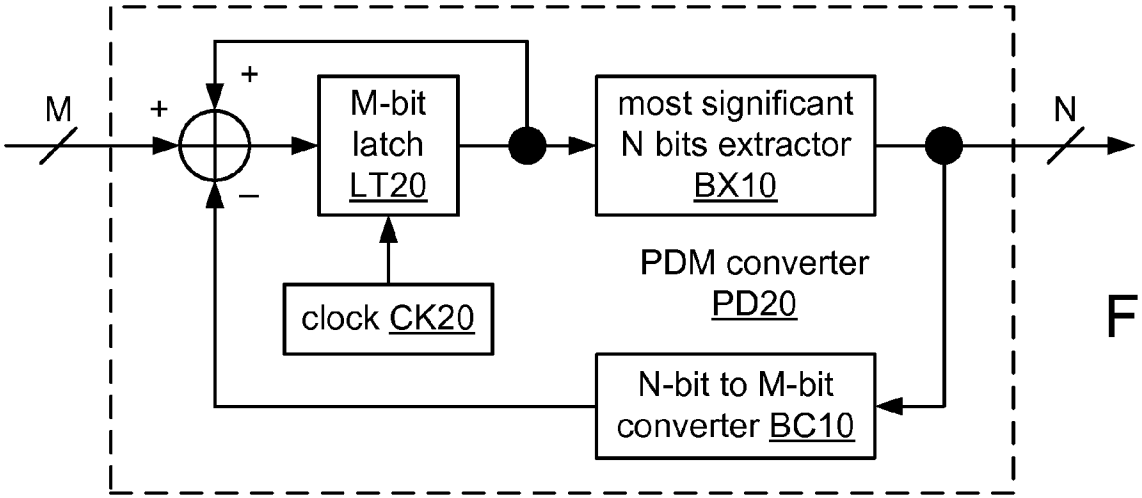
FIG. 23A shows a block diagram of an implementation PD20 of PDM converter PD10.

FIG. 23A shows a block diagram of an implementation PD20 of PDM converter PD10 (also called a sigma-delta modulator) that may be used to convert an M-bit-wide PCM signal to an N-bit-wide PDM signal. Converter PD20 includes an M-bit latch LT20 (e.g., a D-type latch) configured to operate at the PCM sampling rate according to a clock CK20, and a most-significant-N-bits extractor BX10 that outputs the most significant N bits of its digital input as an N-bit-wide signal. Converter C010 also includes an N-bit-to-M-bit converter BC10 (also called an N-bit digital-to-digital converter).

Figure 23B:
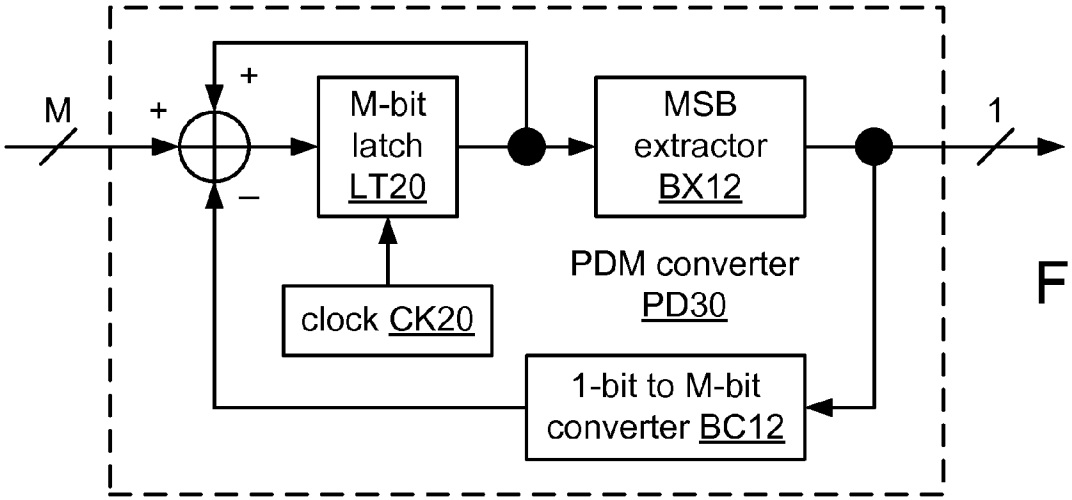
FIG. 23B shows a block diagram of an implementation PD30 of converter PD20.

FIG. 23B shows a block diagram of an M-bits-to-1-bit implementation PD30 of converter PD20. Converter PD30 includes an implementation BX12 of extractor BX10 that outputs the MSB of its digital input as a one-bit-wide signal. Converter PD30 also includes a 1-bit-to-M-bit implementation BC12 (also called a 1-bit digital-to-digital converter) of converter BC10 that outputs the minimum or maximum M-bit digital value, according to the current state of the output of MSB extractor BX12.

Figure 24:
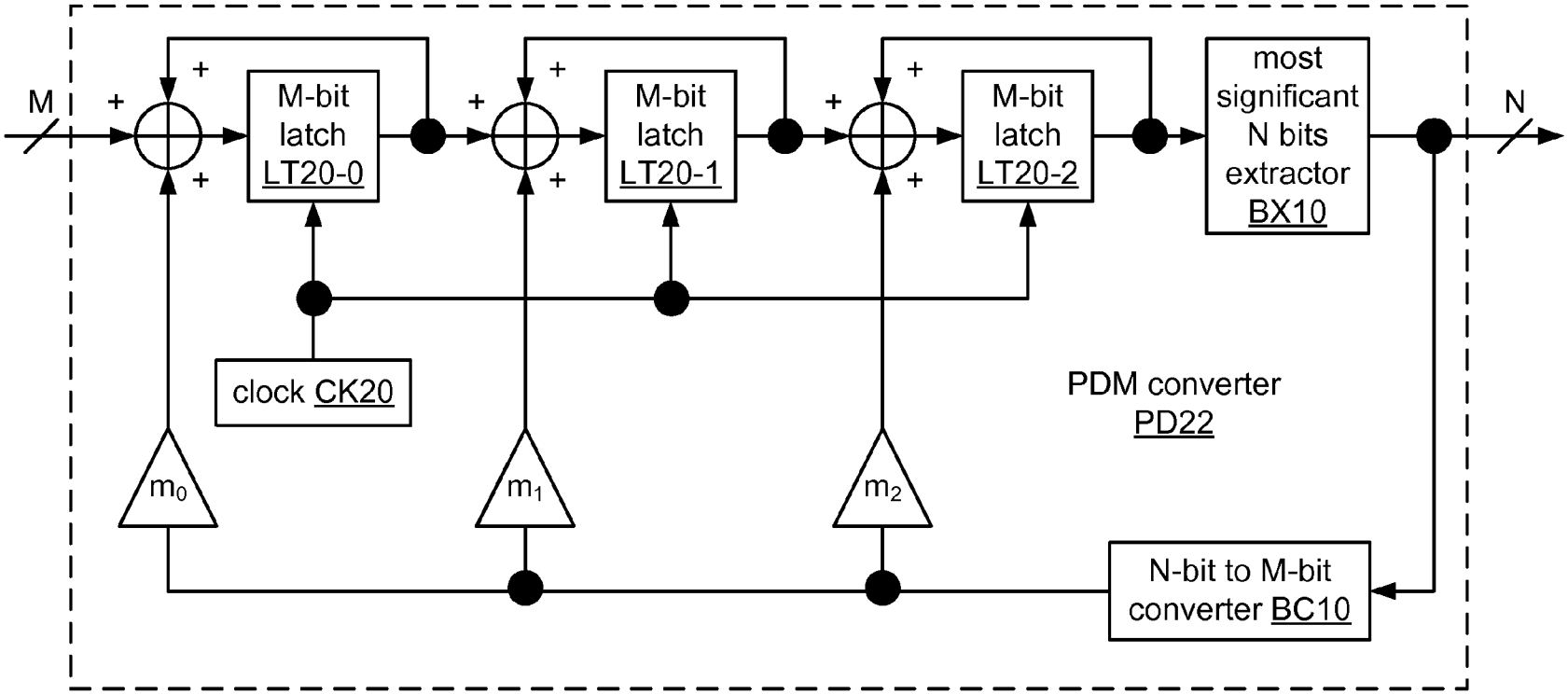
FIG. 24 shows a third-order implementation PD22 of converter PD20.
Figure 25:
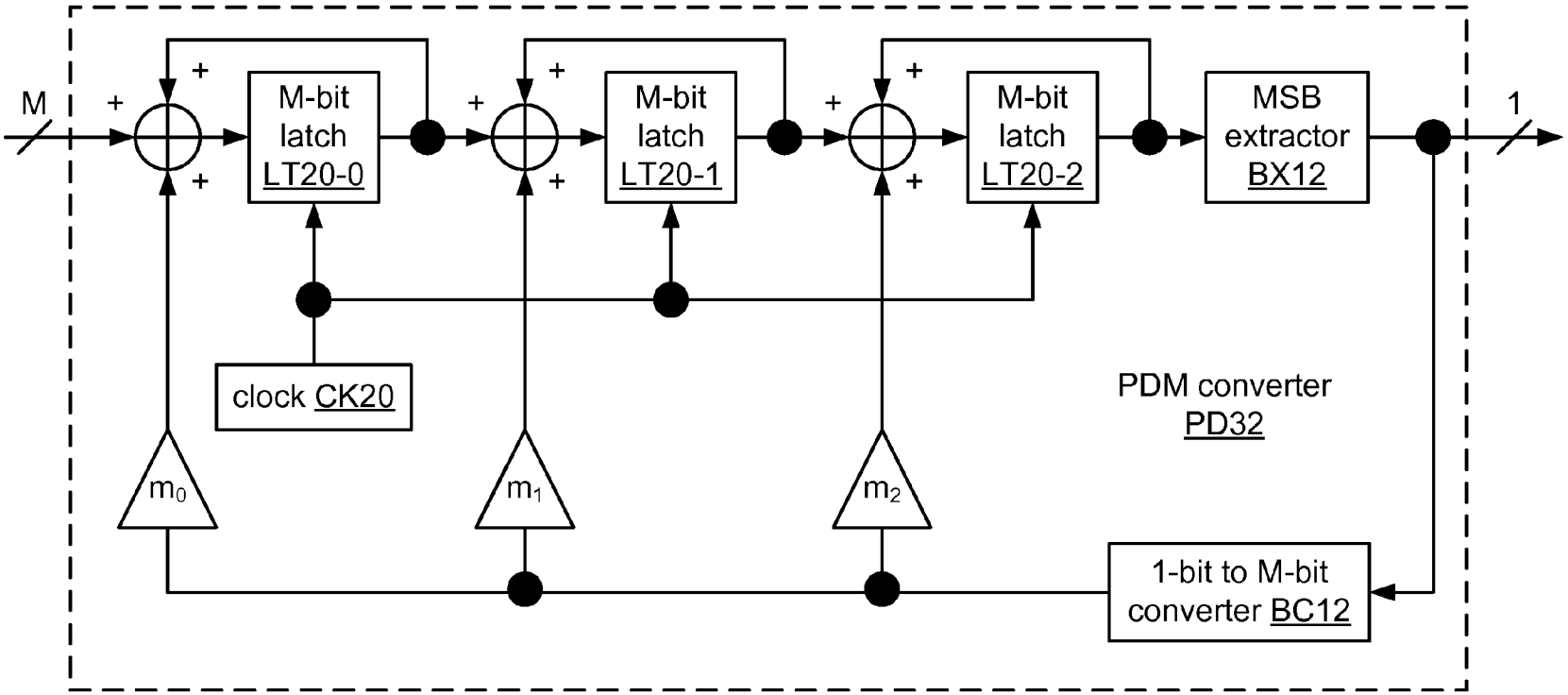
FIG. 25 shows a third-order implementation PD32 of converter PD30.

FIG. 24 shows an example PD22 of a third-order implementation of converter PD20. Values for the optional coefficients m0-m2 may be selected to provide, for example, a desired noise-shaping performance Converter PD20 may be implemented for second-order modulation, or for higher-order modulation, in similar fashion. FIG. 25 shows an example PD32 of a third-order implementation of converter PD30.

Figure 26:
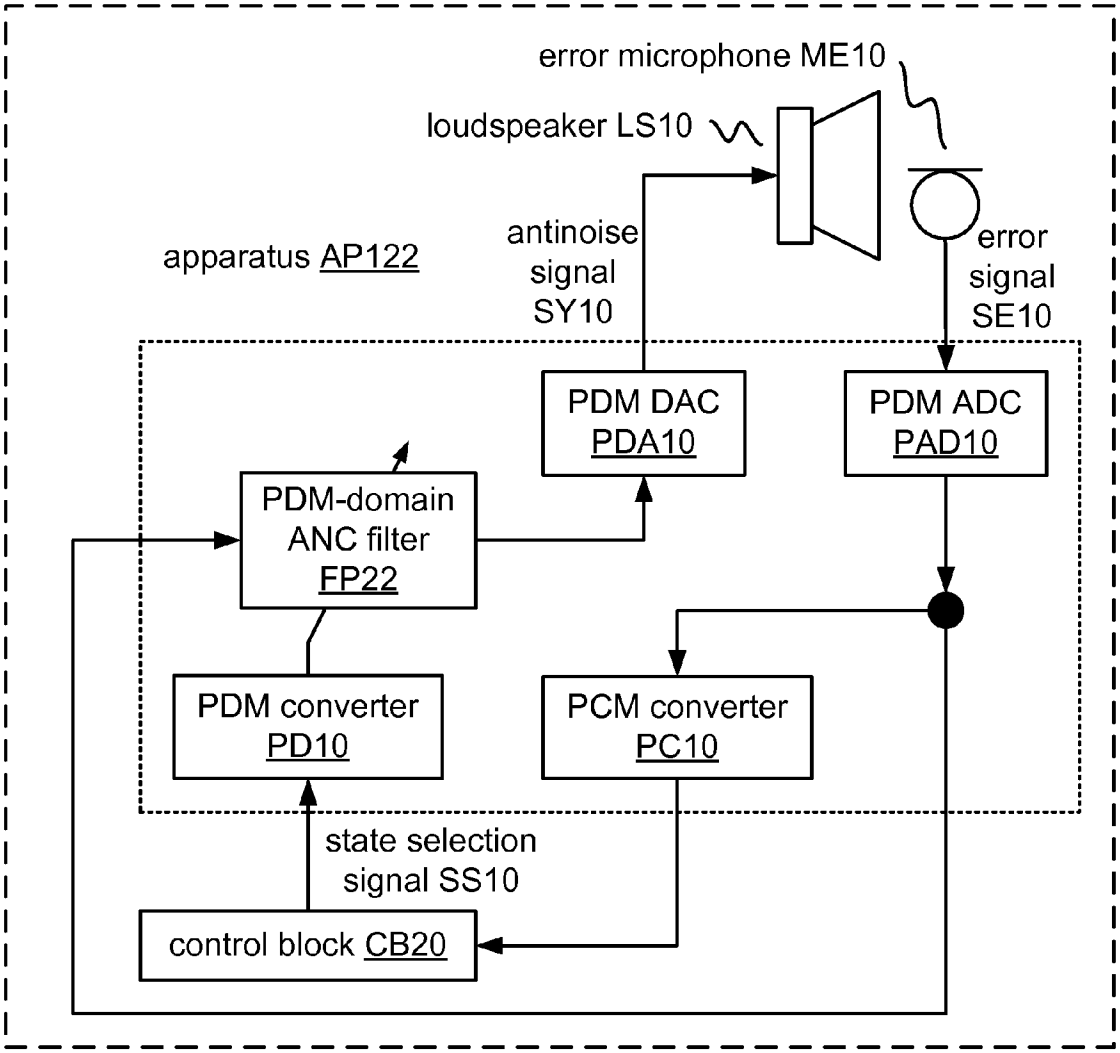
FIG. 26 shows a block diagram of an implementation AP122 of adaptive ANC apparatus A22.

FIG. 26 shows a block diagram of an implementation AP122 of adaptive ANC apparatus A22. Apparatus AP122 includes an instance of PDM ADC PAD10 that is arranged to convert error signal SE10 from the analog domain to a PDM domain. Apparatus AP122 also includes an adaptable ANC filter FP22 that is configured to filter the converted signal in the PDM domain. Filter FP22 is an implementation of filter F22 that may be realized as a PDM-domain implementation of any of filters AF12, AF14, AF16, and FG20 as disclosed herein and/or according to the principles described herein with reference to any of filters F50, F60, F70, and F100. Filter FP22 may be implemented as an FIR filter, as an IIR filter, or as a series of two or more FIR and/or IIR filters. Apparatus AP122 also includes an instance of PDM DAC PDA10 that is arranged to convert antinoise signal SY10 from the PDM domain to the analog domain, an instance of PCM converter PC10 that is arranged to convert error signal SE10 from the PDM domain to the PCM domain, an instance of control block CB20 that is arranged to generate state selection signal SS10 based on information from error signal SE10 in the PCM domain, and an instance of PDM converter PD10 that is arranged to convert state selection signal SS10 from the PCM domain to the PDM domain.

Figure 27:
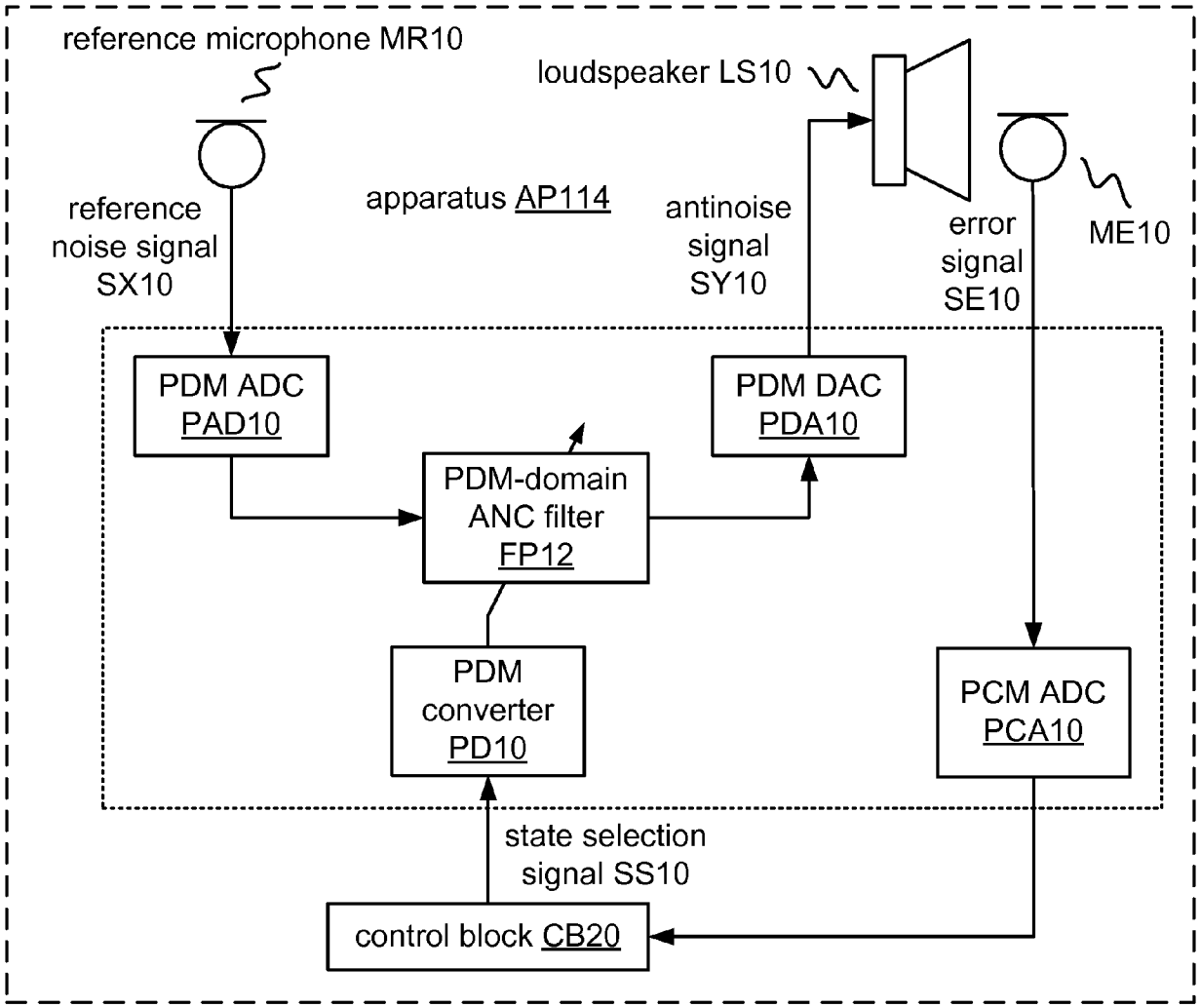
FIG. 27 shows a block diagram of an implementation AP114 of adaptive ANC apparatus A14.

FIG. 27 shows a block diagram of an implementation AP114 of adaptive ANC apparatus A14. Apparatus AP114 includes an instance of PDM ADC PAD10 that is arranged to convert reference noise signal SX10 from the analog domain to a PDM domain, and an instance of adaptable ANC filter FP12 that is configured to filter the converted signal in the PDM domain. Apparatus AP114 also includes an instance of PDM DAC PDA10 that is arranged to convert antinoise signal SY10 from the PDM domain to the analog domain, a PCM ADC PCA10 that is arranged to convert error signal SE10 from the analog domain to the PCM domain, an instance of control block CB20 that is arranged to generate state selection signal SS10 based on information from error signal SE10 in the PCM domain, and an instance of PDM converter PD10 that is arranged to convert state selection signal SS10 from the PCM domain to the PDM domain.

Figure 28:
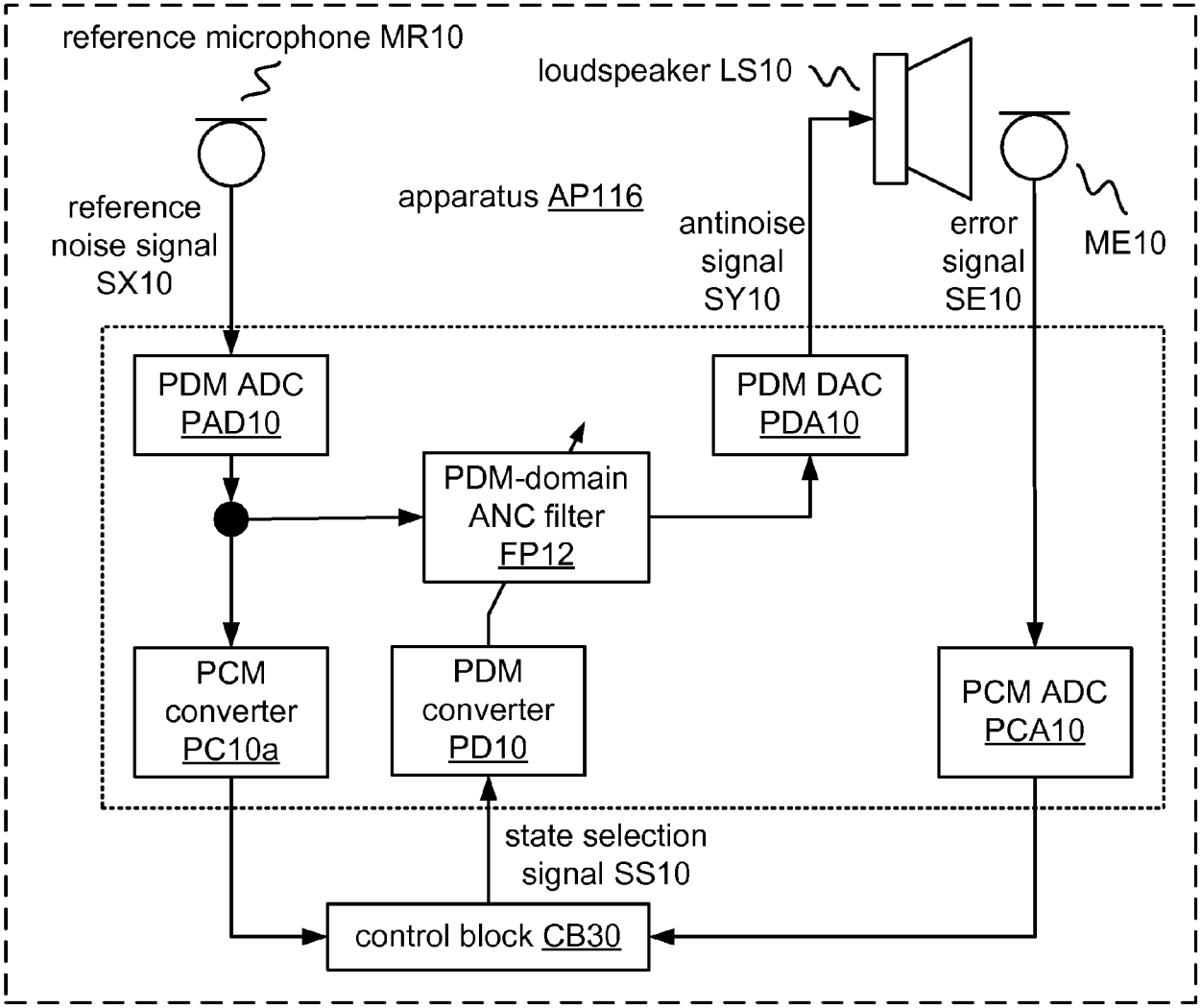
FIG. 28 shows a block diagram of an implementation AP116 of adaptive ANC apparatus A16.

FIG. 28 shows a block diagram of an implementation AP116 of adaptive ANC apparatus A16. Apparatus AP116 includes an instance of PDM ADC PAD10 that is arranged to convert reference noise signal SX10 from the analog domain to a PDM domain, and an instance of adaptable ANC filter FP12 that is configured to filter the converted signal in the PDM domain. Apparatus AP116 also includes an instance of PDM DAC PDA10 that is arranged to convert antinoise signal SY10 from the PDM domain to the analog domain, a PCM ADC PCA10 that is arranged to convert error signal SE10 from the analog domain to the PCM domain, an instance of control block CB30 that is arranged to generate state selection signal SS10 based on information from reference noise signal SX10 and information from error signal SE10 in the PCM domain, and an instance of PDM converter PD10 that is arranged to convert state selection signal SS10 from the PCM domain to the PDM domain.

Figure 29:
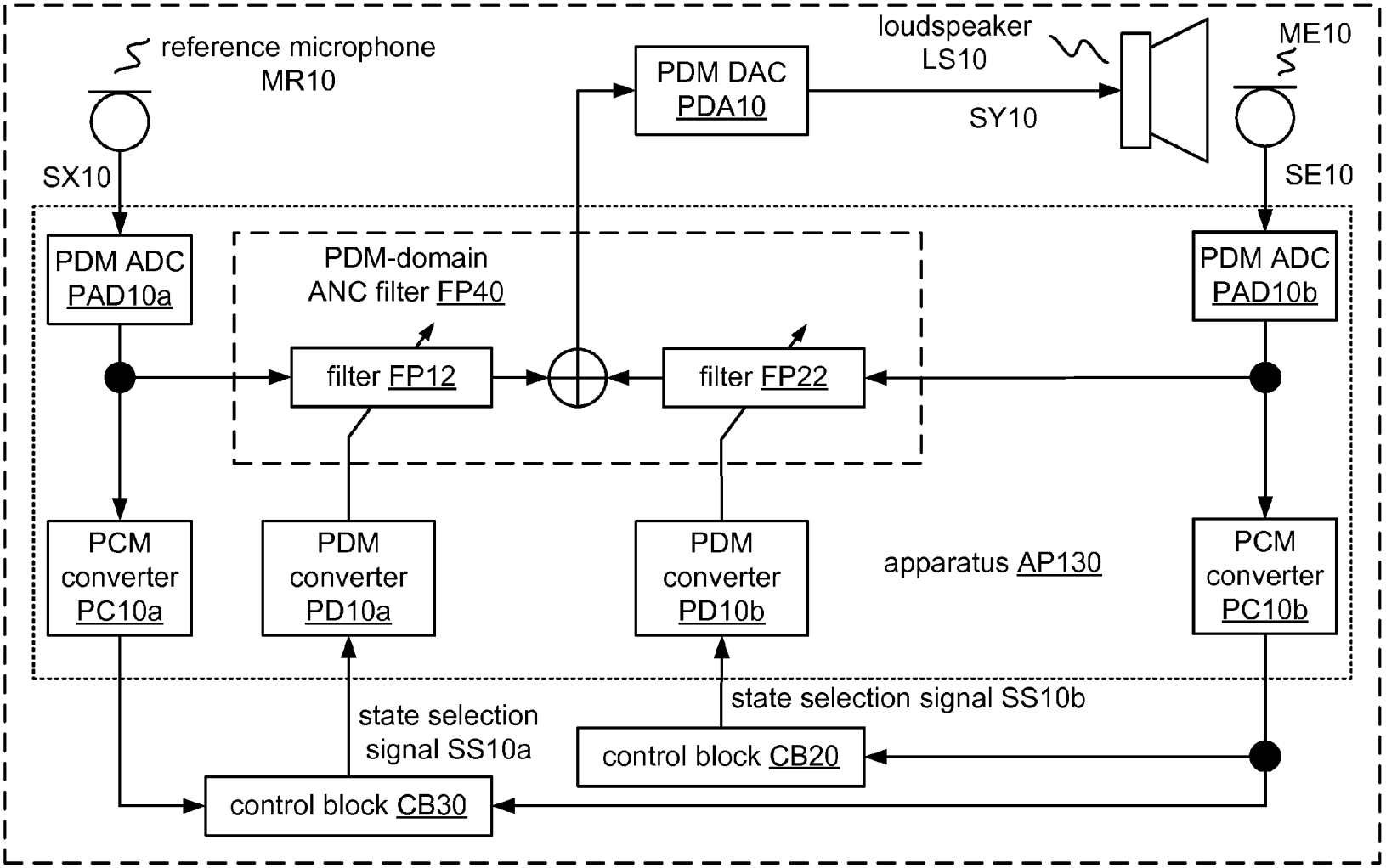
FIG. 29 shows a block diagram of an implementation AP130 of adaptive ANC apparatus A30.

FIG. 29 shows a block diagram of an implementation AP130 of adaptive ANC apparatus A30. Apparatus AP130 includes an instance PAD10*a* of PDM ADC PAD10 that is arranged to convert reference noise signal SX10 from the analog domain to a PDM domain, and an instance PAD10*b* of PDM ADC PAD10 that is arranged to convert error signal SE10 from the analog domain to the PDM domain. Apparatus AP130 also includes an adaptable implementation FP40 of ANC filter F40 that includes an instance of filter FP12 configured to filter reference noise signal SX10 in the PDM domain and an instance of filter FP22 configured to filter error signal SE10 in the PDM domain.

Apparatus AP130 also includes an instance of PDM DAC PDA10 that is arranged to convert antinoise signal SY10 from the PDM domain to the analog domain, an instance PC10*a* of PCM converter PC10 that is arranged to convert reference noise signal SX10 from the analog domain to the PCM domain, and an instance PC10*b* of PCM converter PC10 that is arranged to convert error signal SE10 from the analog domain to the PCM domain. Apparatus AP130 also includes an instance of control block CB30 that is arranged to generate state selection signal SS10*a* based on information from reference noise signal SX10 and information from error signal SE10 in the PCM domain, an instance of control block CB20 that is arranged to generate state selection signal SS10*b* based on information from error signal SE10 in the PCM domain, an instance PD10*a* of PDM converter PD10 that is arranged to convert state selection signal SS10*a* from the PCM domain to the PDM domain, and an instance PD10*b* of PDM converter PD10 that is arranged to convert state selection signal SS10*b* from the PCM domain to the PDM domain.

Figure 30:
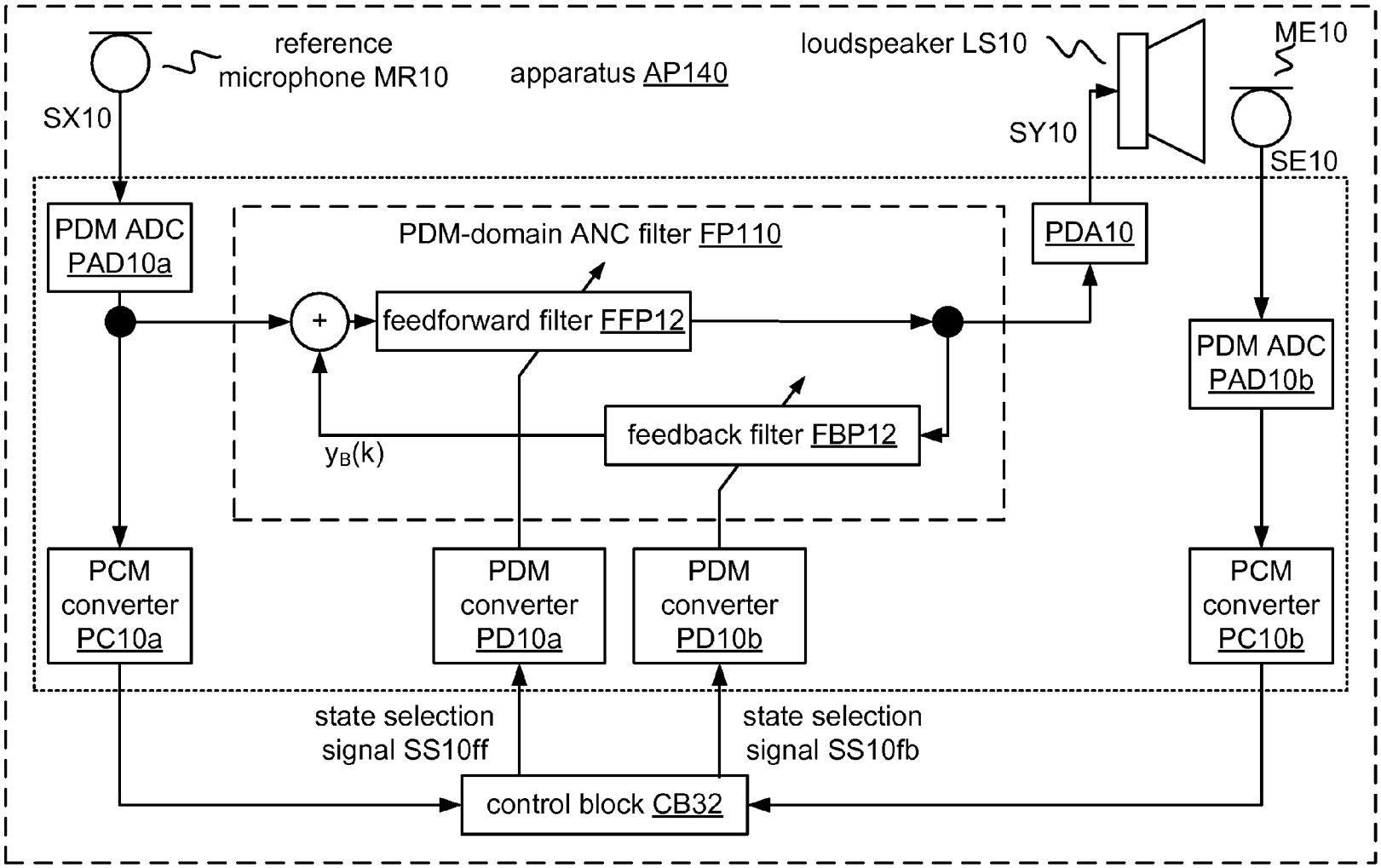
FIG. 30 shows a block diagram of an implementation AP140 of adaptive ANC apparatus A40.

FIG. 30 shows a block diagram of an implementation AP140 of adaptive ANC apparatus A40. Apparatus AP140 includes an instance PAD10*a* of PDM ADC PAD10 that is arranged to convert reference noise signal SX10 from the analog domain to a PDM domain, and an instance PAD10*b* of PDM ADC PAD10 that is arranged to convert error signal SE10 from the analog domain to the PDM domain. Apparatus AP130 also includes an implementation FP110 of ANC filter F110 that includes PDM-domain implementations FFP12 and FBP12 of adaptable filters FF12 and FB12, respectively.

Apparatus AP140 also includes an instance of PDM DAC PDA10 that is arranged to convert antinoise signal SY10 from the PDM domain to the analog domain, an instance PC10*a* of PCM converter PC10 that is arranged to convert reference noise signal SX10 from the analog domain to the PCM domain, and an instance PC10*b* of PCM converter PC10 that is arranged to convert error signal SE10 from the analog domain to the PCM domain. Apparatus AP130 also includes an instance of control block CB32 that is arranged to generate state selection signals SS10*ff* and SS10*fb*, based on information from reference noise signal SX10 and information from error signal SE10 in the PCM domain. Apparatus AP140 also includes an instance PD10*a* of PDM converter PD10 that is arranged to convert state selection signal SS10*ff* from the PCM domain to the PDM domain, and an instance PD10*b* of PDM converter PD10 that is arranged to convert state selection signal SS10*fb* from the PCM domain to the PDM domain.

Figure 31A:
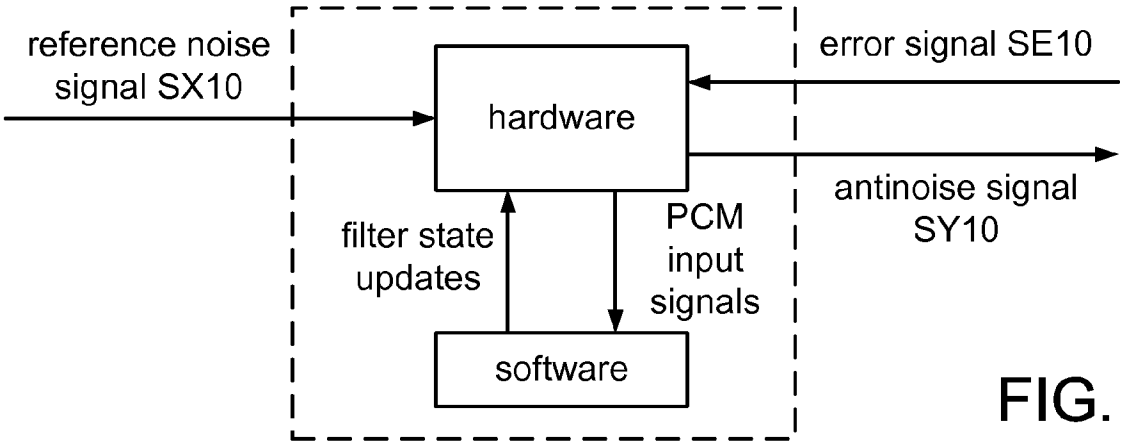
FIG. 31A shows an example of a connection diagram between an adaptable ANC filter operating on a fixed hardware configuration and an associated ANC filter adaptation routine operating in software.
Figure 31B:
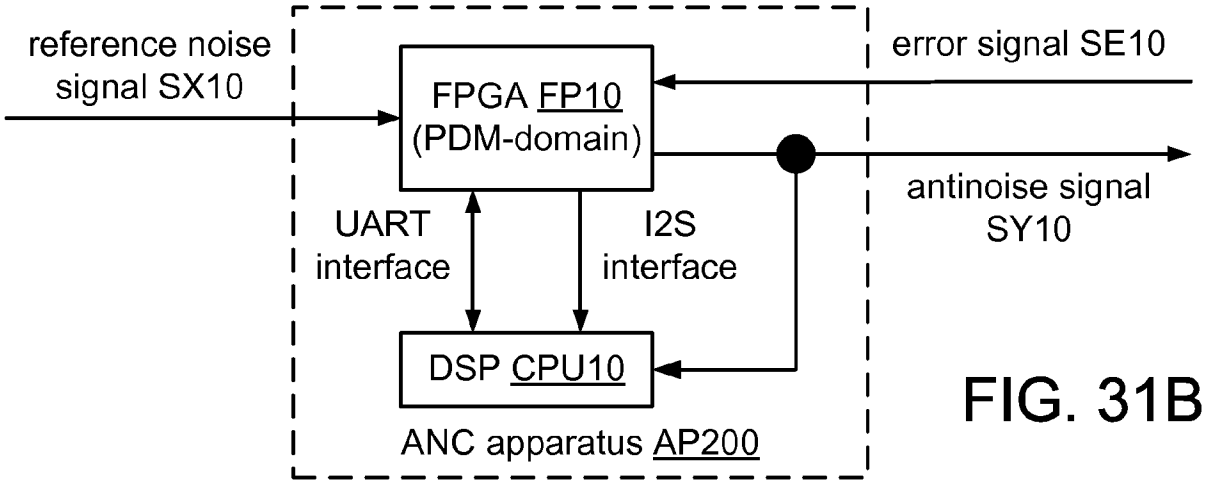
FIG. 31B shows a block diagram of an ANC apparatus AP200.

The dotted box in each of FIGS. 22 and 26-30 indicates that it may be desirable to implement the elements within the dotted box (i.e., the filter and converters) in hardware (e.g., an ASIC or FPGA), with the associated control block being implemented in software executing in the PCM domain. FIG. 31A shows an example of a connection diagram between an adaptable ANC filter operating on a fixed hardware configuration (e.g., on a programmable logic device (PLD), such as an FPGA) in a PDM domain and an associated ANC filter adaptation routine operating in a PCM domain in software (e.g., on a DSP) to produce an implementation of an adaptable ANC apparatus as described herein in a feed-forward arrangement. FIG. 31B shows a block diagram of an ANC apparatus AP200 that includes an adaptable ANC filter operating on an FPGA FP10 in a PDM domain and an associated ANC filter adaptation routine operating in a PCM domain in software on a DSP CPU10 to produce an implementation of an adaptive ANC apparatus AP112, AP114, AP116, AP130, or AP140 as described herein.

There may be differences between the fixed ANC structure and the DSP regarding the transfer functions of the analog-to-digital conversion, digital-to-analog conversion, microphone preamplifier, and loudspeaker amplifier. It may be desirable to configure the codec (e.g., the FPGA) to convert the audio signals (e.g., signals x, y, a, e) from the OSR (e.g., PDM) domain to the adaptation (e.g., PCM) domain, and to route the PCM audio input and output signals from the fixed ANC structure directly to the DSP over an I2S (Inter-IC Sound, Philips, June 1996) interface. In such case, it may be desirable to configure the DSP I2S in slave mode.

The DSP CPU10 may be configured to transmit state selection signal SS10 (e.g., updated filter coefficient values) to the fixed codec (e.g., FPGA) via a UART (Universal Asynchronous Receive and Transmission) or I2C interface. ("Fixed codec" means that adaptation of the filter coefficients is not performed within the codec.) It may be desirable to configure apparatus AP200 such that the update values carried by state selection signal SS10 are stored in memory blocks or "buffers" within the FPGA.

A PDM-domain filter (e.g., filter FP10, FP20, FP12, FP22, FFP12, FBP12) may produce an output that has a bit width which is greater than that of its input. In such case, it may be desirable to reduce the bit width of the signal produced by the filter. For example, it may be desirable to convert the signal produced by the filter to a one-bit-wide digital signal upstream of the audio output stage (e.g., loudspeaker LS10 or its driving circuit).

An instance of PDM converter PD20 may be implemented within the PDM-domain filter, within PDM DAC PDA10, and/or between these two stages. It is noted that the PDM-domain filter may also be implemented to include a cascade of two or more filtering stages (each receiving a one-bit-wide signal and producing a signal having a bit width greater than one, with at least one stage being selectably configurable according to state selection signal SS10) alternating with respective converter stages (each configured to convert its input to a one-bit-wide signal).

An audible audio discontinuity may occur if the coefficient update rate is too low (i.e., if the interval between filter state updates is too long). It may be desirable to implement proper audio ramping within the fixed ANC structure. In one such example, the adaptable ANC filter (e.g., filter F12, F22, F40, FF12, FB12, F110, FG10, FG20, FP12, FP22, FP40, FFP12, FBP12, or FP110) is implemented to include two copies running in parallel, with one copy providing the output while the other is being updated. For example, after buffering of the updated filter coefficient values is done, the input signal is fed to the second filter copy and the audio is ramped (e.g., according to proper ramping time constants) to the second filter copy. Such ramping may be performed, for example, by mixing the outputs of the two filter copies and fading from one output to the other. When the ramping operation is completed, the coefficient values of the first filter copy may be updated. Updating filter coefficient values at the output zero crossing point may also reduce audio distortion caused by discontinuity.

As noted above, it may be desirable to configure any of the implementations of ANC apparatus A10 or A20 described herein (e.g., apparatus AP10, AP20, AP112, AP114, AP116, AP122, AP130, AP140) to mix antinoise signal SY20 with a desired sound signal SD10 to produce an audio output signal S010 for reproduction by loudspeaker LS10.

A system including an implementation of apparatus A10 or A20 may be configured to use antinoise signal SY10 (or audio output signal S010) to drive a loudspeaker directly. Alternatively, it may be desirable to implement such an apparatus to include an audio output stage that is configured to drive the loudspeaker. For example, such an audio output stage may be configured to amplify the audio signal, to provide impedance matching and/or gain control, and/or to perform any other desired audio processing operation. In such case, it may be desirable for the secondary acoustic path estimate $S_{est}(z)$ to include the response of the audio output stage.

It may be desirable to implement the adaptive ANC algorithm to process reference noise signal SX10 as a multichannel signal, in which each channel is based on a signal from a different microphone. Multichannel ANC processing may be used, for example, to support noise suppression at higher frequencies, to distinguish sound sources from one another (e.g., based on direction and/or distance), and/or to attenuate nonstationary noise. Such an implementation of control block CB10, CB30, CB32, CB34, or CB36 may be configured to execute a multichannel adaptive algorithm (e.g., a multichannel LMS algorithm, such as a multichannel FXLMS or FELMS algorithm).

In a device that includes an ANC apparatus as described herein, it may be desirable to use reference noise signal SX10 and/or error signal SE10 for other audio processing operations as well, such as noise reduction. In addition to gain adaptation as described above, for example, the subband reference noise and/or error signal spectrum may also be used by other algorithms to enhance voice and/or music, such as frequency-domain equalization, multiband dynamic range control, equalization of a reproduced audio signal based on an ambient noise estimate, etc. It is also noted that any of apparatus AP112, AP114, AP116, AP122, AP130, and AP140 may also be implemented to include direct conversion of reference noise signal SX10 and/or error signal SE10 from analog to the PCM domain (e.g., in place of PDM-to-PCM conversion via PCM converter PC10). Such an implementation may be desirable, for example, in an integration with another apparatus in which such analog-to-PCM conversion is already available.

FIGS. 32A to 37B show examples of devices within which any of the various ANC structures and arrangements described above may be implemented.

Figure 32C:
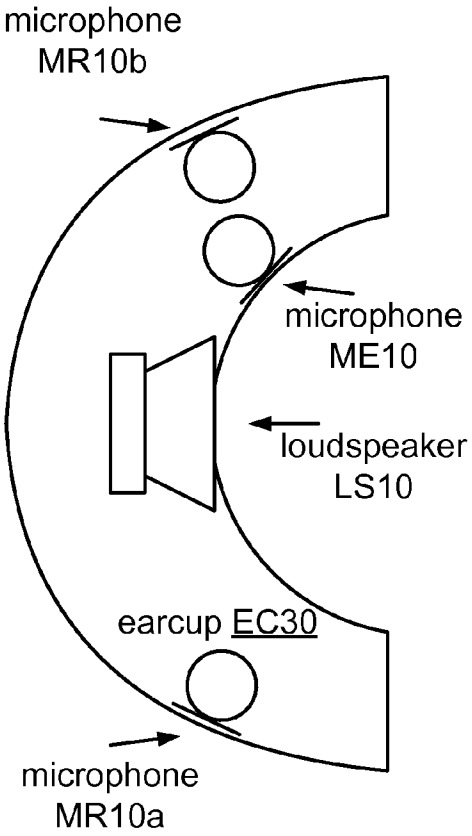
FIG. 32C shows a cross-section of an implementation EC30 of earcup EC20.
Figure 32B:
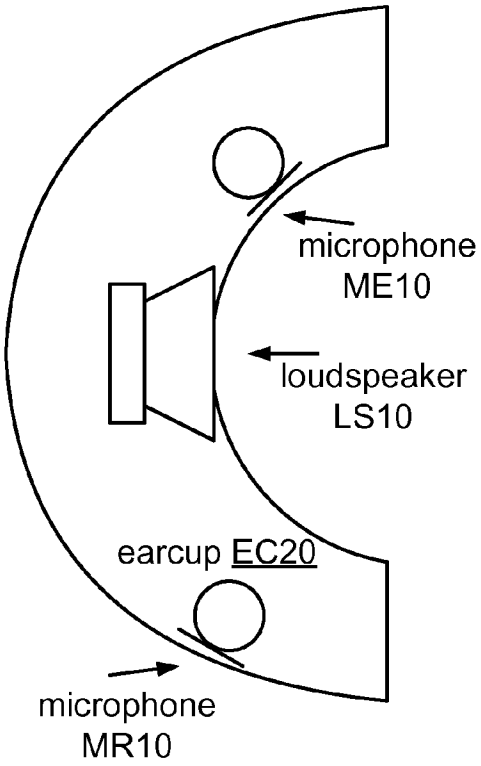
FIG. 32B shows a cross-section of an implementation EC20 of earcup EC10.
Figure 32A:
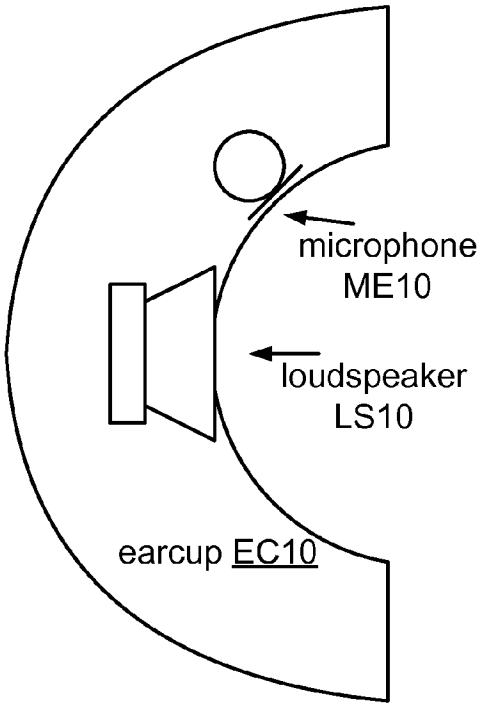
FIG. 32A shows a cross-section of an earcup EC10.

In an ANC system that includes an error microphone (e.g., a feedback ANC system), it may be desirable for the error microphone to be disposed within the acoustic field generated by the loudspeaker. For example, it may be desirable for the error microphone to be disposed with the loudspeaker within the earcup of a headphone. It may also be desirable for the error microphone to be acoustically insulated from the environmental noise. FIG. 32A shows a cross-section of an earcup EC10 that includes an instance of loudspeaker LS10 arranged to reproduce the signal to the user's ear and an instance of error microphone ME10 arranged to receive the error signal (e.g., via an acoustic port in the earcup housing). It may be desirable in such case to insulate microphone ME10 from receiving mechanical vibrations from loudspeaker LS10 through the material of the earcup. FIG. 32B shows a cross-section of an implementation EC20 of earcup EC10 that also includes an instance of reference microphone MR10 arranged to receive an ambient noise signal (e.g., such that the microphones provide respective microphone channels). FIG. 32C shows a cross-section (e.g., in a horizontal plane or in a vertical plane) of an implementation EC30 of earcup EC20 that also includes multiple instances MR10*a*, MR10*b* of reference microphone MR10 arranged to receive ambient noise signals from different directions. Multiple instances of reference microphone MR10 may be used to support calculation of a multichannel or improved single-channel noise estimate (e.g., including a spatially selective processing operation) and/or to support a multichannel ANC algorithm (e.g., a multichannel LMS algorithm).

An earpiece or other headset having one or more microphones is one kind of portable communications device that may include an implementation of an ANC apparatus as described herein. Such a headset may be wired or wireless. For example, a wireless headset may be configured to support half- or full-duplex telephony via communication with a telephone device such as a cellular telephone handset (e.g., using a version of the Bluetooth™ protocol as promulgated by the Bluetooth Special Interest Group, Inc., Bellevue, Wash.).

Figure 33A:
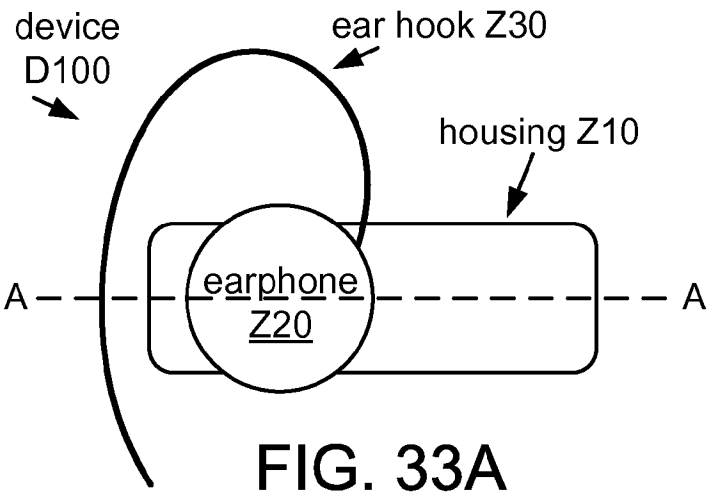
FIGS. 33A to 33D show various views of a multi-microphone wireless headset D100.
Figure 33B:
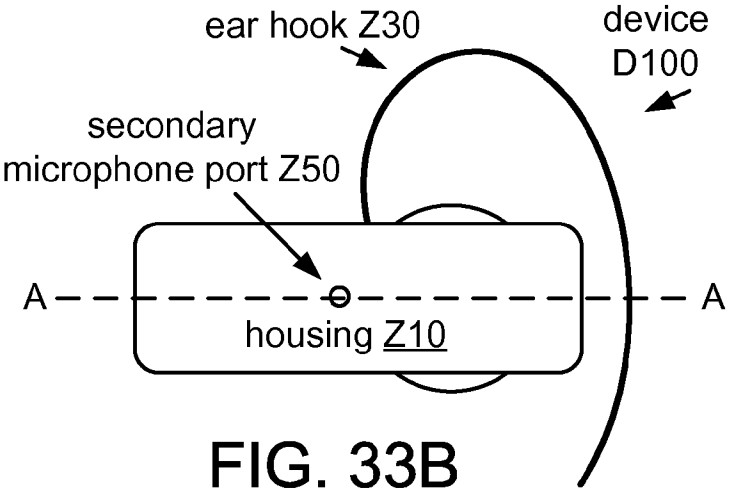
Figure 33C:
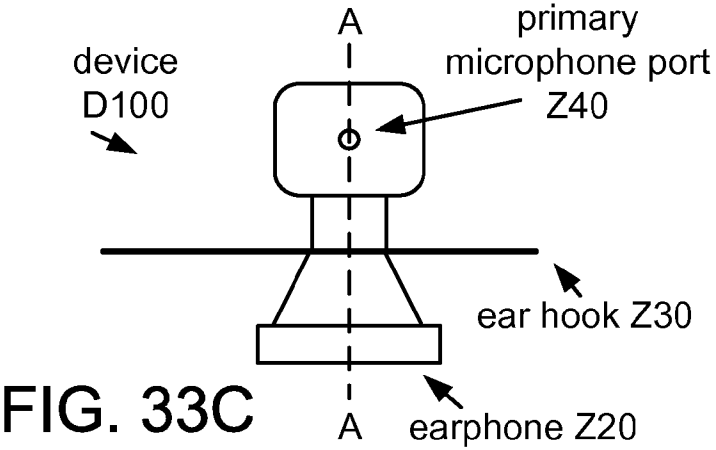
Figure 33D:
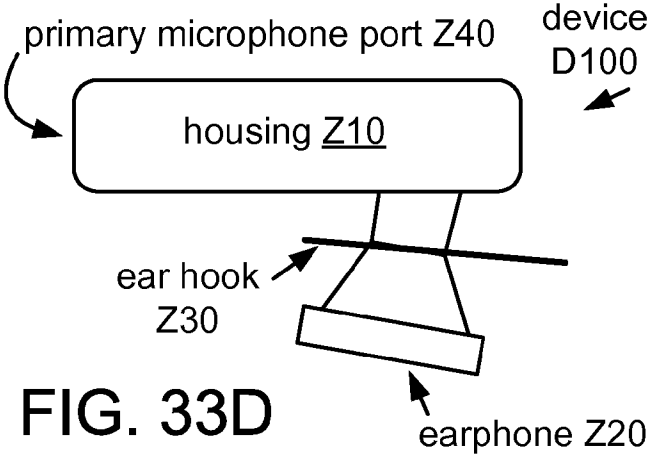

FIGS. 33A to 33D show various views of a multi-microphone portable audio sensing device D100 that may include an implementation of any of the ANC systems described herein. Device D100 is a wireless headset that includes a housing Z10 which carries a two-microphone array and an earphone Z20 that extends from the housing. In general, the housing of a headset may be rectangular or otherwise elongated as shown in FIGS. 33A, 33B, and 33D (e.g., shaped like a miniboom) or may be more rounded or even circular. The housing may also enclose a battery and a processor and/or other processing circuitry (e.g., a printed circuit board and components mounted thereon) and may include an electrical port (e.g., a mini-Universal Serial Bus (USB) or other port for battery charging) and user interface features such as one or more button switches and/or LEDs. Typically the length of the housing along its major axis is in the range of from one to three inches.

Figure 33E:
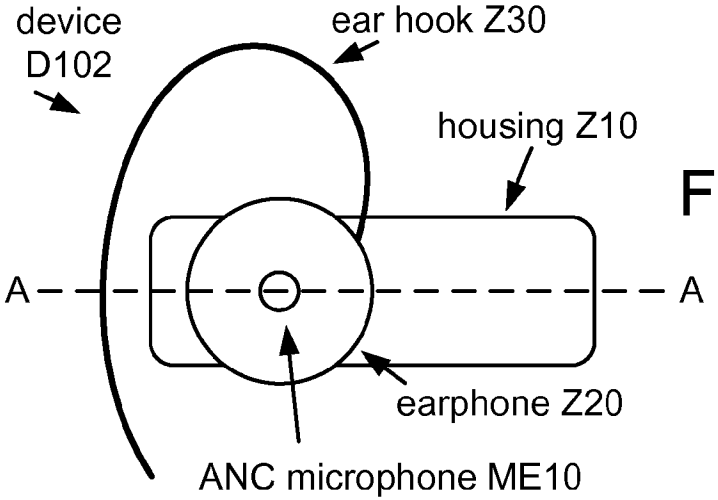
FIGS. 33E to 33G show various views of an implementation D102 of headset D100.
Figure 33G:
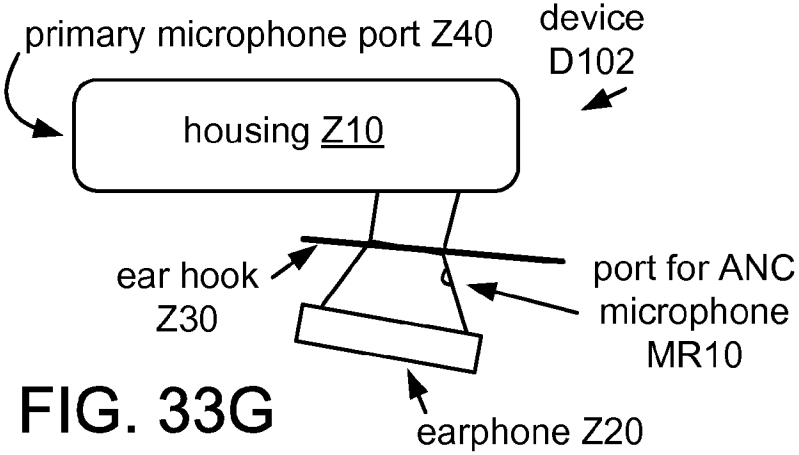
Figure 33F:
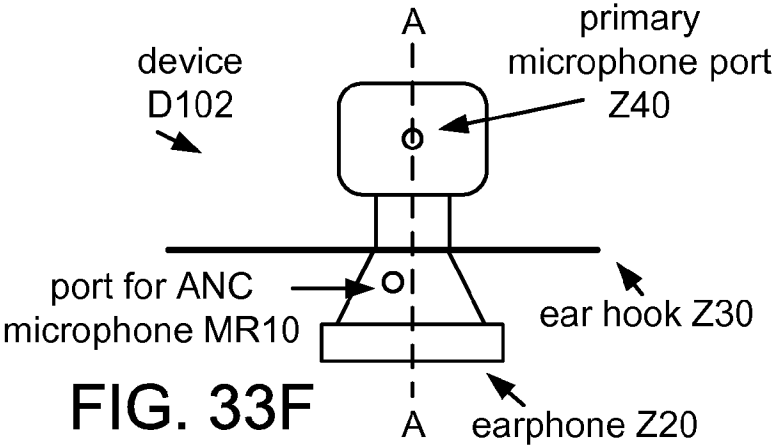

Typically each microphone of array R100 is mounted within the device behind one or more small holes in the housing that serve as an acoustic port. FIGS. 33B to 33D show the locations of the acoustic port Z40 for the primary microphone of the array of device D100 and the acoustic port Z50 for the secondary microphone of the array of device D100 (e.g., reference microphone MR10). FIGS. 33E to 33G show various views of an implementation D102 of headset D100 that includes ANC microphones ME10 and MR10.

Figure 33H:
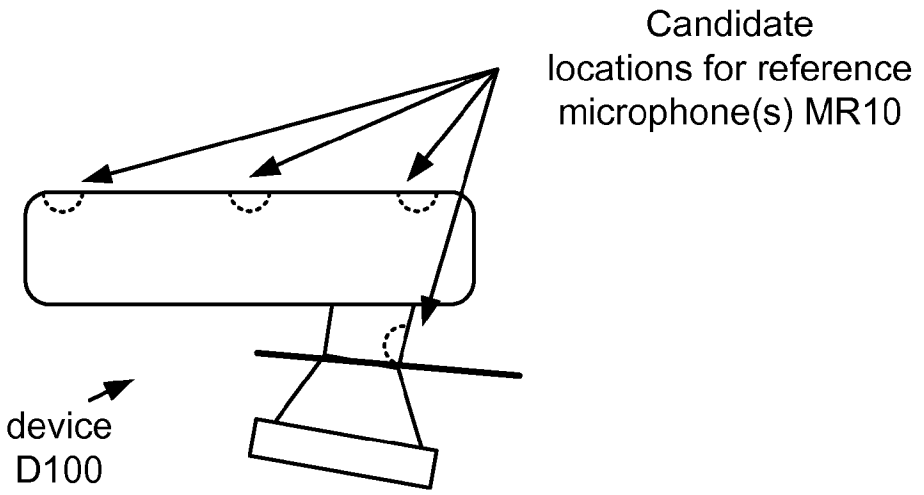
FIG. 33H shows four examples of locations within device D100 at which instances of reference microphones MR10 may be located.
Figure 33I:
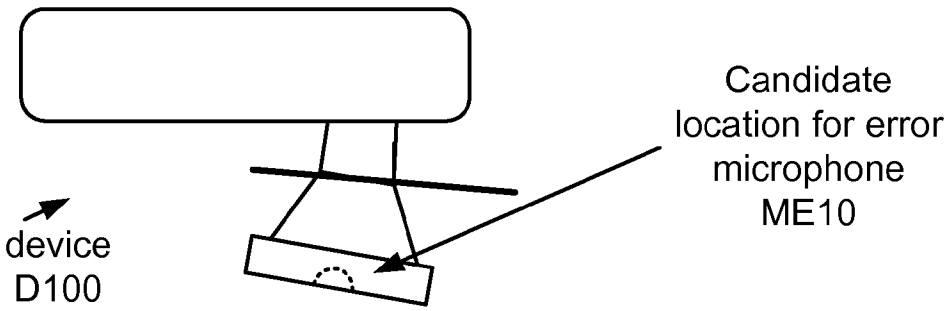
FIG. 33I shows an example of a location within device D100 at which error microphone ME10 may be located.

FIG. 33H shows several candidate locations at which one or more reference microphones MR10 may be disposed within headset D100. As shown in this example, microphones MR10 may be directed away from the user's ear to receive external ambient sound. FIG. 33I shows a candidate location at which error microphone ME10 may be disposed within headset D100.

A headset may also include a securing device, such as ear hook Z30, which is typically detachable from the headset. An external ear hook may be reversible, for example, to allow the user to configure the headset for use on either ear. Alternatively, the earphone of a headset may be designed as an internal securing device (e.g., an earplug) which may include a removable earpiece to allow different users to use an earpiece of different size (e.g., diameter) for better fit to the outer portion of the particular user's ear canal. The earphone of a headset may also include a microphone arranged to pick up an acoustic error signal (e.g., error microphone ME10).

Figure 34A:
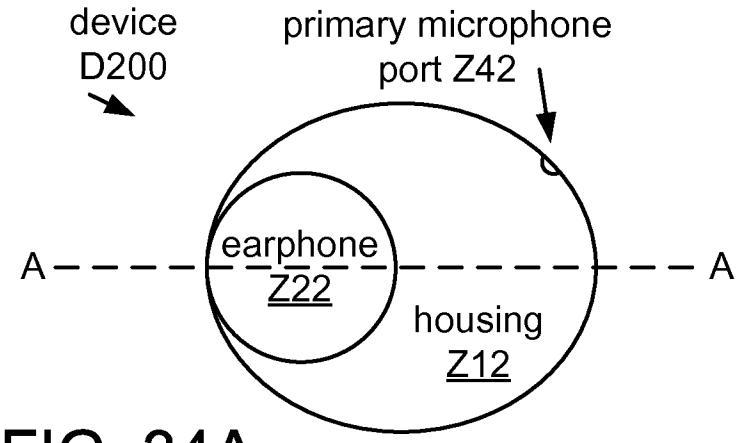
FIGS. 34A to 34D show various views of a multi-microphone wireless headset D200.
Figure 34B:
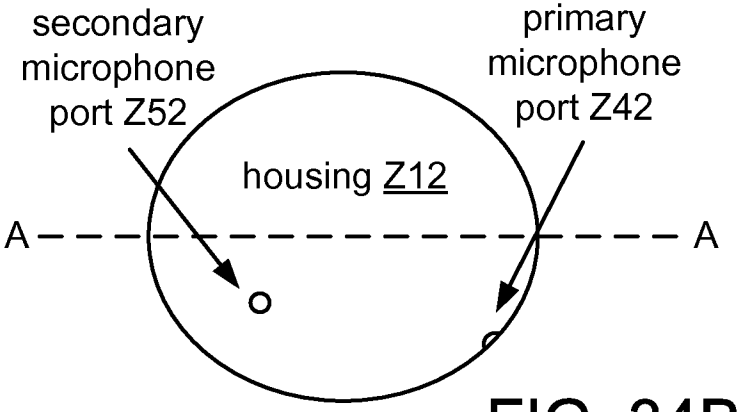
Figure 34C:
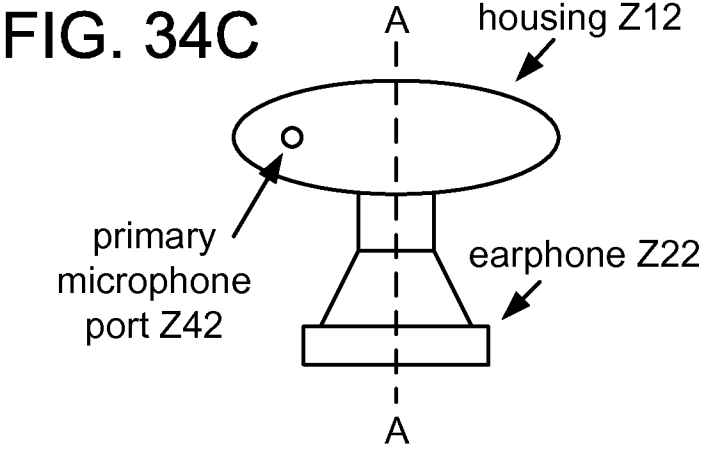
Figure 34D:
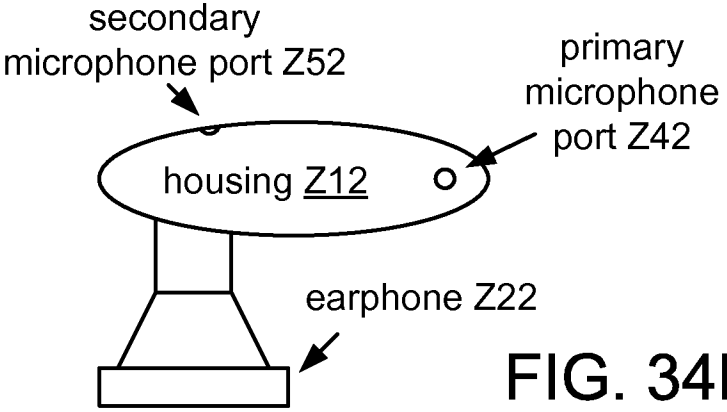
Figure 34E:
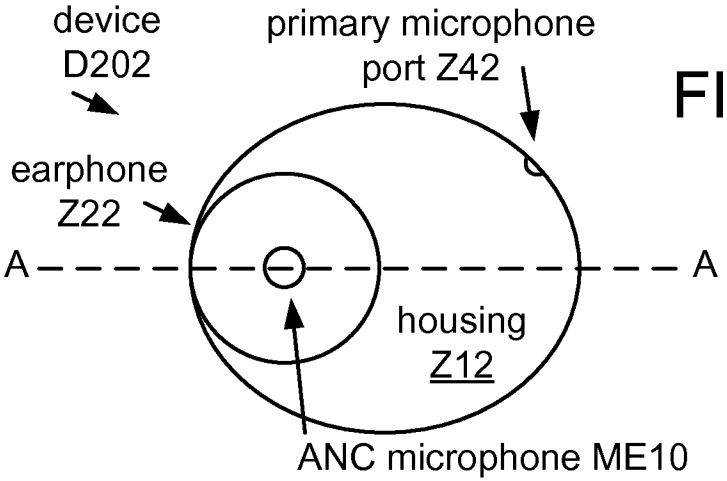
FIGS. 34E and 34F show various views of an implementation D202 of headset D200.
Figure 34F:
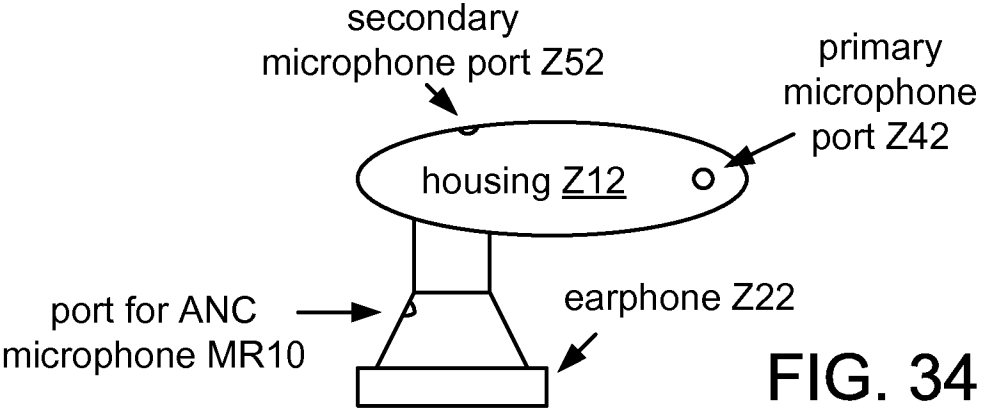

FIGS. 34A to 34D show various views of a multi-microphone portable audio sensing device D200 that is another example of a wireless headset that may include an implementation of any of the ANC systems described herein. Device D200 includes a rounded, elliptical housing Z12 and an earphone Z22 that may be configured as an earplug. FIGS. 34A to 34D also show the locations of the acoustic port Z42 for the primary microphone and the acoustic port Z52 for the secondary microphone of the array of device D200 (e.g., reference microphone MR10). It is possible that secondary microphone port Z52 may be at least partially occluded (e.g., by a user interface button). FIGS. 34E and 34F show various views of an implementation D202 of headset D200 that includes ANC microphones ME10 and MR10.

Figure 35:
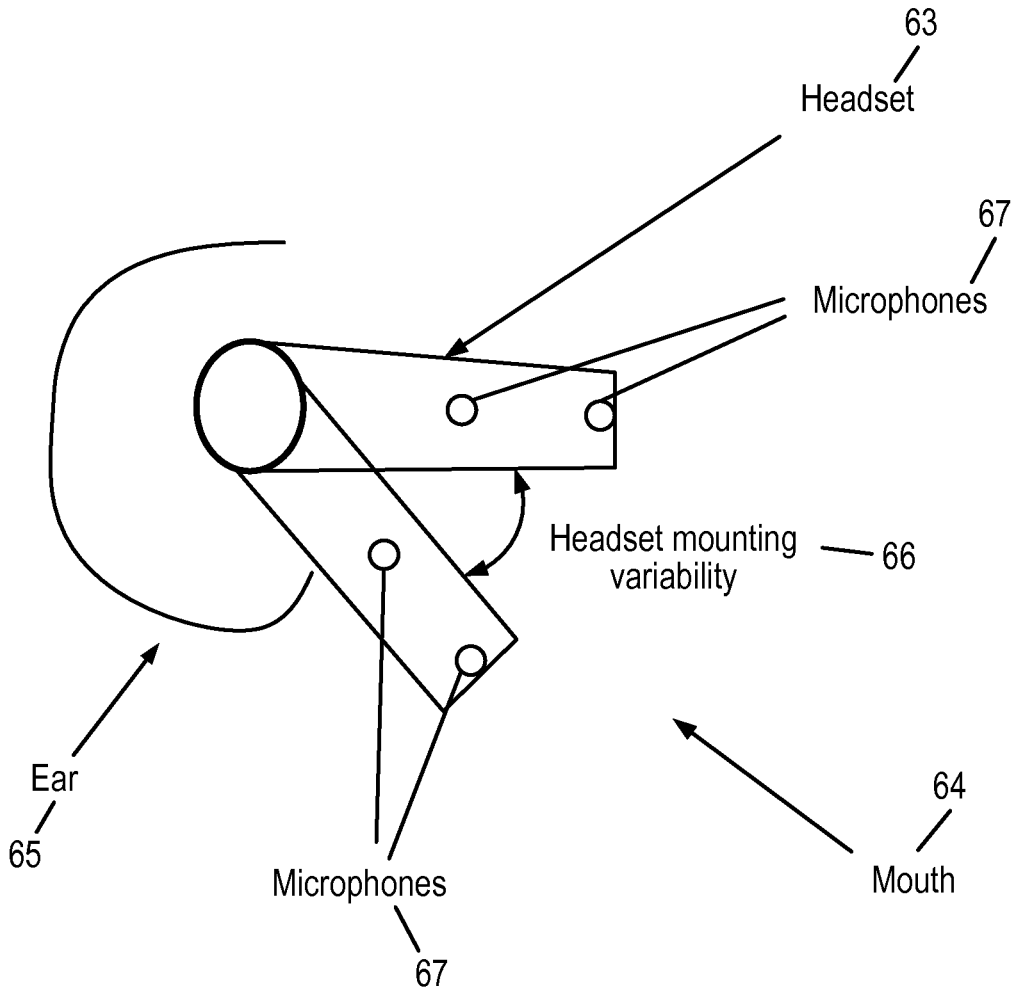
FIG. 35 shows a diagram of various standard orientations of a headset 63.
Figure 36:
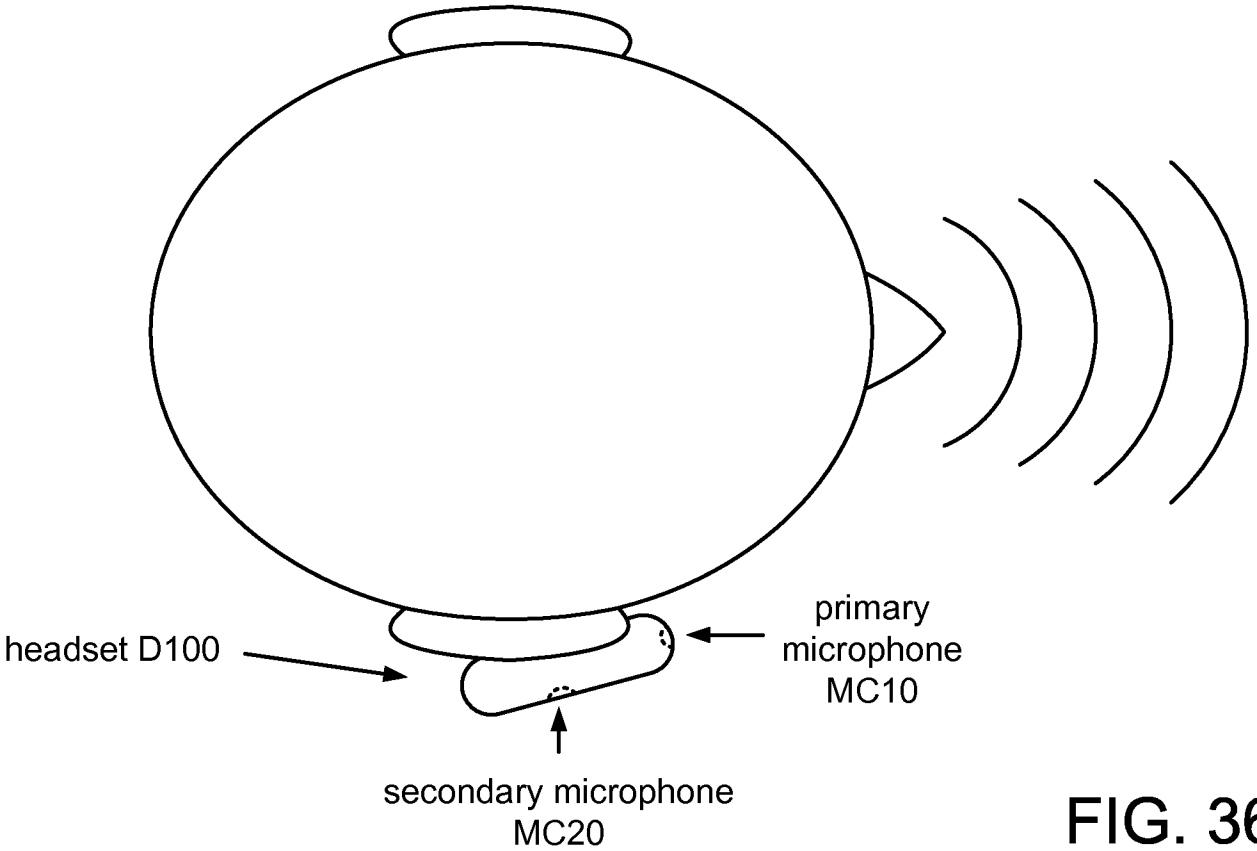
FIG. 36 shows a top view of headset D100 mounted on a user's ear.

FIG. 35 shows a diagram of a range 66 of different operating configurations of such a headset 63 (e.g., device D100 or D200) as mounted for use on a user's ear 65. Headset 63 includes an array 67 of primary (e.g., endfire) and secondary (e.g., broadside) microphones that may be oriented differently during use with respect to the user's mouth 64. Such a headset also typically includes a loudspeaker (not shown) which may be disposed at an earplug of the headset. In a further example, a handset that includes the processing elements of an implementation of an adaptive ANC apparatus as described herein is configured to receive the microphone signals from a headset having one or more microphones, and to output the loudspeaker signal to the headset, over a wired and/or wireless communications link (e.g., using a version of the Bluetooth™ protocol). FIG. 36 shows a top view of headset D100 mounted on a user's ear in a standard orientation relative to the user's mouth, with secondary microphone MC20 (e.g., reference microphone MR10) directed away from the user's ear to receive external ambient sound.

Figure 37A:
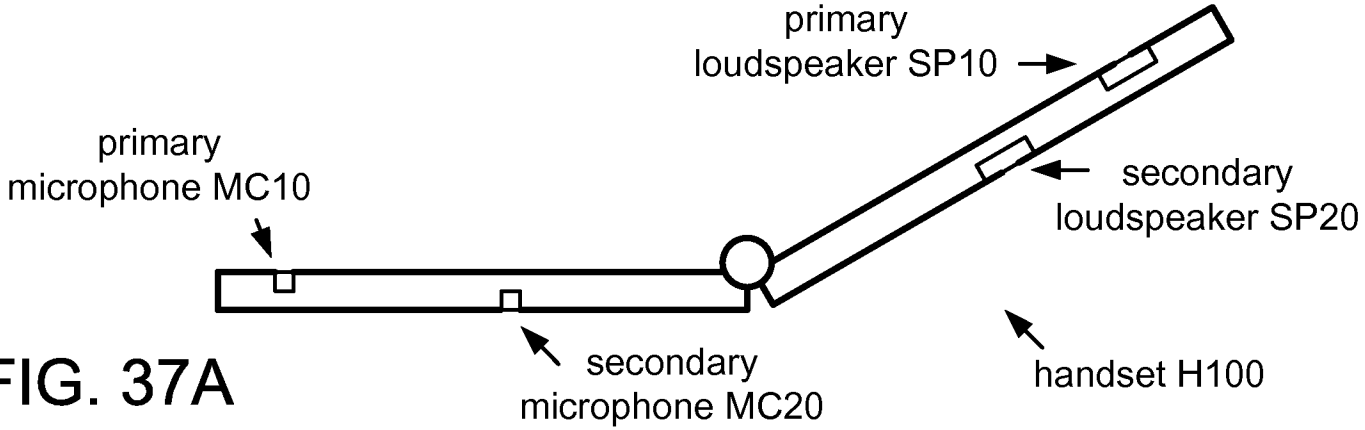
FIG. 37A shows a diagram of a communications handset H100.
Figure 37B:
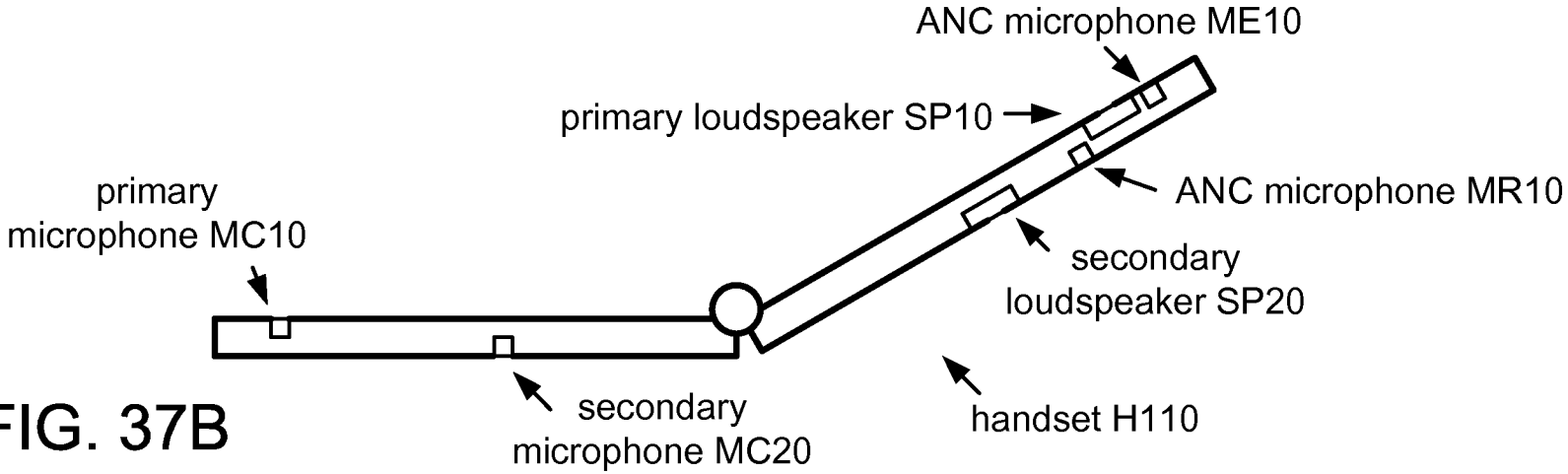
FIG. 37B shows a diagram of an implementation H110 of handset H100.

FIG. 37A shows a cross-sectional view (along a central axis) of a multi-microphone portable audio sensing device H100 that is a communications handset that may include an implementation of any of the ANC systems described herein. Device H100 includes a two-microphone array having a primary microphone MC10 and a secondary microphone MC20 (e.g., reference microphone MR10). In this example, device H100 also includes a primary loudspeaker SP10 and a secondary loudspeaker SP20. Such a device may be configured to transmit and receive voice communications data wirelessly via one or more encoding and decoding schemes (also called "codecs"). Examples of such codecs include the Enhanced Variable Rate Codec, as described in the Third Generation Partnership Project 2 (3GPP2) document C.S0014-C, v1.0, entitled "Enhanced Variable Rate Codec, Speech Service Options 3, 68, and 70 for Wideband Spread Spectrum Digital Systems," February 2007 (available online at www-dot-3gpp-dot-org); the Selectable Mode Vocoder speech codec, as described in the 3GPP2 document C.S0030-0, v3.0, entitled "Selectable Mode Vocoder (SMV) Service Option for Wideband Spread Spectrum Communication Systems," January 2004 (available online at www-dot-3gpp-dot-org); the Adaptive Multi Rate (AMR) speech codec, as described in the document ETSI TS 126 092 V6.0.0 (European Telecommunications Standards Institute (ETSI), Sophia Antipolis Cedex, FR, December 2004); and the AMR Wideband speech codec, as described in the document ETSI TS 126 192 V6.0.0 (ETSI, December 2004). In the example of FIG. 37A, handset H100 is a clamshell-type cellular telephone handset (also called a "flip" handset). Other configurations of such a multi-microphone communications handset include bar-type and slider-type telephone handsets. Other configurations of such a multi-microphone communications handset may include an array of three, four, or more microphones. FIG. 37B shows an implementation H110 of handset H100 that includes ANC microphones ME10 and MR10.

The foregoing presentation of the described configurations is provided to enable any person skilled in the art to make or use the methods and other structures disclosed herein. The flowcharts, block diagrams, state diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for voice communications at higher sampling rates (e.g., for wideband communications).

The various elements of an implementation of an apparatus as disclosed herein (e.g., apparatus A10, A12, A14, A16, A20, A22, A30, A40, A50, A60, AP10, AP20, AP112, AP114, AP116, AP122, AP130, AP140, AP200) may be embodied in any combination of hardware, software, and/or firmware that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips). It is also noted that within each of apparatus A12, A14, A16, A22, A30, and A40, the combination of the ANC filter and the associated control block(s) is itself an ANC apparatus. Likewise, within each of apparatus AP10 and AP20, the combination of the ANC filter and the associated converters is itself an ANC apparatus. Likewise, within each of apparatus AP112, AP114, AP116, AP122, AP130, and AP140, the combination of the ANC filter and the associated control block(s) and converters is itself an ANC apparatus.

One or more elements of the various implementations of the apparatus disclosed herein may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

Those of skill will appreciate that the various illustrative modules, logical blocks, circuits, and operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, a CD-ROM, or any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various operations disclosed herein may be performed by a array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor readable medium or transmitted by a computer data signal embodied in a carrier wave over a transmission medium or communication link.

The implementations of methods, schemes, and techniques disclosed herein may also be tangibly embodied (for example, in one or more computer-readable media as listed herein) as one or more sets of instructions readable and/or executable by a machine including an array of logic elements (e.g., a processor, microprocessor, microcontroller, or other finite state machine). The term "computer-readable medium" may include any medium that can store or transfer information, including volatile, nonvolatile, removable and non-removable media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various operations disclosed herein may be performed by a portable communications device such as a handset, headset, or portable digital assistant (PDA), and that the various apparatus described herein may be included with such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer storage media and communication media, including any medium that facilitates transfer of a computer program from one place to another. A storage media may be any available media that can be accessed by a computer. By way of example, and not limitation, such computer-readable media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage, magnetic disk storage or other magnetic storage devices, or any other medium that can be used to store desired program code, in the form of instructions or data structures, in tangible structures that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

What is claimed is:

1. A method of producing an antinoise signal, said method comprising:

producing the antinoise signal during a first time interval by applying a digital filter to a reference noise signal according to a first state of the digital filter that includes a filter gain;

calculating a second state of the digital filter that is different than the first state of the digital filter and includes an update for said filter gain; and producing the antinoise signal during a second time interval subsequent to the first time interval by applying the digital filter to the reference noise signal according to said second state of the digital filter, wherein said applying the digital filter to the reference noise signal includes:

applying a filter to the reference noise signal, in a filtering domain having a first sampling rate, to produce a filtered signal; and controlling a gain of the filtered signal according to the filter gain to produce the antinoise signal, and wherein said calculating the second state of the digital filter includes:

applying a copy of said filter to the reference noise signal, in an adaptation domain having a second sampling rate that is lower than the first sampling rate, to produce a second filtered signal; and calculating said update based on information from said second filtered signal and on information from an error signal.

2. The method of producing an antinoise signal according to claim 1, wherein the first sampling rate is at least fifty thousand Hertz.

3. The method of producing an antinoise signal according to claim 1, wherein the first sampling rate is at least eight times the second sampling rate.

4. The method of producing an antinoise signal according to claim 1, wherein said error signal is based on a signal that is produced by a microphone in response to an acoustic signal based on said antinoise signal.

5. The method of producing an antinoise signal according to claim 1, wherein said method comprises mixing the antinoise signal with a desired sound signal, and wherein said calculating said update is based on a sum of the second filtered signal and the desired sound signal.

6. The method of producing an antinoise signal according to claim 1, wherein said calculating the second filter state includes, for each of a plurality of subbands of said error signal, calculating an energy of the subband, and wherein said update for said filter gain is based on said calculated energies.

7. An apparatus for producing an antinoise signal, said apparatus comprising:

means for producing the antinoise signal during a first time interval by filtering a reference noise signal, in a filtering domain having a first sampling rate, according to a first state of the means for producing the antinoise signal that includes a filter gain; and means for calculating a second state of the means for producing the antinoise signal that is different than the first state of the means for producing the antinoise signal and includes an update for said filter gain, wherein said means for producing the antinoise signal is configured to produce the antinoise signal during a second time interval subsequent to the first time interval by filtering the reference noise signal in the filtering domain according to the second state of the means for producing the antinoise signal, and wherein said means for producing the antinoise signal includes:

means for filtering the reference noise signal to produce a filtered signal; and means for controlling a gain of the filtered signal according to the filter gain to produce the antinoise signal, and wherein said means for calculating the second state of the means for producing the antinoise signal includes:

a copy of said means for filtering arranged to filter the reference noise signal, in an adaptation domain having a second sampling rate that is lower than the first sampling rate, to produce a second filtered signal; and means for calculating said update based on information from said second filtered signal and on information from an error signal.

8. The apparatus for producing an antinoise signal according to claim 7, wherein said error signal is based on a signal that is produced by a microphone in response to an acoustic signal based on said antinoise signal.

9. The apparatus for producing an antinoise signal according to claim 7, wherein said apparatus is configured to mix the antinoise signal with a desired sound signal, and wherein said calculating said update is based on a sum of the second filtered signal and the desired sound signal.

10. The apparatus for producing an antinoise signal according to claim 7, wherein said calculating the second state of the means for producing the antinoise signal includes, for each of a plurality of subbands of said error signal, calculating an energy of the subband, and wherein said update for said filter gain is based on said calculated energies.

11. An apparatus for producing an antinoise signal, said apparatus comprising:

a digital filter configured to produce the antinoise signal during a first time interval by filtering a reference noise signal, in a filtering domain having a first sampling rate, according to a first state of the digital filter that includes a filter gain; and a control block configured to calculate a second state of the digital filter that is different than the first state of the digital filter and includes an update for said filter gain, wherein the digital filter is configured to produce the antinoise signal during a second time interval subsequent to the first time interval by filtering the reference noise signal in the filtering domain according to the second state of the digital filter, and wherein said digital filter includes:

a filter configured to filter the reference noise signal to produce a filtered signal; and a gain control element configured to control a gain of the filtered signal according to the filter gain to produce the antinoise signal, and wherein said control block includes:

a copy of said filter configured to filter the reference noise signal, in an adaptation domain having a second sampling rate that is lower than the first sampling rate, to produce a second filtered signal; and a calculator configured to calculate said update based on information from said second filtered signal and on information from an error signal.

12. The apparatus for producing an antinoise signal according to claim 11, wherein said apparatus includes a filter configured to receive a sensed noise signal from each of a plurality of different microphones and to perform a spatially selective processing operation to produce the reference noise signal, wherein the reference noise signal is based on information from each of the plurality of sensed noise signals.

13. The apparatus for producing an antinoise signal according to claim 11, wherein the first sampling rate is at least fifty thousand Hertz.

14. The apparatus for producing an antinoise signal according to claim 11, wherein the first sampling rate is at least eight times the second sampling rate.

15. The apparatus for producing an antinoise signal according to claim 11, wherein said apparatus includes a converter configured to convert the error signal to the second sampling rate.

16. The apparatus for producing an antinoise signal according to claim 11, wherein said error signal is based on a signal that is produced by a microphone in response to an acoustic signal based on said antinoise signal.

17. The apparatus for producing an antinoise signal according to claim 11, wherein said apparatus is configured to mix the antinoise signal with a desired sound signal, and wherein said calculator is configured to calculate said update based on a sum of the second filtered signal and the desired sound signal.

18. The apparatus for producing an antinoise signal according to claim 17, wherein said desired sound signal is a far-end voice communications signal.

19. The apparatus for producing an antinoise signal according to claim 17, wherein said desired sound signal is a sidetone signal.

20. The apparatus for producing an antinoise signal according to claim 11, wherein said update for said filter gain is based on a calculated energy of said error signal.

21. The apparatus for producing an antinoise signal according to claim 11, wherein said calculating the second filter state includes, for each of a plurality of subbands of said error signal, calculating an energy of the subband, and wherein said update for said filter gain is based on said calculated energies.

22. The apparatus for producing an antinoise signal according to claim 11, wherein said apparatus is configured to mix the antinoise signal with a desired sound signal, and wherein said update is based on a ratio between a calculated energy of said error signal and a calculated energy of a sum of (A) said second filtered signal and (B) the desired sound signal.

23. The apparatus for producing an antinoise signal according to claim 11, wherein said apparatus is configured to mix the antinoise signal with a desired sound signal, and wherein said update includes, for each of a plurality of subbands of the filtered signal, a corresponding one among a plurality of subband updates, and wherein each among said plurality of subband updates is based on a sum, in the subband, of the second filtered signal and the desired sound signal.

24. The apparatus for producing an antinoise signal according to claim 23, wherein each of said plurality of subbands is within the range of 200 to 2000 Hertz.

25. The apparatus for producing an antinoise signal according to claim 11, wherein said first state of the digital filter includes a first set of filter coefficient values, and wherein said second state of the digital filter includes a second set of filter coefficient values that is different than said first set, and wherein, during said first time interval, the digital filter is configured to produce the filtered signal by filtering the reference noise signal according to the first set of filter coefficient values, and wherein, during said second time interval, the digital filter is configured to produce the filtered signal by filtering the reference noise signal according to the second set of filter coefficient values.

26. The apparatus for producing an antinoise signal according to claim 25, wherein said control block is configured to calculate the second set of filter coefficient values according to a least-mean-squares algorithm, based on information from the reference noise signal and on information from the error signal.

27. An apparatus for producing an antinoise signal, said apparatus comprising:

an integrated circuit comprising a digital filter and configured to produce the antinoise signal during a first time interval by applying the digital filter to a reference noise signal according to a first state of the digital filter that includes a filter gain; and a computer-readable medium having tangible structures that store machine-executable instructions which when executed by at least one processor cause the at least one processor to calculate a second state of the digital filter that is different than the first state of the digital filter and includes an update for said filter gain, wherein the integrated circuit is configured to produce the antinoise signal during a second time interval subsequent to the first time interval by applying the digital filter to the reference noise signal according to the second state of the digital filter, and wherein said digital filter includes:

a filter configured to filter the reference noise signal, in a filtering domain having a first sampling rate, to produce a filtered signal; and a gain control element configured to control a gain of the filtered signal according to the filter gain to produce the antinoise signal, and wherein said calculating the second state of the digital filter includes:

applying a copy of said filter to the reference noise signal, in an adaptation domain having a second sampling rate that is lower than the first sampling rate, to produce a second filtered signal; and calculating said update based on information from said second filtered signal and on information from an error signal.

28. The apparatus for producing an antinoise signal according to claim 27, wherein said error signal is based on a signal that is produced by a microphone in response to an acoustic signal based on said antinoise signal.

29. The apparatus for producing an antinoise signal according to claim 27, wherein said apparatus is configured to mix the antinoise signal with a desired sound signal, and wherein said calculating said update is based on a sum of the second filtered signal and the desired sound signal.

30. The apparatus for producing an antinoise signal according to claim 27, wherein said calculating the second state of the digital filter includes, for each of a plurality of subbands of said error signal, calculating an energy of the subband, and wherein said update for said filter gain is based on said calculated energies.

* * * * *